US006215969B1

(12) United States Patent
Nomura et al.

(10) Patent No.: US 6,215,969 B1
(45) **Date of Patent: *Apr. 10, 2001**

(54) TONER CONTAINER, TONER CONTAINER ASSEMBLING METHOD, PROCESS CARTRIDGE, AND ELECTROPHOTOGRAPHIC IMAGE FORMING APPARATUS

(75) Inventors: Yoshiya Nomura, Tokyo; Kanji Yokomori; Shigeo Miyabe, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/122,766

(22) Filed: Jul. 27, 1998

Related U.S. Application Data

(62) Division of application No. 08/944,985, filed on Oct. 7, 1997, now Pat. No. 5,878,309, which is a continuation of application No. 08/543,836, filed on Oct. 16, 1995, now abandoned.

(30) Foreign Application Priority Data

| | | |
|---|---|---|
| Oct. 17, 1994 | (JP) | 6-250382 |
| Jun. 13, 1995 | (JP) | 7-145979 |
| Jul. 31, 1995 | (JP) | 7-215446 |

(51) Int. Cl.[7] ..... G03G 21/16

(52) U.S. Cl. ..... 399/111; 399/106; 399/119

(58) Field of Search ..... 399/110, 111, 399/113, 119, 120, 106

(56) References Cited

U.S. PATENT DOCUMENTS

| | | | |
|---|---|---|---|
| 4,076,149 | 2/1978 | Saxinger | 222/202 |
| 4,583,660 | 4/1986 | La Barre et al. . | |
| 4,591,258 | 5/1986 | Nishino et al. . | |

(List continued on next page.)

FOREIGN PATENT DOCUMENTS

| | | |
|---|---|---|
| 0068858 | 1/1983 | (EP) . |
| 0257178 | 3/1988 | (EP) . |
| 0281372 | 9/1988 | (EP) . |

(List continued on next page.)

OTHER PUBLICATIONS

Patent Abstract, Japanese, vol. 012, No. 100 (P–683), Feb. 1988, English Abstract of Japanese Patent No 62–231976.

J. Mort, *The Anatomy of Xerography: Its Invention and Evolution*, McFarland & Company, USA, 1989, p. 127.

(List continued on next page.)

*Primary Examiner*—William J. Royer
(74) *Attorney, Agent, or Firm*—Fitzpatrick, Cella, Harper & Scinto

(57) ABSTRACT

A toner container for containing toner to be used for developing a latent image formed on an electrophotographic photosensitive member by a developing device, usable with a process cartridge detachably mountable to a main assembly of an electrophotographic image forming apparatus, the process cartridge containing the photosensitive member and the developing device, includes: a first frame having a toner supply opening for supplying the toner to the developing device and a mounting portion for mounting a rotatable stirring member for stirring the toner contained in the toner container; a second frame coupled with the first frame and having an outward projection without interference with a rotational region of the stirring member; wherein the toner container is formed by coupling the first frame and second frame.

78 Claims, 36 Drawing Sheets

U.S. PATENT DOCUMENTS

| | | | | |
|---|---|---|---|---|
| 4,797,704 | * | 1/1989 | Williams et al. | 399/119 |
| 4,924,267 | | 5/1990 | Yoshikawa et al. . | |
| 5,047,803 | | 9/1991 | Kanoto . | |
| 5,079,589 | | 1/1992 | Shibata et al. . | |
| 5,083,166 | * | 1/1992 | Hill et al. | 399/119 |
| 5,091,748 | | 2/1992 | Morisawa et al. . | |
| 5,095,339 | | 3/1992 | Terashima . | |
| 5,103,765 | | 4/1992 | Owada et al. . | |
| 5,126,789 | | 6/1992 | Fukuchi et al. . | |
| 5,133,283 | | 7/1992 | Masuda . | |
| 5,142,322 | | 8/1992 | Surti . | |
| 5,153,643 | | 10/1992 | Nagakura . | |
| 5,177,529 | | 1/1993 | Schroll et al. . | |
| 5,325,163 | | 6/1994 | Nishio . | |
| 5,331,373 | | 7/1994 | Nomura et al. . | |
| 5,452,056 | | 9/1995 | Nomura et al. . | |
| 5,463,446 | | 10/1995 | Watanabe et al. . | |
| 5,485,249 | | 1/1996 | Higeta et al. . | |
| 5,500,714 | | 3/1996 | Yashiro et al. . | |
| 5,510,878 | | 4/1996 | Noda et al. . | |
| 5,537,187 | | 7/1996 | Sekine . | |
| 5,555,461 | | 9/1996 | Ackerman | 347/33 |
| 5,585,889 | | 12/1996 | Shishido et al. . | |
| 5,614,992 | | 3/1997 | Kikuchi et al. | 399/124 |
| 5,623,328 | | 4/1997 | Tsuda et al. . | |
| 5,640,649 | | 6/1997 | Kikuchi et al. | 399/111 |
| 5,652,647 | | 7/1997 | Yashiro et al. . | |
| 5,697,022 | | 12/1997 | Matsuda et al. . | |
| 5,802,433 | * | 9/1998 | Sato et al. | 399/111 |
| 5,828,929 | | 10/1998 | Watanabe et al. . | |
| 5,832,345 | * | 11/1998 | Damji et al. | 399/111 X |
| 5,867,751 | | 2/1999 | Nomura et al. . | |
| 5,875,374 | | 2/1999 | Kikuchi et al. . | |
| 5,890,036 | * | 3/1999 | Karakama et al. | 399/119 |
| 5,899,602 | * | 5/1999 | Noda et al. | 399/111 |
| 5,909,607 | | 6/1999 | Kikuchi et al. . | |

FOREIGN PATENT DOCUMENTS

| | | |
|---|---|---|
| 0285139 | 10/1988 | (EP) . |
| 0295187 | 12/1988 | (EP) . |
| 0306618 | 3/1989 | (EP) . |
| 0 395 004 | 10/1990 | (EP) . |
| 0 446 885 | 9/1991 | (EP) . |
| 0466173 | 1/1992 | (EP) . |
| 0468751 | 1/1992 | (EP) . |
| 0572738 | 12/1993 | (EP) . |
| 0586044 | 3/1994 | (EP) . |
| 0586046 | 3/1994 | (EP) . |
| 586401 | 9/1994 | (EP) . |
| 2163761 | 6/1990 | (JP) . |
| 4-18920 | 2/1992 | (JP) . |
| 6-19242 | 1/1994 | (JP) . |
| 6-83123 | 3/1994 | (JP) . |
| 6-208260 | 7/1994 | (JP) . |
| 6-317961 | 11/1994 | (JP) . |
| WO89/04511 | 5/1989 | (WO) . |
| WO 92/18910 | 10/1992 | (WO) . |

OTHER PUBLICATIONS

Xerox Disclosure Journal, "Improved Toner Hopper" (G. Bell, et al.), vol. 11, No. 3, May/Jun. 1986, pp. 117–120.

Patent Abstract of Japan, vol. 95, No. 010, 30 Nov. 1995 (JP 07–171967).

Patent Abstract of Japan, vol. 11, No. 321, 20 Oct. 1997 (JP 62–103147).

Patent Abstract of Japan, vol. 96, No. 002, 29 Feb. 1996 (JP 07–285226).

* cited by examiner

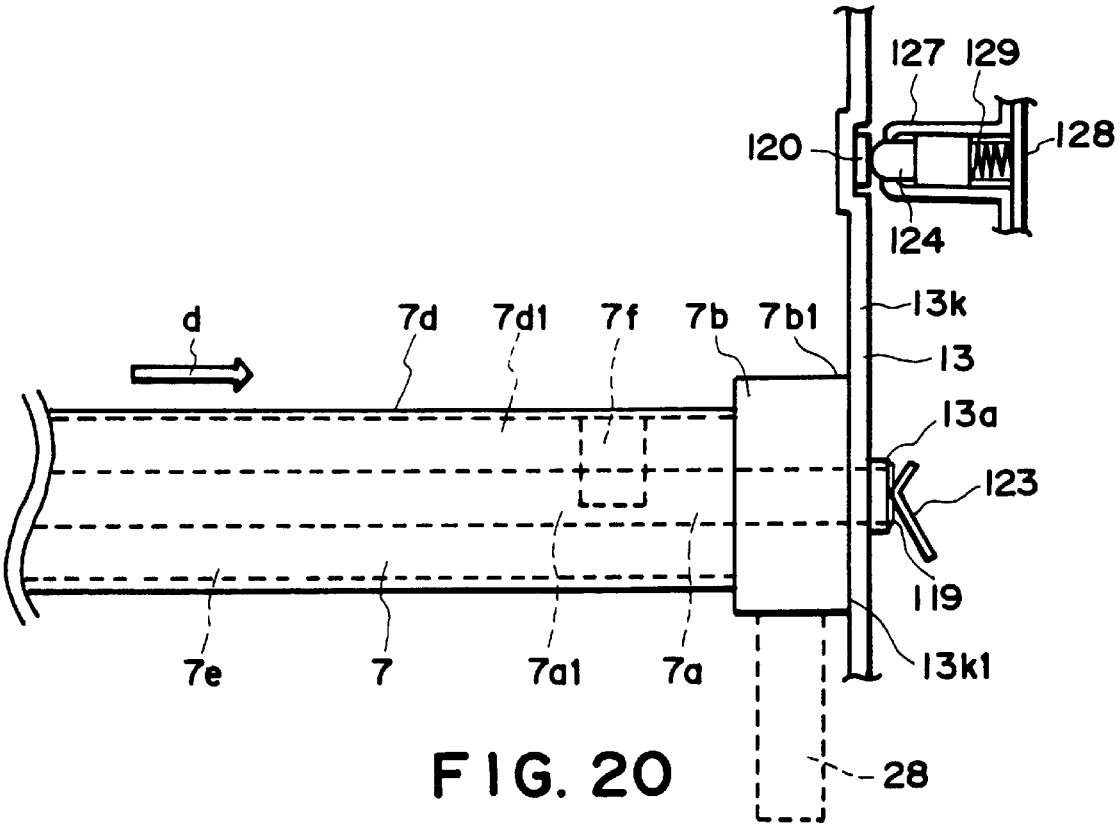
FIG. 20
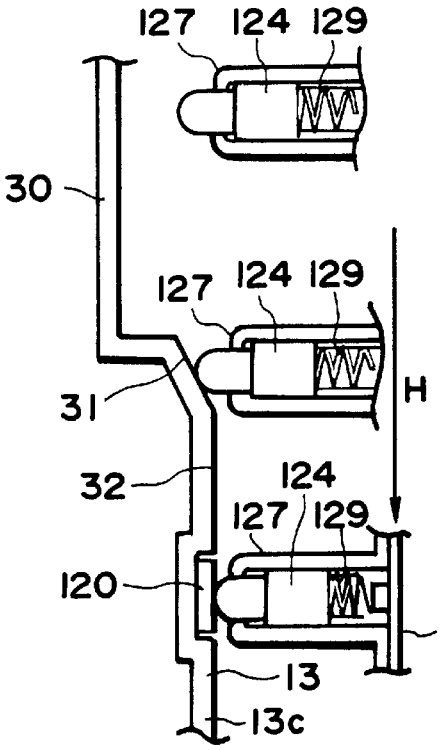
FIG. 21(a)
FIG. 21(b)
FIG. 21(c)

TONER CONTAINER, TONER CONTAINER ASSEMBLING METHOD, PROCESS CARTRIDGE, AND ELECTROPHOTOGRAPHIC IMAGE FORMING APPARATUS

This application is a divisional of U.S. patent application Ser. No. 08/944,985, filed on Oct. 7, 1997, now U.S. Pat. No. 5,878,309, which is a continuation of U.S. patent application Ser. No. 08/543,836, filed on Oct. 16, 1995, now abandoned.

FIELD OF THE INVENTION

The present invention relates to a toner container, an assembly method for the toner container, a process cartridge and an image forming apparatus usable with the process cartridge.

DESCRIPTION OF THE RELATED ART

Here, the electrophotographic image forming apparatus means an apparatus which forms images on recording medium, using an electrophotographic image forming process. It includes an electrophotographic copying machine, an electrophotographic printer (for example, a LED printer, a laser beam printer), an electrophotographic facsimile machine, an electrophotographic word processor, and the like.

The process cartridge means a cartridge having as a unit an electrophotographic photosensitive member, and charging means, developing means and cleaning means, which is detachably mountable to a main assembly of an image forming apparatus. It may include as a unit an electrophotographic photosensitive member and at least one of charging means, developing means and cleaning means. It may include as a-unit developing means and an electrophotographic photosensitive member.

An image forming apparatus using an electrophotographic process is known which is used with the process cartridge. This is advantageous in that the maintenance operation can be, in effect, carried out by the users thereof without expert service persons, and therefore, the operativity can be remarkably improved. Therefore, this type is now widely used.

Some of the process cartridges of this type comprise a toner container.

However, in order to increase the amount of the containable toner, the container volume must be increased, which is rather difficult. Beside, assuming it is possible to successfully increase the container volume, there arises another problem in that a method for efficiently feeding out the toner from the large capacity toner container must be devised.

Thus, the present invention was made to further develop the aforementioned art.

SUMMARY OF THE INVENTION

Accordingly, it is a principal object of the present invention to provide a toner container, toner container assembling method, process cartridge and an electrophotographic image forming apparatus, wherein the toner contained in the toner container can be used efficiently.

It is another object of the present invention to provide a toner container, toner container assembling method, process cartridge and an electrophotographic image forming apparatus, wherein a large amount of the toner contained in the toner container can be used efficiently.

It is a further object of the present invention to provide a toner container constituted by coupling a first frame and a second frame, toner container assembling method, process cartridge and an electrophotographic image forming apparatus.

It is a further object of the present invention to provide a toner container having a first inclined surface and a second inclined surface, toner container assembling method, process cartridge and an electrophotographic image forming apparatus.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 9, (*b*) shows an outer appearance of a developing unit of the process cartridge of FIG. 3.

FIG. 19, (*b*) is a side view of an inside of the main assembly of the apparatus.

FIG. 20 shows contact between a contact member and a contact point.

FIG. 21 shows contact between a contact member and a contact point.

FIG. 23, (*b*) is a perspective view of an inside of a developing device holder.

DETAILED DESCRIPTION OF THE PREFERRED EMBODIMENTS

Figure 1:
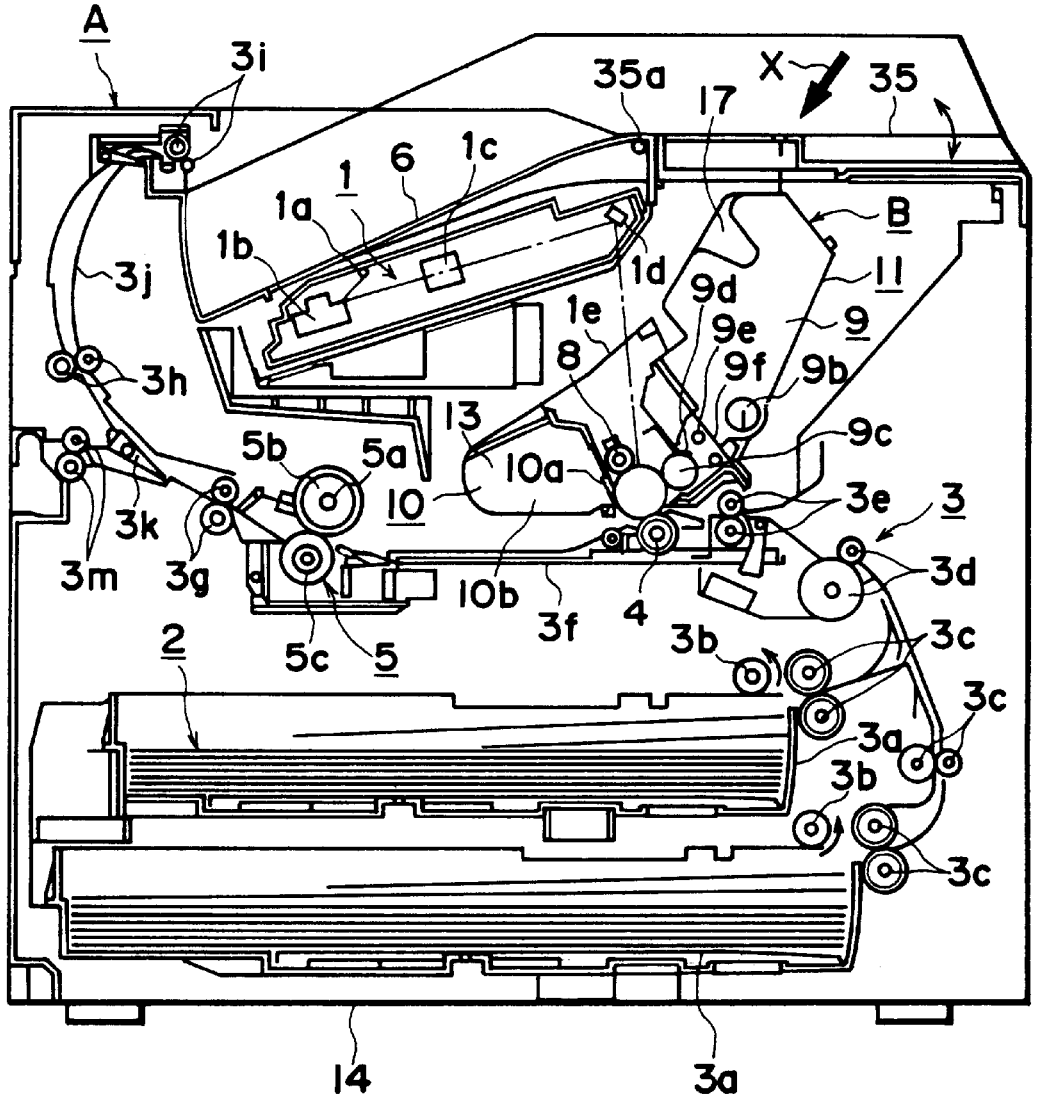
FIG. 1 is a side sectional view of an electrophotographic image forming apparatus according to a first embodiment of the present invention.
Figure 2:
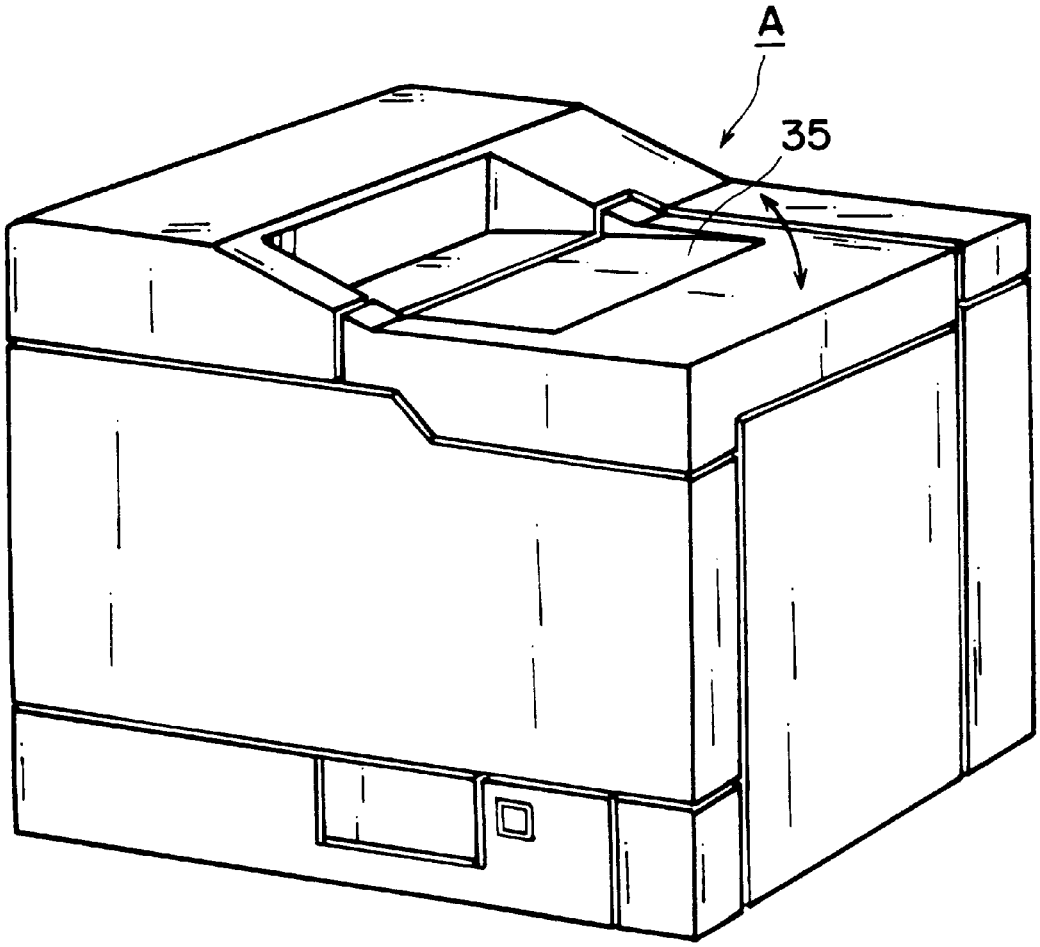
FIG. 2 shows an outer appearance of the apparatus of FIG. 1.
Figure 3:
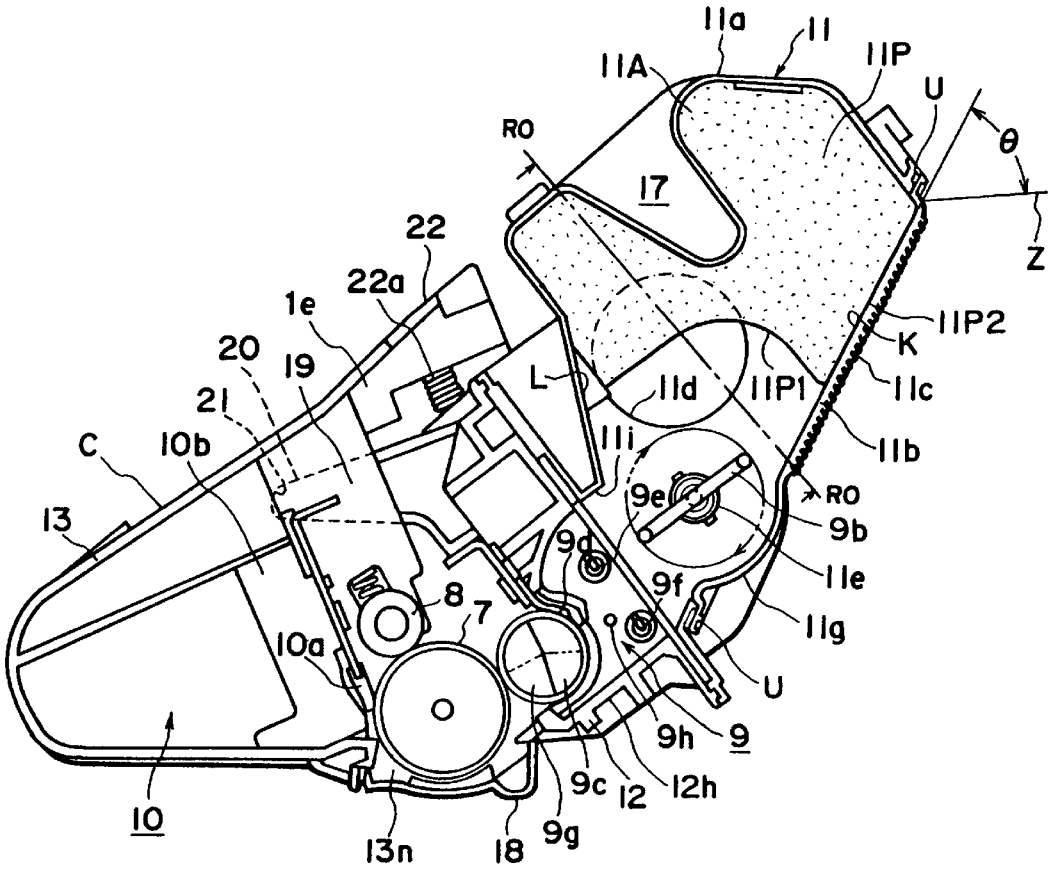
FIG. 3 is a side sectional view of a process cartridge according to an embodiment of the present invention.
Figure 4:
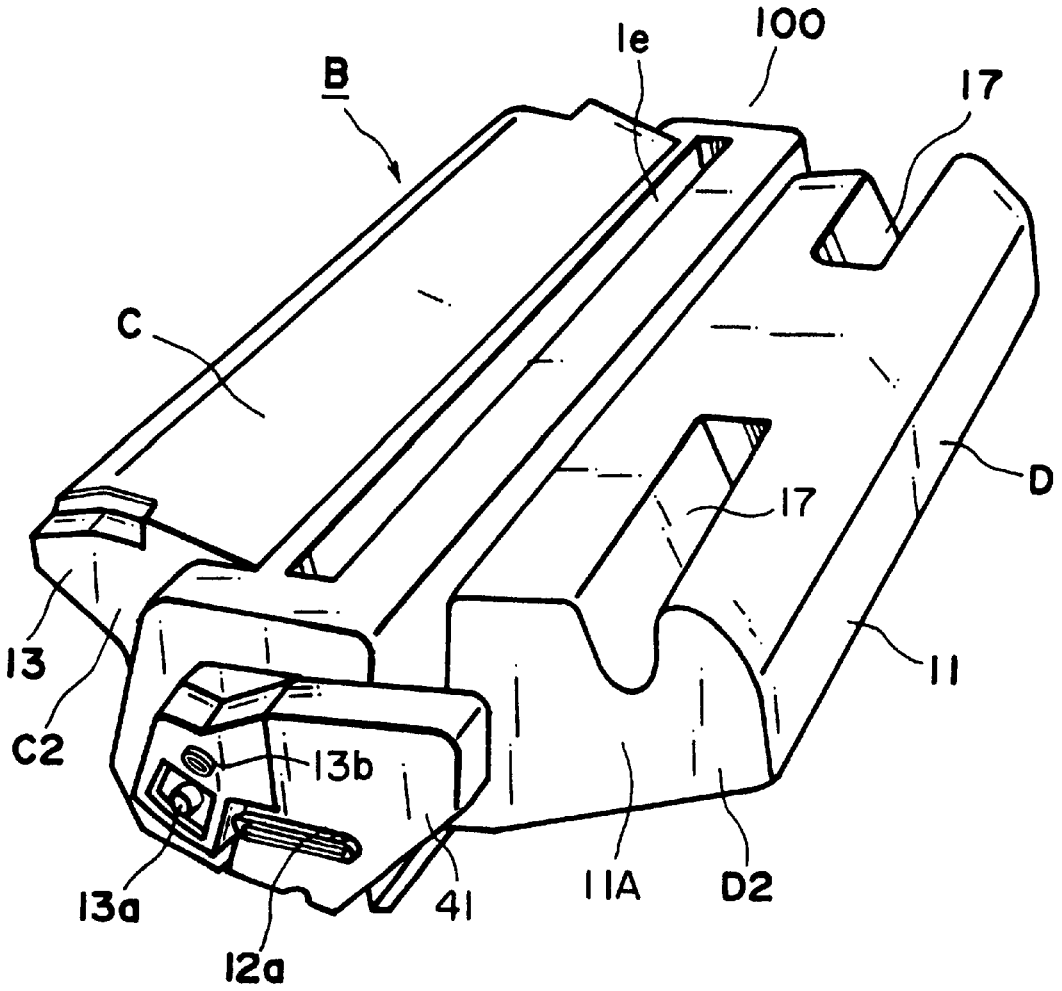
FIG. 4 shows a schematic outer appearance of the process cartridge of FIG. 3.
Figure 5:
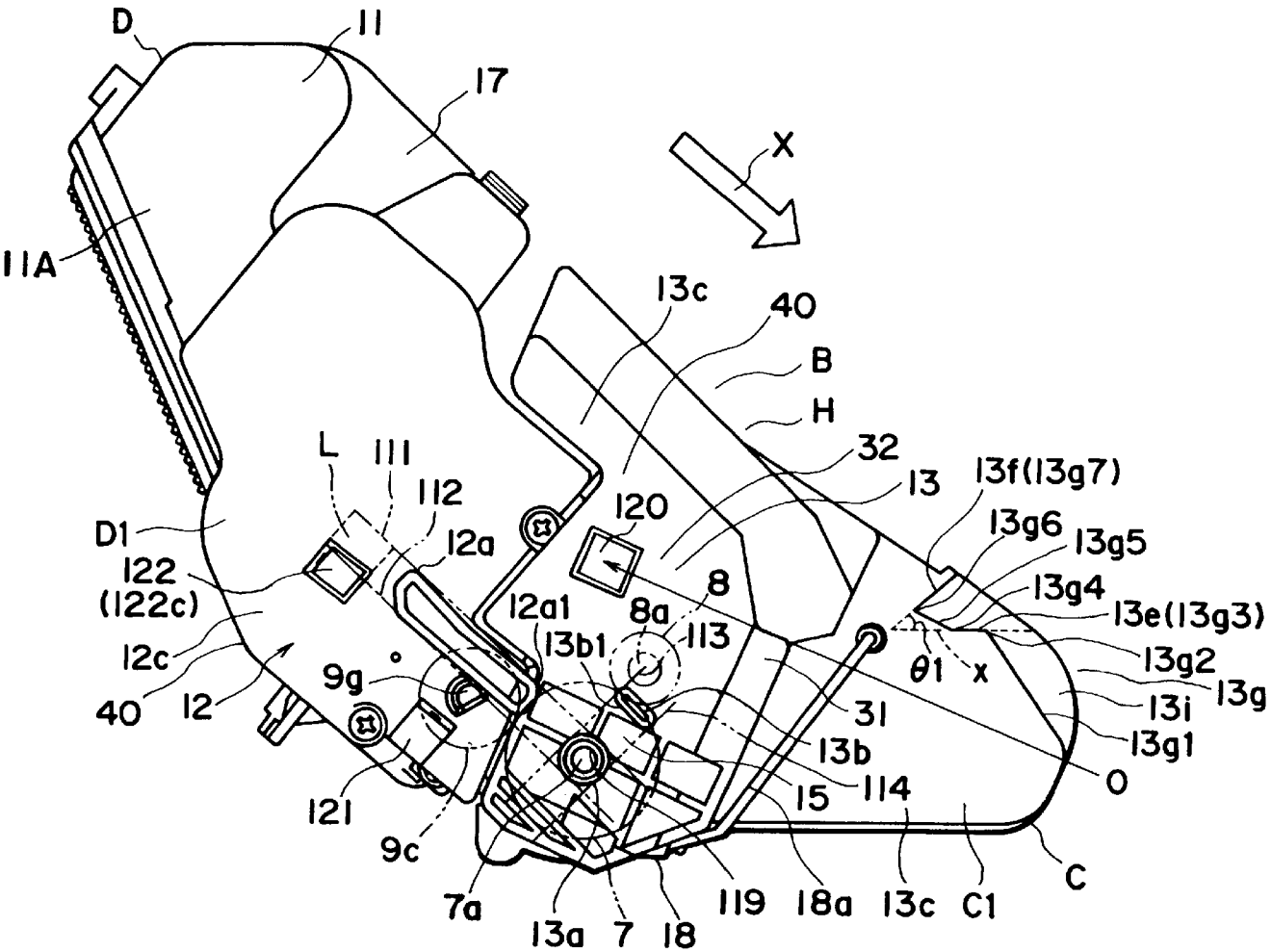
FIG. 5 is a right side view of the process cartridge of FIG. 3.
Figure 6:
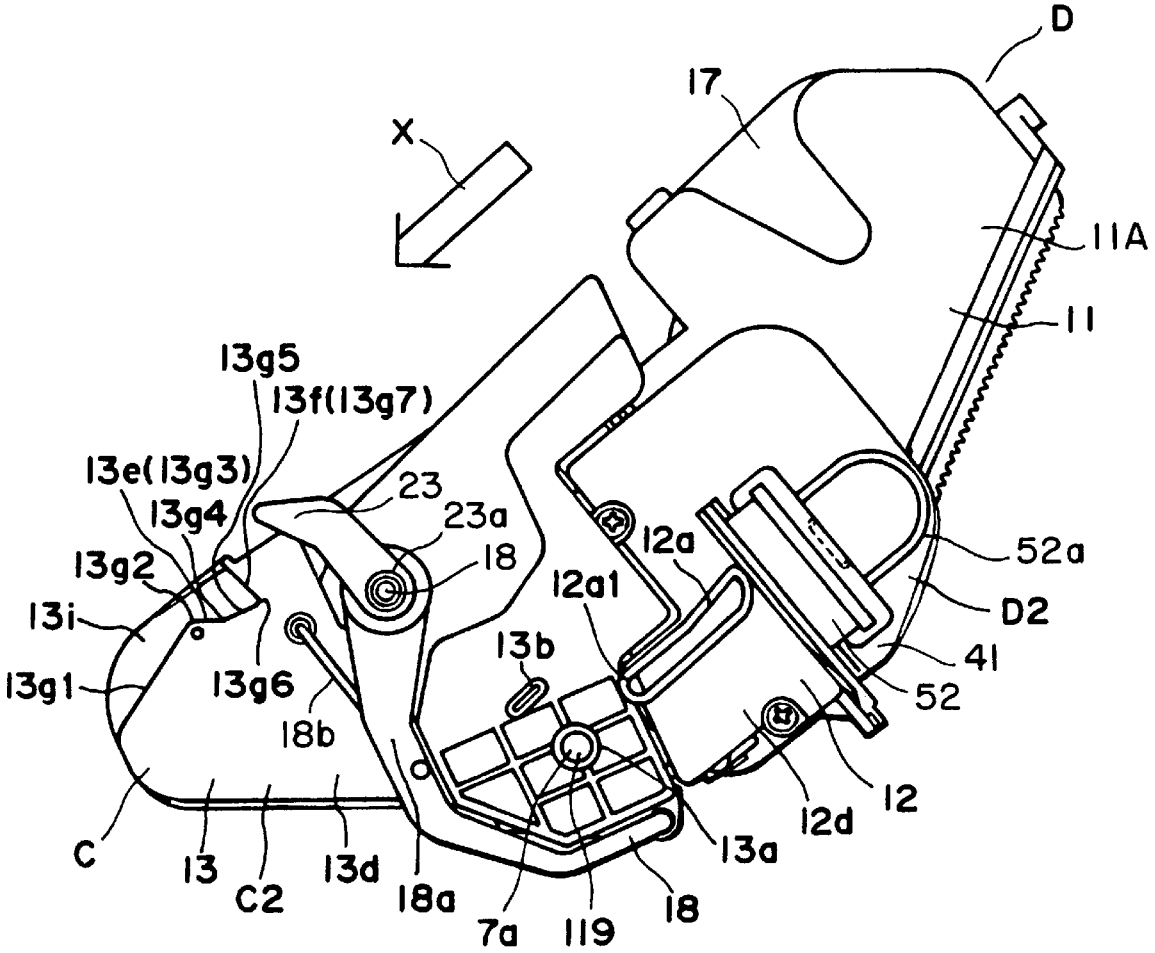
FIG. 6 is a left side view of the process cartridge of FIG. 3.
Figure 7:
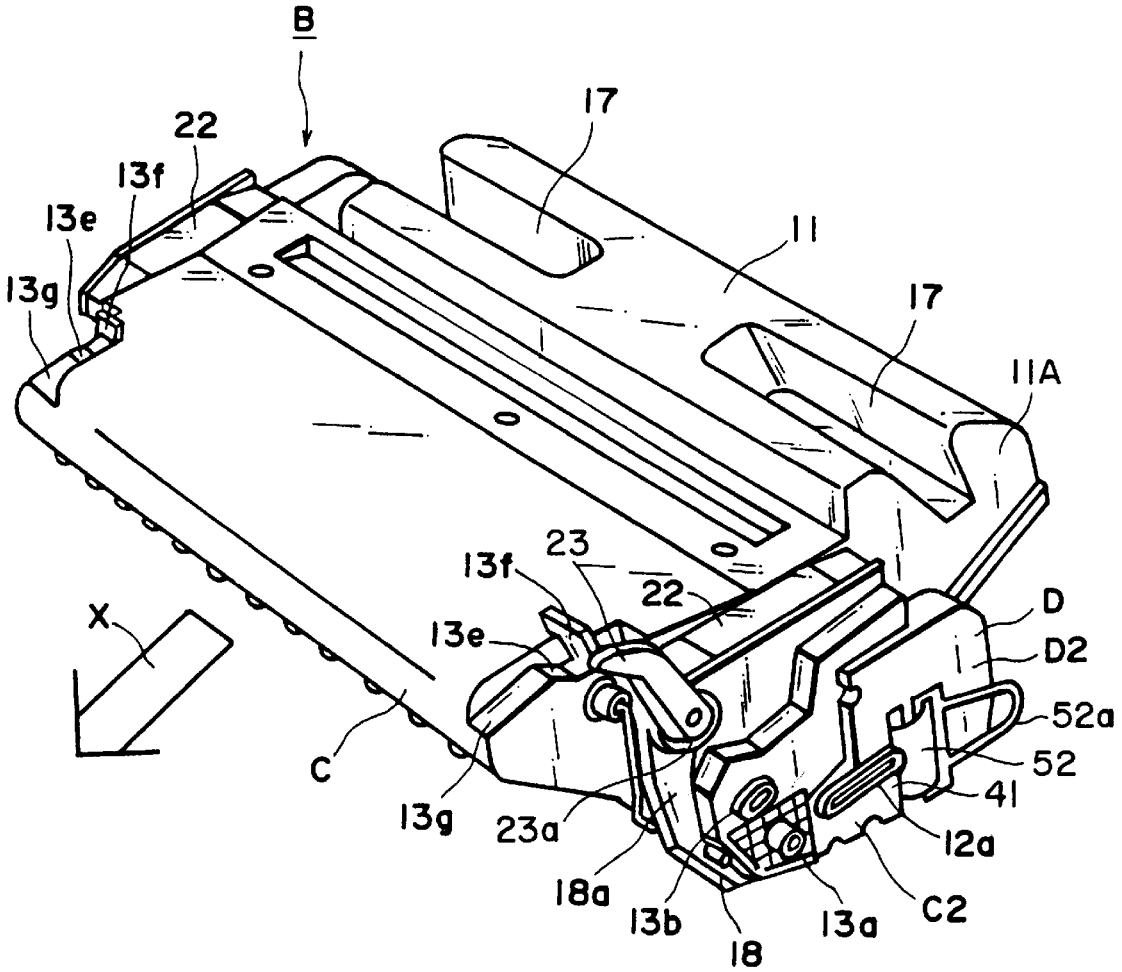
FIG. 7 shows an outer appearance of the process cartridge of FIG. 3.
Figure 8:
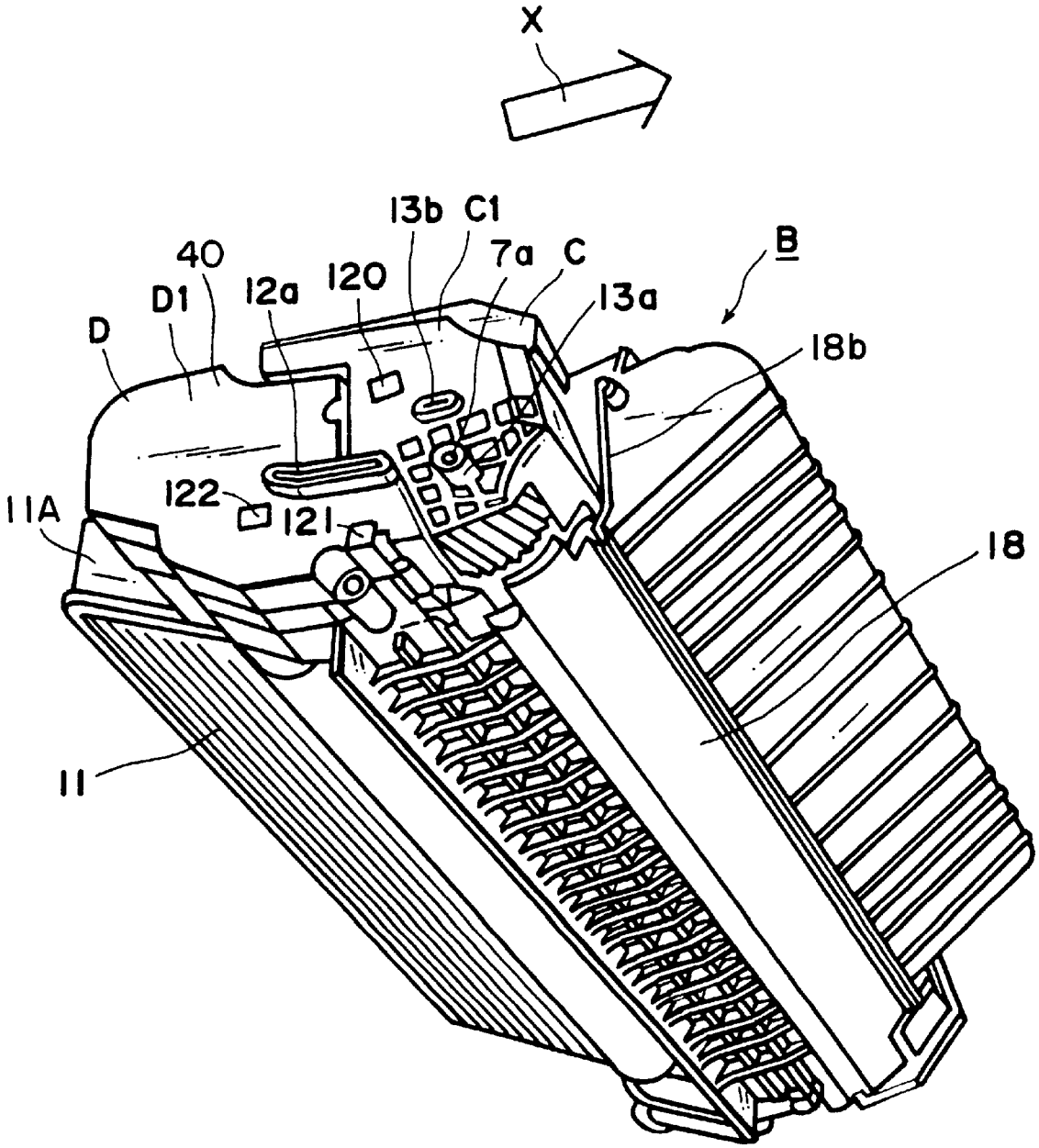
FIG. 8 shows an outer appearance of the process cartridge of FIG. 3, as seen from the bottom.

Hereinafter, the preferable embodiments of the present invention will be described. In the following descriptions, the widthwise direction of a process cartridge B means the direction in which the process cartridge B is inserted or removed from the main assembly 14 of an image forming apparatus (hereinafter, apparatus main assembly). This direction coincides with the direction in which the recording medium is conveyed. The longitudinal direction of the process cartridge B means the direction perpendicular (substantially) to the direction in which the process cartridge B is inserted or removed from the apparatus main assembly 14. This direction intersects with (is substantially perpendicular to) the direction in which the recording medium is conveyed. FIG. 1 is a schematic view of an embodiment of the electrophotographic image forming apparatus (laser beam printer) in accordance with the present invention, and FIG. 2 is an external perspective view thereof. FIGS. 3–8 are drawings depicting an embodiment of the process cartridge in accordance with the present invention. FIG. 3 is a sectional side view of the process cartridge; FIG. 4, an external perspective view thereof; FIG. 5, a right side view thereof; FIG. 6, a left side view thereof; FIG. 7, a perspective view as seen from above; and FIG. 8 is a perspective view as seen from below. Also in the following description, the top surface of the process cartridge B means the surface which faces upward when the process cartridge B is in the apparatus main assembly 14, and the bottom surface means the surface which faces downward when the process cartridge B is in the apparatus main assembly 14.

[Electrophotographic Image Forming Apparatus A and Process Cartridge B]

To begin with, referring to FIGS. 1 and 2, a laser beam printer as an electrophotographic image forming apparatus, to which the embodiment of the present invention has been applied, will be described. FIG. 3 is a side view of a process cartridge B.

Referring to FIG. 1, this laser beam printer A is of a type which forms an image on recording medium, for example, recording paper, OHP sheet, or fabric, through the electrophotographic image forming process. First, a toner image is formed on a drum shaped electrophotographically sensitive member (hereinafter, photosensitive drum) as an image bearing member. More specifically, the photosensitive drum is charged by charging means, and then, a laser beam is projected onto the charged photosensitive member from optical means in response to imaging data, to form a latent image on the photosensitive member in response to the imaging data. Next, this latent image is developed into a toner image by developing means. Meanwhile, a sheet of recording medium 2 placed in a cassette 3*a* is conveyed, being thereby fed out, by a conveying means 3 comprising a pair of pickup rollers 3*b* and 3*c*, and a pair of registration rollers 3*d* and 3*e*, and the like, in synchronism with the toner image formation. Next, a voltage is applied to a transfer roller 4 as transferring means, whereby the toner image formed on the photosensitive drum, which a process cartridge B comprises, is transferred onto the recording medium 2. Then, the recording medium having received the toner image is delivered to a fixing means 5. This fixing means 5 comprises a driving roller 5*c* and a fixing roller 5*b* containing a heater 5*a*, and applies heat and pressure to the recording medium 2, which is passed through the fixing means 5, whereby the transferred toner image is fixed. Next, the recording medium 2 now bearing the fixed toner image conveyed and discharged into a discharge tray 6, through a sheet-reversing path 3*j*, by a group of discharging roller pairs 3*g*, 3*h* and 3*i*. This discharge tray 6 is provided on the top surface of the apparatus main assembly 14 of the image forming apparatus A. The apparatus A comprises also a pivotable flapper 3*k* and a discharge roller pair 3*m*, and when this flapper 3*k* is operated, the recording medium 2 can be discharged without being flipped over through the discharge roller pair 3*m*, without going through the sheet-reversing path 3*j*. In this embodiment, the aforementioned pickup roller 3*b*, conveyer roller pairs 3*c* and 3*d*, register roller 3*e*, conveyer guide 3*f*, discharge roller pairs 3*g*, 3*h* and 3*i*, and discharge roller pair 3*m* constitute conveying means.

Referring to FIGS. 3–8, in the process cartridge B, the surface of a photosensitive drum 7 as the image bearing member with a photosensitive layer 7*e* (FIG. 20) is uniformly charged by applying a voltage to a charging roller 8, which is a charging means, while the photosensitive drum 7 is rotated. Next, a laser beam carrying the image data is projected by an optical system 1 onto the photosensitive drum 7 through an exposure opening 1*e,* whereby a latent image is formed on the photosensitive drum 7. This latent image is developed with toner by a developing means 9.

The charging roller 8 is placed in contact with the photosensitive drum 7 to charge the photosensitive drum 7, wherein this charging roller 8 is rotated by the rotation on the photosensitive drum 7. The developing means 9 develops the latent image formed on the photosensitive drum 7, by supplying the toner to the photosensitive drum 7, on the regions to be developed. The optical system 1 comprises a laser diode 1*a,* a polygon mirror 1*b,* a lens 1*c,* and a full reflection mirror 1*d.*

As the toner stirring member 9*b* of the aforementioned developing means 9 is rotated, the developing means 9 stirs the toner within the toner container 11A, and sends it toward the developing roller 9*c*, and as a developing roller 9*c*, in which a magnet is fixed, is rotated, a layer of toner triboelectrically charged by a developing blade 9*d* is formed on the surface of the developing roller 9*c*. The toner is supplied from this toner layer to the photosensitive drum 7, on the region to be developed. As the toner is transferred onto the photosensitive drum 7 in correspondence with the latent image, the latent image is visualized. This developing blade 9*d* regulates the amount of the toner coated on the peripheral surface of the developing roller 9*c*. Also, stirring members 9*e* and 9*f* for stirring and circulating the toner are rotatively mounted adjacent to the developing roller 9*c*.

Next, a voltage with a polarity opposite to that of the toner image is applied to the transfer roller 4, whereby the toner image on the photosensitive drum 7 is transferred onto the recording medium 2. Then, the residual toner on the photosensitive drum 7 is removed by a cleaning means 10. The cleaning means 10 comprises an elastic cleaning blade 10*a,* which is disposed in contact with the photosensitive drum 7. The toner remaining on the photosensitive drum 7 is scraped off by the elastic cleaning blade 10*a* to be collected in a waste toner collector 10*b.*

The process cartridge B is formed by combining: a toner chamber portion 11 of the cartridge frame (hereinafter toner chamber frame), which constitutes a portion of the toner container 11A (toner containing portion) for storing the toner; a developing chamber portion 12 of the frame (hereinafter, developing chamber frame), which contains the developing means such as the developing roller 9*c*; and a cleaning means portion 13 of the frame (hereinafter, cleaning means frame), which comprises the photosensitive drum 7, cleaning means such as the cleaning blade 10*a,* charging roller 8, and the like. This process cartridge B is removably installed in the apparatus main assembly 14 by an operator.

The process cartridge B is provided with an exposure opening 1*e,* which allows the light beam carrying the image data to be irradiated onto the photosensitive drum 7, and a transfer opening 13*n,* which allows the photosensitive drum 7 to face directly the recording medium 2. More specifically, the exposure opening 1*e* is provided in the cleaning means portion 13, and the transfer opening 13*n* is formed between the developing chamber portion 12 and cleaning means portion 13.

Next, the structure of the housing of an embodiment of the process cartridge B according to the present invention will be described.

This process cartridge B in accordance with the present invention is assembled in the following manner. First, the toner chamber frame 11 and developing chamber frame 12 are joined. Then, the cleaning means frame 13 is rotatively attached to the structure formed by joining the preceding two frame portions, completing thereby a cartridge housing. Next, the aforementioned photosensitive drum 7, charging roller 8, developing means 9, cleaning means 10 and the like are disposed within the housing to complete the process cartridge B. The process cartridge B is removably installed in a cartridge installing means provided within the apparatus main assembly 14.

[Structure of Housing of Process Cartridge B]

The housing of the process cartridge B according to the present invention is constructed by joining the toner chamber frame 11, developing chamber frame 12, and cleaning means frame 13, and its structure will be described below.

Referring to FIGS. 3 and 9, the toner chamber frame 11 comprises a toner storing container portion 11A, in which the toner stirring member 9*b* for stirring and sending out the contained toner is mounted. The developing roller 9*c* and developing blade 9*d* are mounted on the developing chamber frame 12, and the stirring members 9*e* and 9*f*, which circulate the toner within the developing chamber, are rotatively mounted adjacent to the developing roller 9*c*. Further, an antenna rod 9*h* is disposed adjacent to the developing roller 9*c*, substantially in parallel thereto. The aforementioned toner chamber frame 11 and developing chamber frame 12 are melt-welded (by the ultrasonic welding in this embodiment) to form a developing unit D as an integral second frame member (refer to FIG. 9(*b*)).

The photosensitive drum 7, charging roller 8, and cleaning means 10 are mounted on the cleaning means frame 13. Further, a drum shutter member 18, which covers and protects the photosensitive drum 7 when the process cartridge B is out of the apparatus main assembly 14, is attached to the cleaning means portion 13 of the frame to form a cleaning unit C as the first frame member (refer to FIG. 9(*a*)).

Then, the developing unit D and cleaning unit C are joined with a joining member 22, in such a manner as to be pivotable relative to each other, to complete the process cartridge B. More specifically, referring to FIG. 9, an axis 20 is provided at the end of an arm portion 19 formed at each of the longitudinal ends (in the axial direction of the developing roller 9*c*) of the developing chamber portion 12 of the frame (refer to FIG. 9(*b*)). On the other hand, a recessed portion 21, in which the axis 20 is fitted to fix the positional relationship between the developing unit D and cleaning unit C, is provided at each of the longitudinal ends of the cleaning means portion 13 of the frame (refer to FIG. 9(*a*)). The joining member 22 is mounted on the cleaning means portion 13 of the frame by inserting the axis 20 into the recessed portion 21, whereby the developing and cleaning units D and C are joined in a manner so as to pivot relative to each other about the axis 20. The joining member 22 is provided with a compression spring 22*a*, so that the developing chamber frame 12 is pressed downward to reliably press the developing roller 9*c* toward the photosensitive drum 7. Further, a spacer ring 9*i* having a larger diameter than the developing roller 9*c* is provided at each of the longitudinal end portions of the developing roller 9*c,* wherein this ring 9*i* is pressed on the photosensitive drum 7 to keep a predetermined distance (approximately 300 $\mu$m) between the photosensitive drum 7 and developing roller 9*c*. Thus, the positional relationship between the peripheral surface of the photosensitive drum 7 and the peripheral surface of the developing roller 9*c* can be precisely maintained by the elastic force of the compression spring 22*a*.

[Structure of Guiding Means of Process Cartridge B]

Next, guiding means, which guides the cartridge B when the cartridge B is installed into the apparatus main assembly 14 or removed therefrom, will be described referring to FIGS. 4–9, wherein FIG. 5 is a right-hand side view of the cartridge B relative to the direction of an arrow mark X, in which the cartridge B is inserted into the apparatus main assembly 14 (right-hand side as seen from the developing unit D side), and FIG. 6 is a left-hand side view of the same.

As is evident from the drawings, the guiding means, which serves as a guide when the process cartridge B is inserted into the apparatus main assembly 14 or removed therefrom, is provided on each of the longitudinal end surfaces of the housing 100. This guiding means comprises a cylindrical guide 13*a* as a first guiding member, a long guide 12*a* as a second guiding member, and s short guide 13*b* as a third guiding member.

Figure 23A:
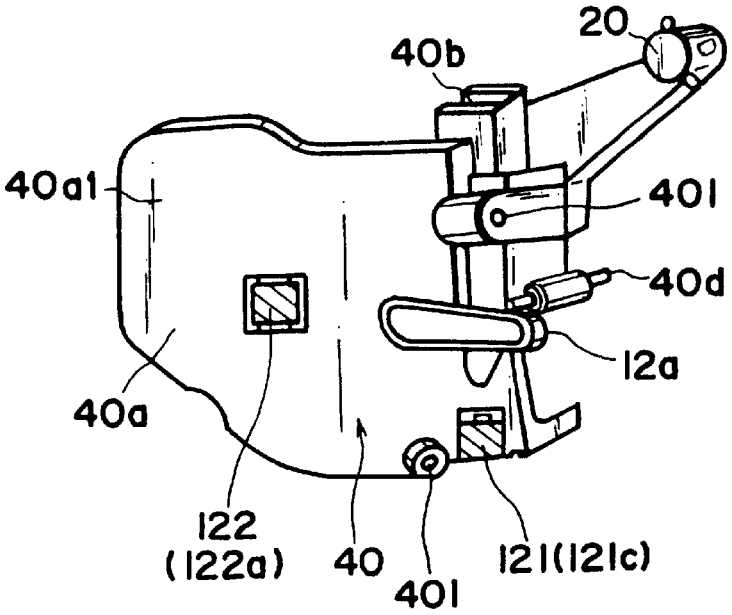
FIG. 23, (*a*) shows an outer appearance of a developing holder.
Figure 23B:
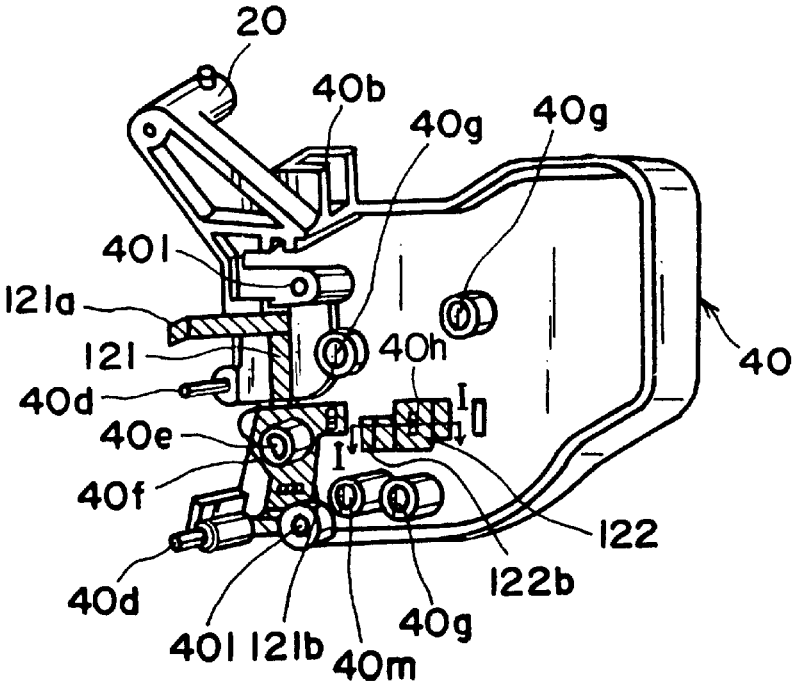

The cylindrical guide 13*a*, that is, a cylindrical member, projects outward from the lateral surface of the cleaning means frame 13, in line with the axis of the photosensitive drum 7. It supports the drum shaft 7*a*, which supports the photosensitive drum 7, in such a manner as not to rotate it. The long guide 12*a* is provided on each of the longitudinal end surfaces of the developing chamber frame 12, and bridges the surfaces of the developing chamber frame 12 and cleaning means frame 13. The short guide 13*b* is provided on each of the longitudinal end surfaces of the cleaning means frame 13, above the cylindrical guide 13*a*. More specifically, the long guide 12*a* is integrally formed on developing roller holders 40 and 41 (refer to FIG. 23), which will be described later. Further, the cylindrical guide 13*a* and short guide 13*b* are integrally formed on the cleaning means frame 13.

The long guide 12*a* extends in the direction (arrow X direction), in which the cartridge B is inserted, and its angle is set to be substantially equal to an angle at which the process cartridge B is inserted. The cylindrical guide 13*a* is disposed so as to fall in the path of the imaginary extension of the long guide 12*a* in the cartridge inserting direction, and the short guide 13*b* is substantially parallel to the long guide 12*a*. Referring to FIG. 6, the cylindrical guide 13*a*, second guide member 12*a*, third guide member 13*b* are also provided on the longitudinal side surface opposite to the one illustrated in FIG. 10, and their configuration and positions are the same as those shown in FIG. 5. These three guiding members project substantially the same distance from the external surface of the cleaning means frame 13 and developing chamber frame 12, which are in the same plane.

Hereinafter, a more detailed description will be given.

The cylindrical guide 13*a* as the first guiding member is provided on each of the lateral surfaces C1 (right-hand side 13*c*) and C2 (left-hand side 13*d*) of the cleaning unit C, wherein the side C1 is the right-hand side portion 13*c* of the cleaning means frame 13, relative to the axial direction of the photosensitive drum 7, as the cartridge B is seen from the developing unit D side (as the cartridge B is seen from the downstream side of the cartridge B inserting direction). The other side C2 is the left-hand side portion of the cleaning means frame 13, relative to the axial direction of the photosensitive drum 7. This cylindrical guide 13*a* is a cylindrical member, which projects from each of both longitudinal end surfaces 13*c* and 13*d* of the cleaning means frame 13 in the axial direction of the photosensitive drum 7. The drum shaft 7*a* is supported by this cylindrical member 13*a*, which fits around the drum shaft 7*a*. In other words, the drum shaft 7*a* is guided by the guiding member 16*a*, which will be described later, with the cylindrical member 13*a* being interposed, and then, the position of the drum shaft 7*a* is fixed by a groove 16*a*5 (refer to FIGS. 10–17).

The long guide 12*a* as the second guide member is provided on each of the longitudinal end surfaces D1 (right-hand portion 12*c*) and D2 (left-hand side 12*d*) of the developing unit D, wherein one surface, D1, of the lateral portion is the right-hand portion 12*c*, relative to the axial direction of the photosensitive drum 7, of the developing chamber frame portion 12, and the other surface, D2, is the left-hand side portion 12*d*, relative to the axial direction of the photosensitive drum 7, of the developing chamber frame portion 12. The long guide 12*a* is disposed away from the cylindrical guide 13*a*, being on the upstream side of the cylindrical guide 13*a*, relative to the cartridge inserting direction (arrow X direction). More precisely, the long guide 12*a* is disposed within a region L formed between the top and bottom imaginary lines 111 and 112 (FIG. 5) extended parallel in the inserting direction and tangentially from the peripheral surface of the cylindrical guide 13*a*, and this long guide 12*a* bridges between the developing chamber frame portion 12 and cleaning means frame portion 13, with its inserting end portion 12*a*1 extending over the lateral surface area of the cleaning frame portion 13 (by an approximate distance of 1 mm to 3 mm).

The short guide 13*b* as the third guiding member is provided on the lateral surfaces 13*c* and 13*d* of the cleaning unit C, above the cylindrical guide 13*a*. More specifically, the short guide 13*b* is substantially directly above the cylindrical guide 13*a* as seen from the cartridge inserting direction. In other words, the short guide 13*b* is disposed within the region 15 formed between two parallel lines 113 and 114, which are drawn in such a manner as to be tangent to the peripheral surface of the cylindrical guide 13*a* and substantially perpendicular to the cartridge inserting direction (arrow X direction). In addition, the short guide 13*b* is substantially parallel to the long guide 13*a*.

Here, typical measurements of the guiding members will be listed. Hereinafter, a tolerable range means the measurement range adopted in this embodiment of the process cartridge.

The cylindrical guide 13*a* is approximately 10.0 mm in diameter (tolerable range of 7.5 mm to 10.0 mm); the long guide 12*a*, approximately 36.0 mm in length (tolerable range of 15.0 mm to 41.0 mm) and approximately 8.0 mm in width (tolerable range D of 1.5 mm to 10.0 mm); and short guide 13*b* is approximately 10.0 mm in length (tolerable range of 3.0 mm to 17.0 mm) and approximately 4.0 mm (tolerable range of 1.5 mm to 7.0 mm) in width. Further, the distance between the peripheral surface of the cylindrical guide 13*a* and the inserting end portion 12*a*1 of the long guide 12*a* is approximately 9.0 mm.

The distance between the peripheral surface of the cylindrical guide 13*a* and the bottom end tip 13*b*1 of the short guide 13*b* is approximately 7.5 mm (tolerable range of 5.5 mm to 9.5 mm).

Next, a regulatory contact portion 13*e* and a disengagement contact portion 13*f*, which are provided on the top surface 13*d* of the cleaning unit C, will be described. Here, the top surface means such a portion of the cleaning unit C surface that is going to face upward when the process cartridge B is installed into the apparatus main assembly 14. In this embodiment, it is the top surface 13*i* of the cleaning unit C.

The regulatory contact portion 13*e* and disengagement contact portion 13*f* are provided on each of the right lateral end portion 13*c* and left lateral end portion 13*d* of this surface 13*i*. This regulatory contact 13*e* fixes the position of the process cartridge B in the apparatus main assembly 14. More specifically, when the process cartridge B is inserted into the apparatus main assembly 14, the contact 13*e* comes in contact with a fixing member 25 provided on the apparatus main assembly 14 (FIGS. 10–17), whereby the position of the process cartridge B is regulated. The disengagement contact portion 13*f* displays its function when the process cartridge B is removed from the apparatus main assembly 14. More specifically, when the process cartridge B is taken out of the apparatus main assembly 14, it comes in contact with the fixing member 25 to permit a moment to function to smoothly remove the cartridge B. The steps for installing or removing the process cartridge B will be described below with reference to FIGS. 10–17.

Describing in more detail, a recessed portion 13*g* is provided on the cleaning unit C, on the top surface 13*i* of the cleaning unit C, at each of the lateral edges relative to the cartridge inserting direction. This recess portion 13*g* is provided with: the first slanted surface 13*g*1, which extends upward toward the rear from the leading end of the cartridge B relative to the inserting direction (arrow X direction); the second slanted surface 13*g*3, which extends downward toward the rear from the top end 13*g*2 of the slanted surface 13*g*3; and the fourth slanted surface 13*g*5, which extends further downward toward the rear from the bottom end 13*g*4 of the slanted surface 13*g*3. At the bottom end 13*g*6 of the slanted surface 13*g*5, a wall (slanted or inclined surface) 13*g*7 is provided. The second slanted surface 13*g*3 corresponds to the regulatory contact portion 13*e*, and the wall 13*g*7 corresponds to the disengagement contact portion 13*f*.

Here, the typical measurements of the portions described above will be listed.

The regulatory contact portion 13*e* is angled by 0 degrees relative to the horizontal direction X (FIG. 5) of the cartridge B in the apparatus main assembly 14, and is approximately 6.0 mm in length (tolerable range of 4.5 mm to 8.0 mm). The disengagement contact portion 13*f* is slanted by 91 (approximately 45 degrees) relative to the horizontal direction 1, and is approximately 10.0 mm in length (tolerable range of 8.5 mm to 15.0 mm).

[Steps for Installing or Removing Process Cartridge]

Next, the steps for installing the process cartridge B into the apparatus main assembly 14, or removing it therefrom, will be described with reference to FIGS. 10–19.

Let it be assumed that the process cartridge B structured as described above can be installed into the cartridge accommodating means provided within the apparatus main assembly 14, and can be removed therefrom.

Figure 17:
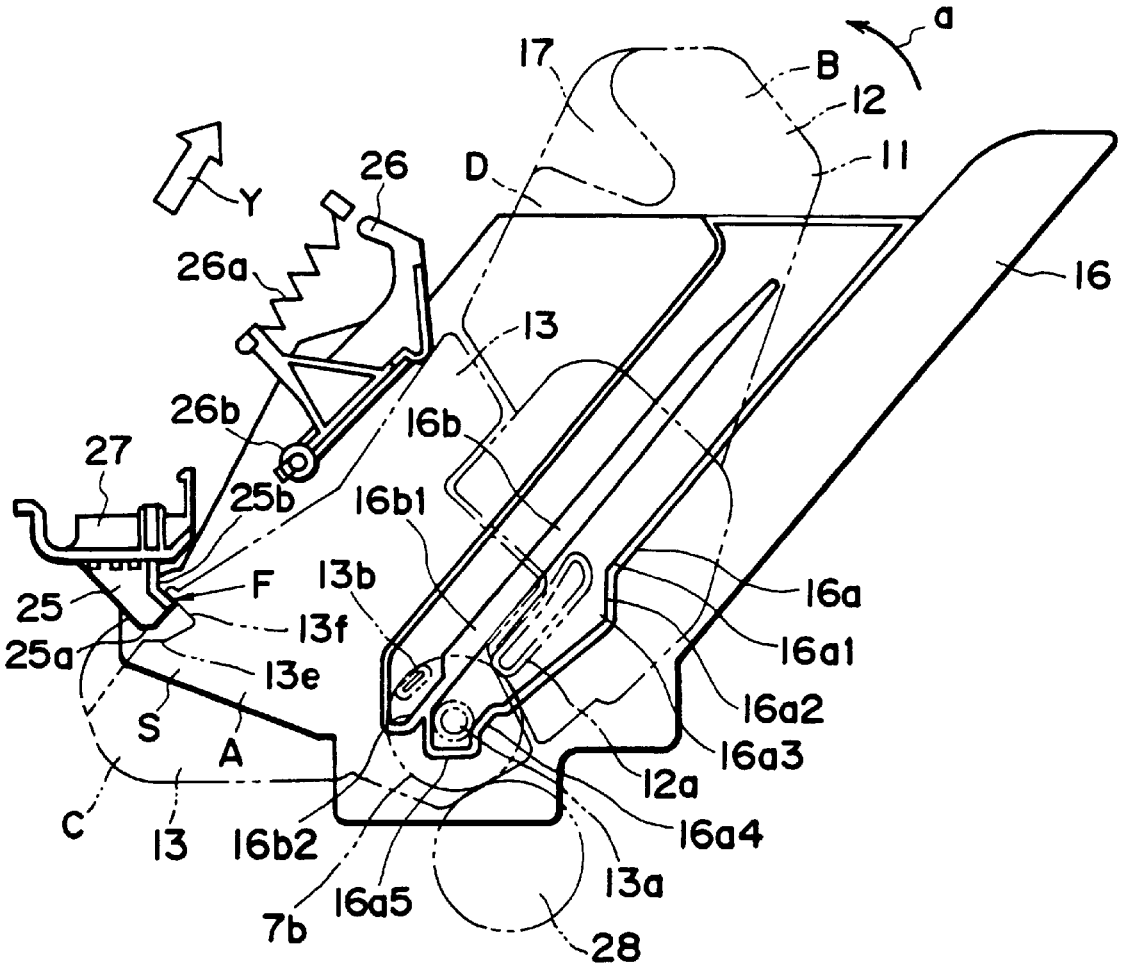
FIG. 17 is a side view illustrating a mounting and demounting operation of the process cartridge of FIG. 3 relative to the main assembly of the image forming apparatus.
Figure 18:
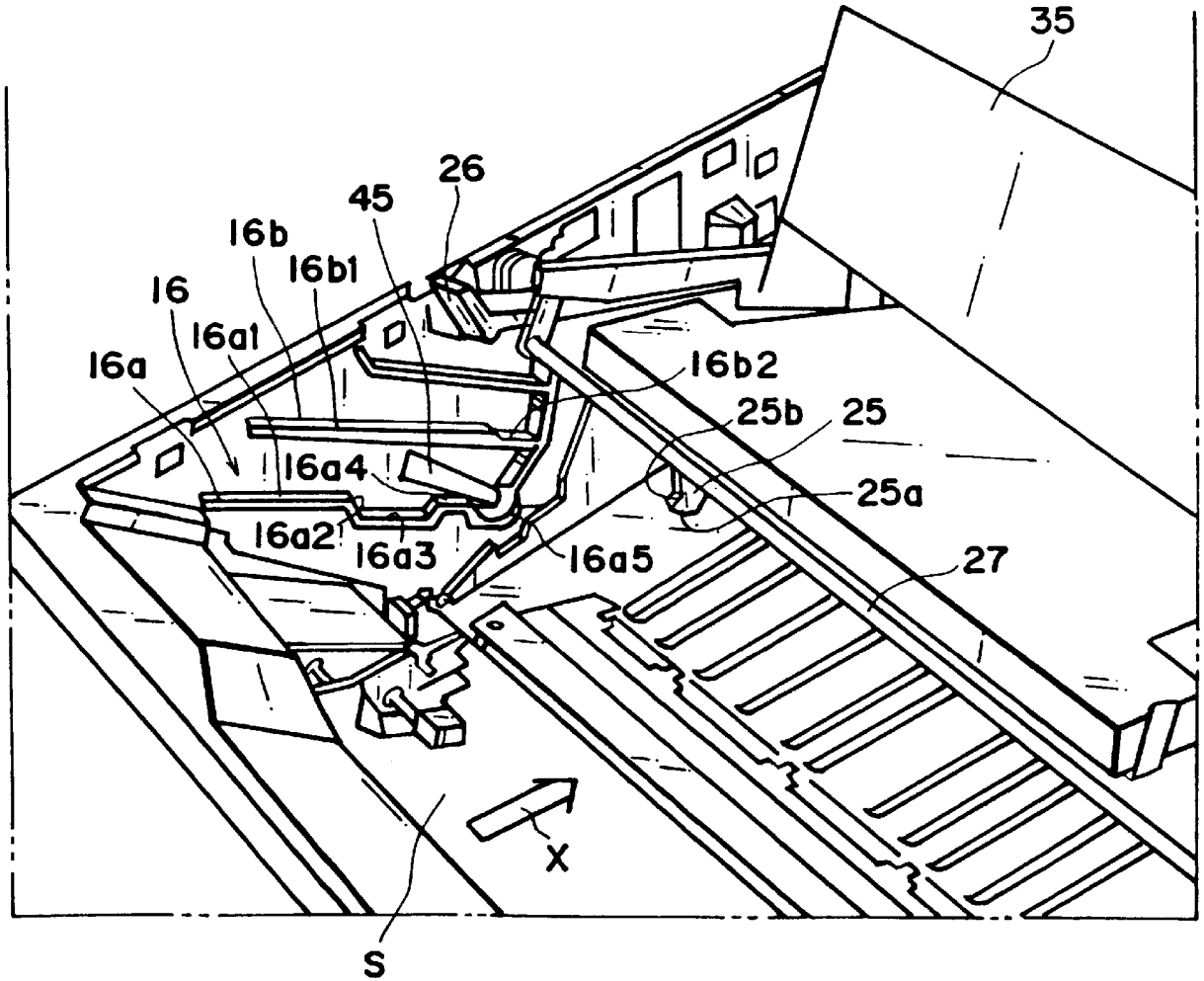
FIG. 18 is a perspective view of an inside of the main assembly of the apparatus.

Referring to FIGS. 18 and 19, as an operator opens a pivotal cover 35 by pivoting it about a supporting point 35*a*, a cartridge accommodating space S. and left and right cartridge installation guides 16, which are mounted on the corresponding sides of the apparatus main assembly 14, are exposed. Each of the cartridge installation guides 16 comprises a pair of guide portions of its own, that is, a first guide portion 16*a* and a second guide portion 16*b*, which correspond to the same on the opposite side. The installation of the process cartridge B into the apparatus main assembly 14 is accomplished by inserting the process cartridge B along the guide portions 16*a* and 16*b* and closing the cover 35. As for the inserting direction of the cartridge B, it is a direction which intersects with the axial line of the photosensitive drum 7; more specifically, such a direction that is substantially perpendicular to the axial line of the photosensitive drum 7 as illustrated in FIGS. 10–17. In this case, the cleaning unit C side is the leading side and the developing unit D side is the tailing side.

A recessed portion 17 is provided on the cartridge B, at each of the longitudinal ends, which makes it easier for an operator to hold it during its installation or removal (see FIG. 3); the operator uses both hands to hang onto the recessed portions, as handholds, of the process cartridge when installing or removing it.

Further, the process cartridge B comprises a drum shutter 18 (see FIG. 3), the movement of which is linked to the movement of the cartridge B during its installation or removal. When the cartridge B is removed from the laser beam printer assembly, the shutter 18 is closed to protect the portion of the photosensitive drum 7 which faces the transfer opening. This shutter member 18 is connected to each of the tips of an arm 18*a* and a link member 18*b*, being thereby supported, both of which are rotatively supported on the cleaning means frame 13 as illustrated in FIG. 6. Also referring to FIG. 6, as the process cartridge B is inserted in the apparatus main assembly 14 in the arrow X direction, the leading end of the lever 23, which is fixed to the arm 18*a* by its base portion, strikes a stopper (unillustrated) fixed on the apparatus main assembly 14, whereby the lever 23 is rotated about a supporting point 18*c* where the shutter arm 18*a* is supported, opening thereby the shutter member 18. As the process cartridge B is taken out of the apparatus main assembly 14, the shutter member 18 is closed due to the elastic force of a torsion spring 23*a*.

The first guide portion 16*a* is the bottom portion of the guide member 16, and guides the long guide 12*a* and cylindrical guide 13*a* provided on the process cartridge B side. This first guide portion 16*a* comprises a main guide portion 16*a*1, a stepped portion 16*a*2, a recessed portion 16*a*3, an auxiliary guide portion 16*a*4, and a positioning groove 16*a*5, which are disposed in this order from the upstream side toward the downstream relative to the inserting direction. The main guide portion 16*a*1 guides the long guide 12*a* and cylindrical guide 13*a*. The auxiliary guide portion 16*a*4 guides the cylindrical guide 13*a* into the positioning groove 16*a*5. The positioning groove 16*a*5 is where the cylindrical guide 13*a* is fitted to regulate the position of the cartridge B in the apparatus main assembly 14. The second guide portion 16*b* is the upper portion of the guide member 16, and comprises a slanted surface 16*b*1 and a recess 16*b*2, which are disposed in this order from the upstream side toward the downstream relative to the inserting direction.

Figure 15:
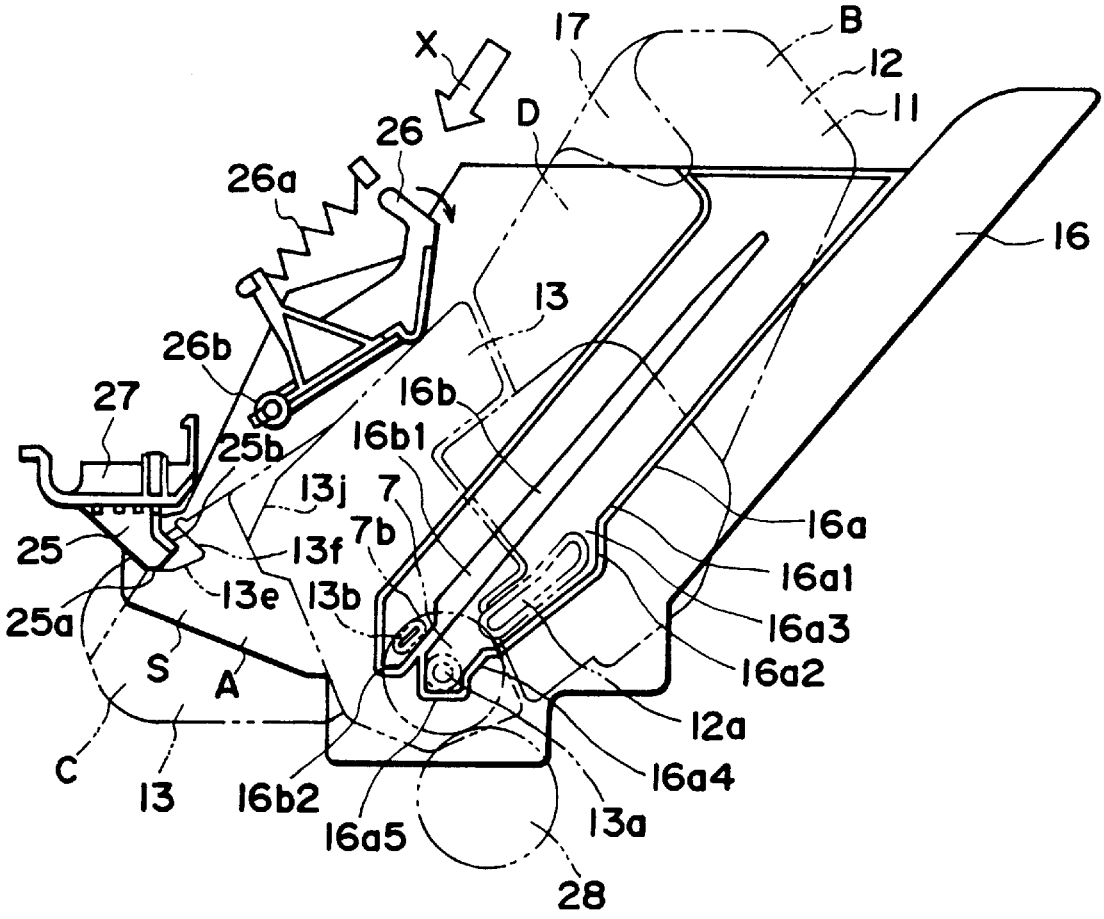
FIG. 15 is a side view illustrating a mounting and demounting operation of the process cartridge of FIG. 3 relative to the main assembly of the image forming apparatus.

Further, in the cartridge accommodating space S of the apparatus main assembly 14, a fixed member 25 (member for regulating the rotation) is provided on the left and right sides. It is fixed to a stay 27. This fixed member 25 comes in contact with the aforementioned regulatory contact portion 13*e* to regulate the clockwise rotation of the cartridge B (FIG. 15). More specifically, the cartridge B is accurately positioned in the apparatus main assembly 14 as the cylindrical guide 13*a* fits into the groove 16*a*5 and the regulatory contact 13*e* comes in contact with the fixed member 25. Further, when the cartridge B is taken out, the fixed member 25 comes in contact with the disengagement contact portion 13*f* to facilitate the smooth removal of the cartridge B.

Further, in the cartridge accommodating space S, a pressing member 26 is disposed on the left and right sides (refer to FIGS. 10–19). This pressing member 26 pressed in the clockwise direction (FIGS. 10–17) by the elastic force of a coil spring 26*a* is rotatable about a fulcrum 26*b*, and elastically presses the top surface of the cartridge B, whereby the cartridge B is prevented from being vibrated when the apparatus A is subjected to vibration or the like.

Figure 10:
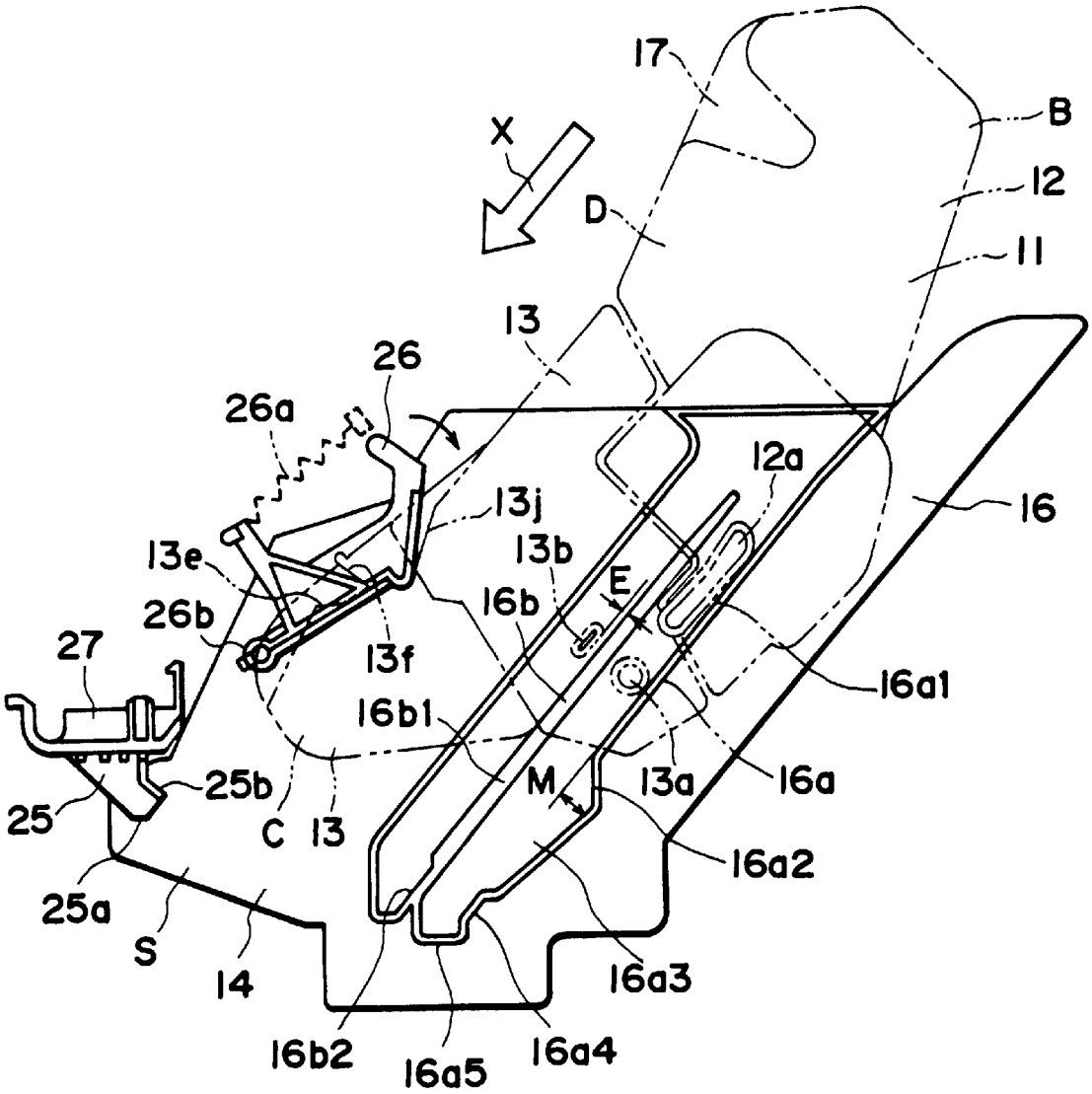
FIG. 10 is a side view illustrating a mounting and demounting operation of the process cartridge of FIG. 3 relative to the main assembly of the image forming apparatus.

Next, the relationship between the installation guide 16 provided on the apparatus main assembly 14 and the guide members 12*a*, 13*a* and 13*b* provided on the cartridge B, during the installation or removal of the cartridge B, will be described with reference to the drawings. FIGS. 10–15 are schematic drawings, which depict the steps for installing the process cartridge B from the beginning of the cartridge installation to the moment when the process cartridge B is finally positioned in a predetermined location. In FIGS. 10 and 15, the full side view of the process cartridge B is depicted with a solid line, and the installation guide member of the apparatus main assembly 14 is depicted with a double dot chain line (imaginary line). In FIGS. 11–14, which depict intermediary steps of the cartridge installation, only the guide members of the process cartridge B are depicted with the solid line, and the other portions are depicted with the double dot chain lines.

First, referring to FIG. 10, at the beginning of the cartridge B installation into the apparatus main assembly 14 by an operator, the cylindrical guide 13*a* and long guide 12*a* of the cartridge B are guided by the guide portion 16*a* in such a manner as to slide thereon. At this moment, the short guide 13*b* is not guided by the guide portion 16*b*, being away from it by a predetermined distance E (in this embodiment, approximately 2.0 mm to 4.0 mm).

Also at this moment, the pressing member 26 rotates upward following the slanted surface 13*i* provided on the top surface of the cartridge B, so that it does not interfere with the cartridge installation. As the cartridge B is being further inserted, the pressing member 26 keeps on sliding on the top surface of the cartridge B, checking thereby the upward movement of the cartridge B. Even after the cartridge B has been installed in the apparatus A, the pressing member 26 keeps on pressing on the top surface of the cartridge B as long as the cartridge B is in the apparatus A.

Figure 11:
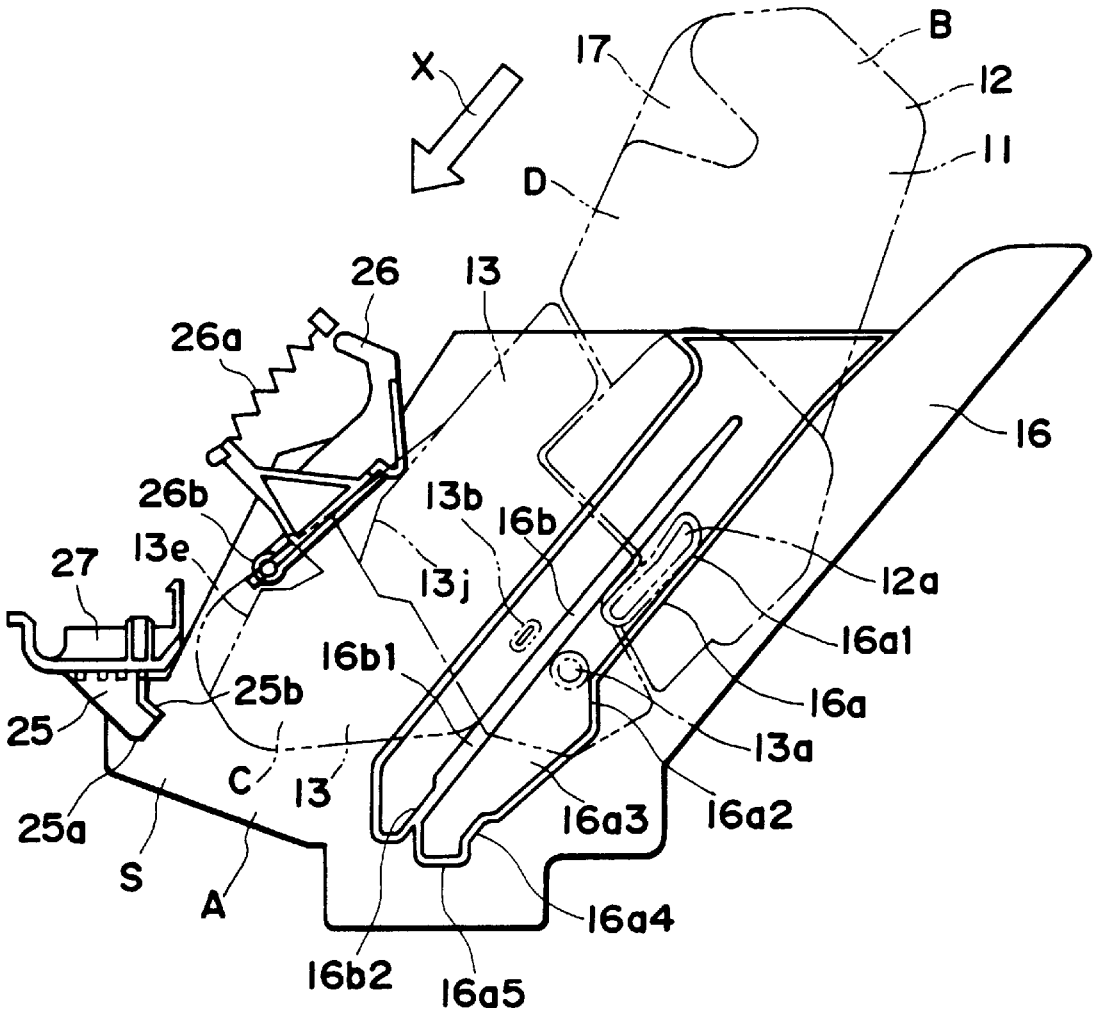
FIG. 11 is a side view illustrating a mounting and demounting operation of the process cartridge of FIG. 3 relative to the main assembly of the image forming apparatus.

Next, when the process cartridge B has been further inserted and is in the state depicted in FIG. 11, the cylindrical guide 13*a* is ready to pass the stepped portion 16*a*2 provided on the first installation guide portion 16*a* and to move onto the recessed portion 16*a*3 provided also on the first installation guide portion 16*a*. This recessed portion 16*a*3 of the guide portion 16*a* is to let go of the long guide 12*a* when the process cartridge B is inserted to a predetermined point (FIG. 15), and its depth M (FIG. 10; in this embodiment, approximately 4.0 mm to 8.0 mm) is set to be larger than the aforementioned distance E (E<M). It should be noted that at this moment, the short guide 13*b* is not in contact with the second guide portion 16*b* (upwardly slanted surface 16*b*1).

Figure 12:
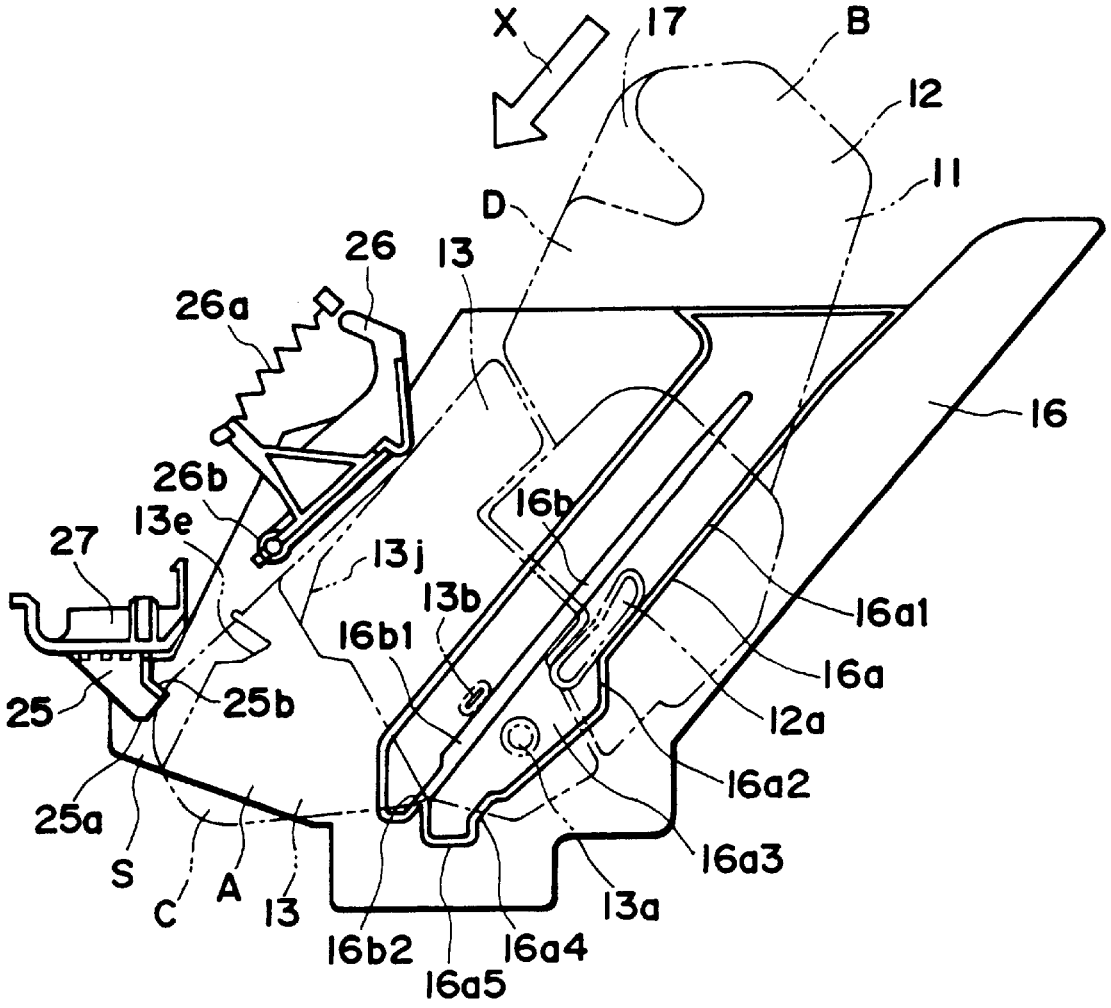
FIG. 12 is a side view illustrating a mounting and demounting operation of the process cartridge of FIG. 3 relative to the main assembly of the image forming apparatus.

Next, as the process cartridge B is further inserted until the state depicted in FIG. 12 is realized, the short guide 13*b* makes contact with the guide portion 16*b* before the cylindrical guide 13*a* of the cartridge B reaches the bottom of the recessed portion 16*a*3.

In other words, at this time, both the long and short guides 12*a* and 13*b* serve as the insertion guide, whereby the shock, which might be imparted on the cartridge B by the stepped portion or the like, is reduced.

Figure 13:
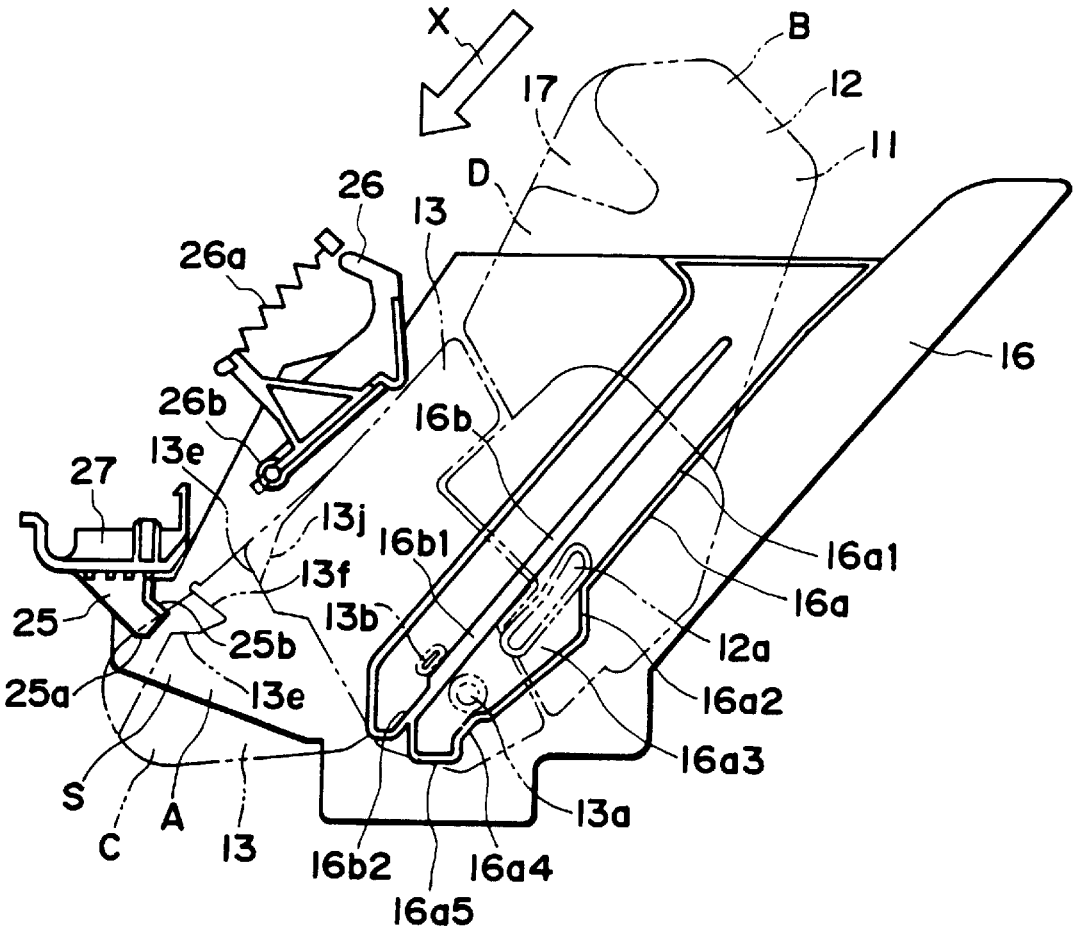
FIG. 13 is a side view illustrating a mounting and demounting operation of the process cartridge of FIG. 3 relative to the main assembly of the image forming apparatus.

As the process cartridge B is further inserted, the state illustrated in FIG. 13 is realized. In this state, the trailing end of the long guide 12*a* of the process cartridge B is at the edge of the recessed portion 16*a*3 of the first guide portion 16*a*, and the cylindrical guide 13*a* of the process cartridge B is in contact with the auxiliary guide portion 16*a*4, being ready to follow the guide portion 16*a*4. Next, the cylindrical guide 13*a* and short guide 13*b* of the process cartridge B are guided by the first guide portion 16*a* and second guide portion 16*b*, respectively (FIG. 14).

Figure 14:
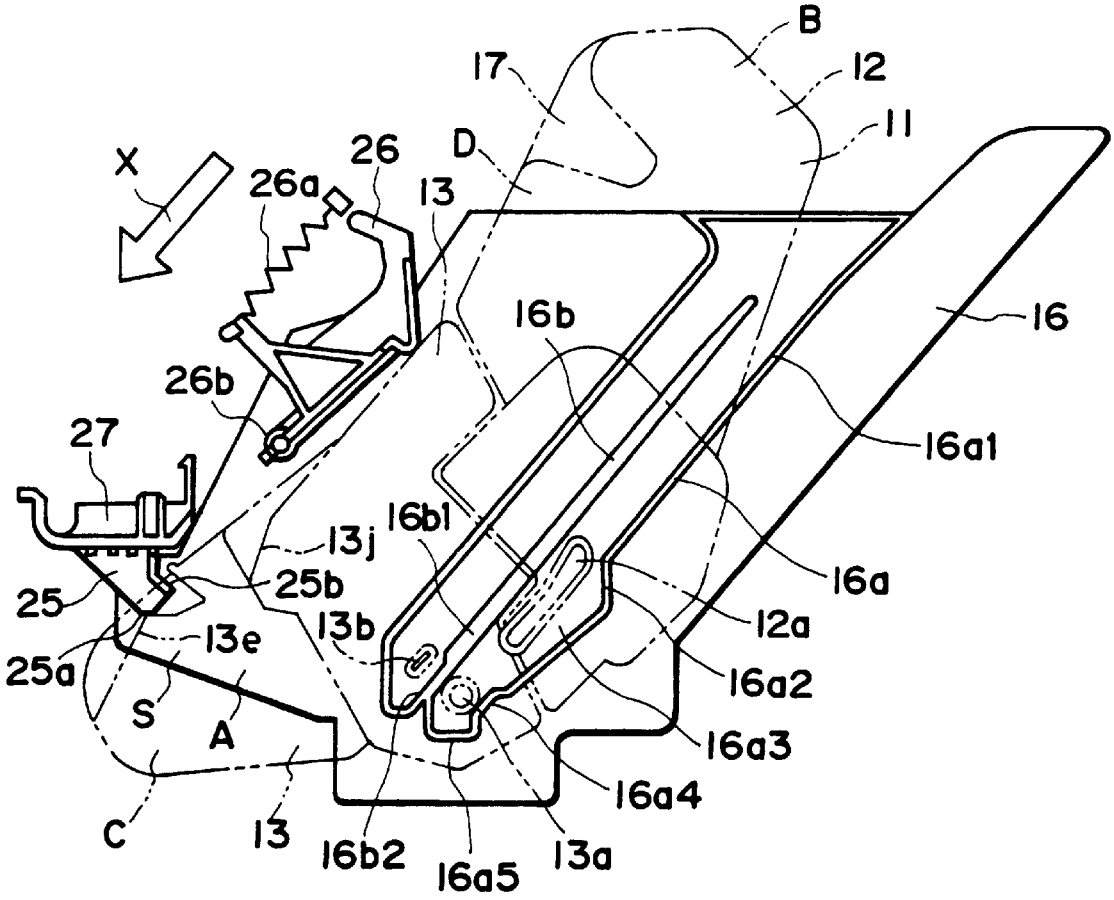
FIG. 14 is a side view illustrating a mounting and demounting operation of the process cartridge of FIG. 3 relative to the main assembly of the image forming apparatus.

Next, as the cartridge B is further inserted and the state illustrated in FIG. 14 is realized, the short guide 13*b* comes to the recessed portion 16*b*2 of the second guide portion 16*b*. For a short period in which this short guide 13*b* drops into the recessed portion 16*b*2, only the cylindrical guide 13*a* is in contact with the apparatus main assembly 14, at the auxiliary guide portion 16*a*4; therefore, the process cartridge B slightly rotates in the counterclockwise direction, and lastly, the cylindrical guide 13*a* drops into the groove 16*a*5 of the guide portion 16*a* (FIG. 15). At substantially the same time, the regulatory contact portion 13*e* provided on the cleaning means frame portion 13 comes in contact with the rotation regulating portion 25*a* (FIG. 15) of the fixed member 25 fixed to the apparatus main assembly 14. As a result, the overall position and orientation of the process cartridge B within the apparatus A is fixed. In this state, the position of the process cartridge B is fixed by the cylindrical guide 13*a* alone, and the other guides (long and short guides 12*a* and 13*b*) are not in contact with any portion of the installation guide member 16 of the apparatus main assembly 14; therefore, the position of the cartridge B is accurately fixed.

The positional relationship between the regulatory contact portion 13*e* and rotation regulating portion 25*a*, which will be described later in detail, is such that the moment, which is generated on the process cartridge B as the process cartridge B is driven, is received by the contact between regulatory contact portion 13*e* and rotation regulating portion 25*a*. The distance from the contact point between the regulatory contact portion 13*e* and rotation regulating portion 25 to the center of the cylindrical guide 13*a* is longer than the distance between the long guide 12*a* and the center of the cylindrical guide 13*a*, and the distance between the short guide 13*b* and center of the cylindrical guide 13*a*. Therefore, the orientation of the process cartridge B remains more stable when the process cartridge B is driven.

In a state shown in FIG. 15, a helical drum gear 7*b* provided on the photosensitive drum 7, at one of the axial ends, engages with a driving helical gear 28 provided on the apparatus main assembly 14. Thus, the driving force is transmitted from the apparatus main assembly 14 to the photosensitive drum by way of the gears 28 and 7*b*, wherein as the driving force is transmitted from the helical gear 28 to helical gear 7*b*, the cartridge B is subjected to a force that works in the clockwise direction (FIG. 17). However, the movement generated on the cartridge B is regulated by the contact portion 13*e*.

The pressing member 26 presses down the process cartridge B from above. Therefore, even if the cylindrical guide 13*a* fails to drop into the groove 16*a*5 of the apparatus main assembly 14, a moment is generated about the contact point between the rotation regulating portion 25*a* and contact portion 13*e*, whereby the cylindrical guide 13*a* is caused to drop into the groove 16*a*5.

Next, referring to FIGS. 16 and 17, the steps for taking the process cartridge B out of the apparatus main assembly 14 will be described. In the drawing, the direction indicated by an arrow Y is the direction in which the process cartridge B is removed.

Figure 16:
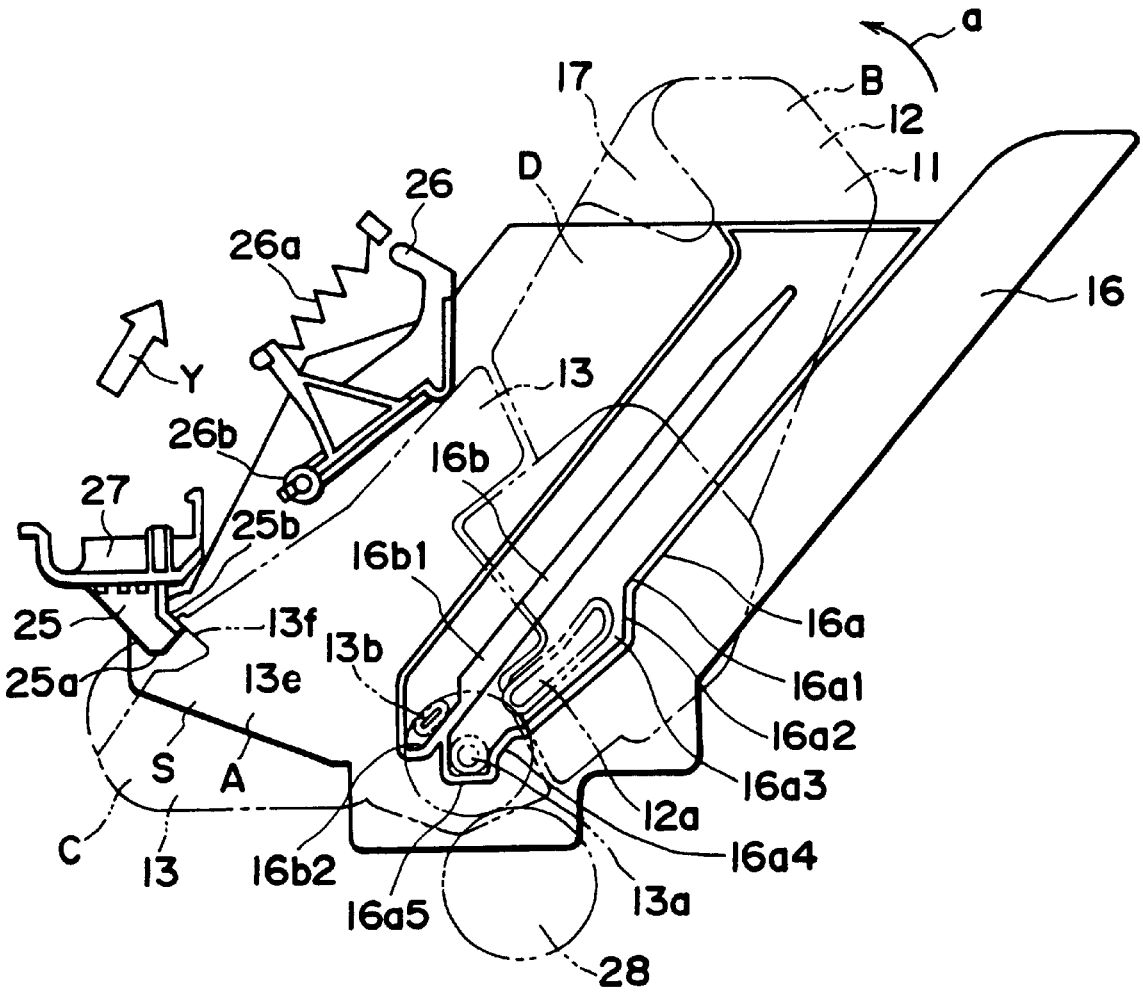
FIG. 16 is a side view illustrating a mounting and demounting operation of the process cartridge of FIG. 3 relative to the main assembly of the image forming apparatus.

Referring to FIG. 16, when the process cartridge B is to be removed from the apparatus main assembly 14, the operator grabs a handle portion 17 (to provide the handle, recessed portions, are formed on the cartridge B) and lifts the cartridge B by the handle portion 17 in the direction of an arrow a), whereby the process cartridge B is rotated counterclockwise about the cylindrical guide 13*a*. As a result, the disengagement contact portion 13*f* of the process cartridge B makes contact with the disengagement contact portion 25*b* of the fixed member 25 provided on the apparatus main assembly 14. As the process cartridge B is further lifted, it is rotated about the contact point F (FIG. 17) between the disengagement contact portion 13*f* and disengagement contact portion 25*b* of the fixed member 25. As a result, the cylindrical guide 13*a* is lifted out of the groove 16*a*5. At this moment, the engagement between the drum gear 7*b* and driving gear 28 is smoothly broken. In this state, the process cartridge B can be pulled straight out of the apparatus A, following the steps depicted in FIGS. 14, 13, 12, 11 and 10 (in that order).

As described above, according to this embodiment, the long guide as the second guide member is extended in the cartridge inserting direction in such a manner as to bridge the lateral surfaces of the developing unit D and cleaning unit C; therefore, the process cartridge is prevented from wobbling during the installation or removal. As a result, the cartridge installation becomes more reliable, which improves the operational efficiency.

The guiding means, which serves as the guide when the process cartridge is inserted into the apparatus main assembly 14 or removed therefrom, is constituted of three guide members: cylindrical guide 13*a*, long guide 12*a*, and short guide 13*b*, and the process cartridge B is guided by at least two guides during its installation or removal; therefore, even if there is a stepped portion or the like on the installation guide members of the apparatus main assembly 14, the shock, to which the process cartridge B might be subjected, is cushioned.

The position of the process cartridge B is fixed by a rotation regulating portion 25*a* oriented to control the moment, which is generated on the cartridge B as the cartridge is driven, and the cylindrical guide 13*a*, whereas the other guides (long and short guides 12*a* and 13*b*) remain in non-contact with the guide members of the apparatus main assembly 14; therefore, the orientation of the process cartridge B remains more stable while the image forming apparatus is driven (during the image formation).

As for the guiding means for installing or removing the cartridge B, the embodiment described above exemplifies a guiding means comprising three guide members positioned at different locations. However, the embodiment described above is not limited to this example, but instead, it may include guiding means comprising at least a cylindrical guide as the first guide member, and a long guide as the second guide member, or a guiding means comprising an additional guide member or guide members besides the three mentioned above. Such an arrangement can also stabilize the cartridge B during the installation or removal, and improves the operational efficiency.

Referring to FIGS. 9(*a*) and 9(*b*), a spur gear 7*n* is disposed on the photosensitive drum 7, at the end opposite, relative to the axial direction, to the end where the drum gear 7*b* is disposed. When the process cartridge B is mounted in the apparatus main assembly 14, this spur gear 7*n* engages with a gear (unillustrated), which is disposed in the apparatus main assembly 14 on the same axis as the transfer roller 4. As it engages with the unillustrated gear, the driving force is transmitted from the process cartridge to rotate the transfer roller 4.

A reference numeral 9*u* designates a helical gear, which is disposed at one of the axial ends of the developing roller 9*c*. It engages with the aforementioned spur gear 7*n*, whereby the driving force for rotating the developing roller 9*c* is transmitted by way of the helical drum gear 7*b*.

[Toner Container Frame (Toner Container)]

Figure 29:
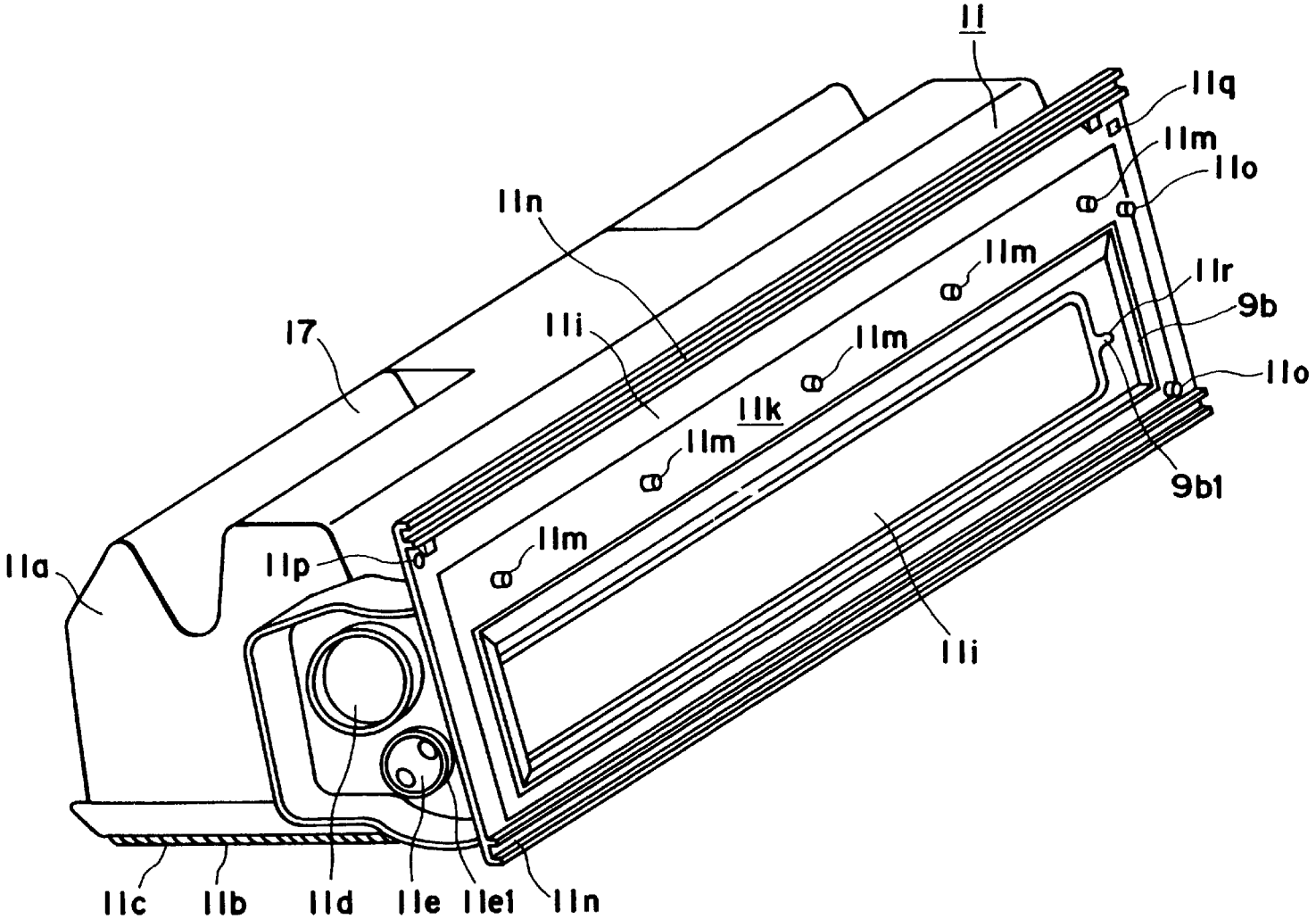
FIG. 29 is a perspective view of a toner frame.
Figure 30:
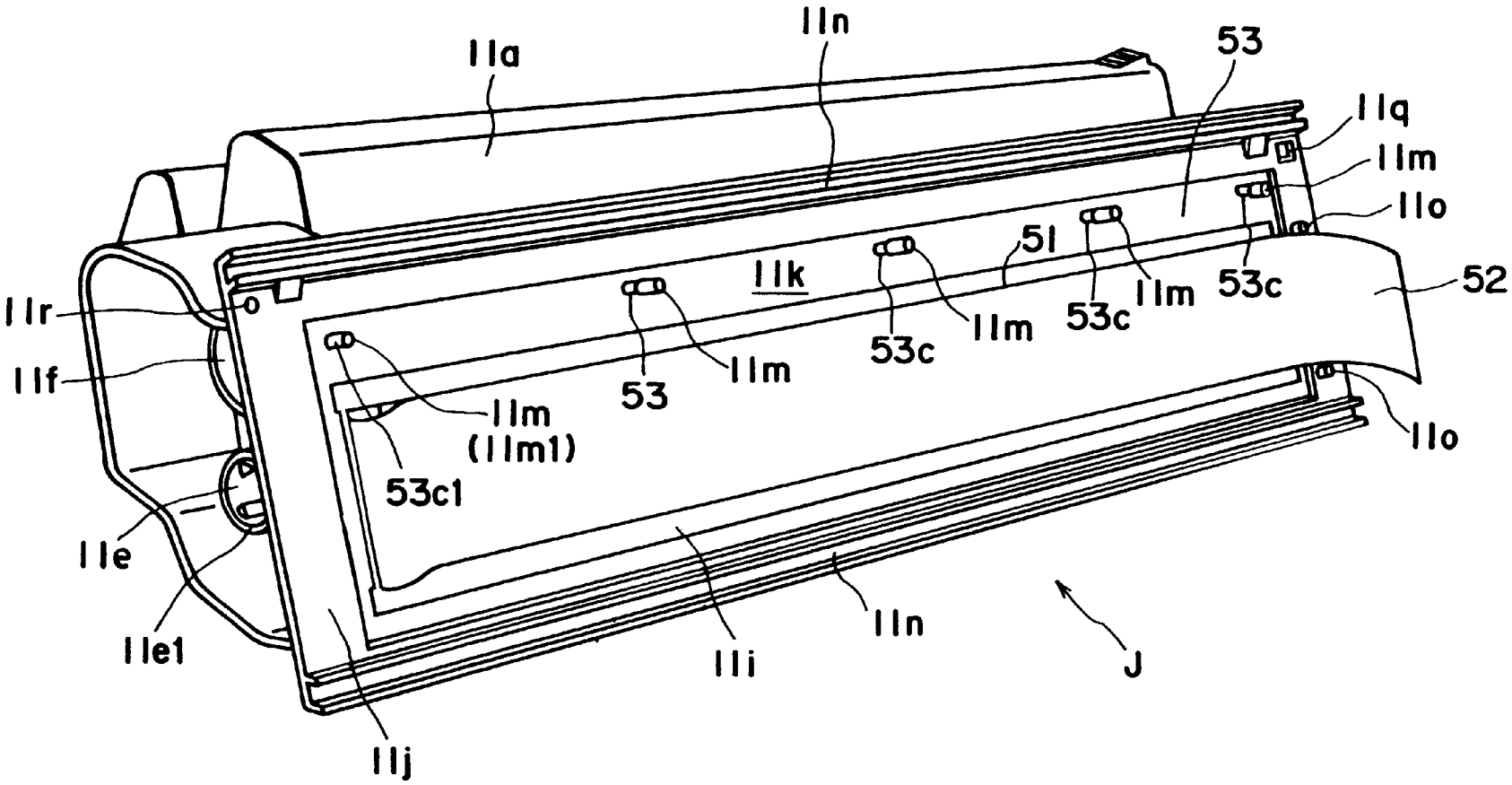
FIG. 30 is a perspective view of the toner frame after a toner seal is mounted.
Figure 32:
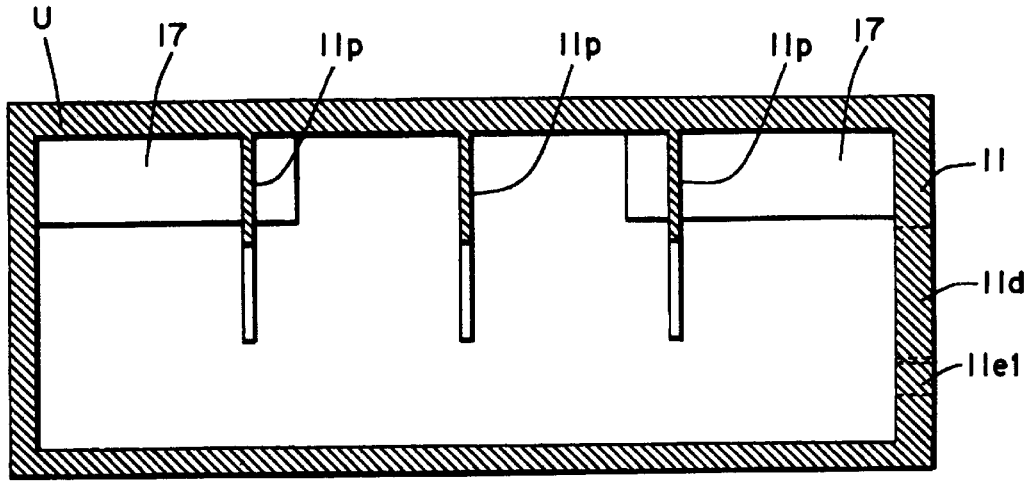
FIG. 32 is a sectional view taken along a line RO—RO of FIG. 3.
Figure 33:
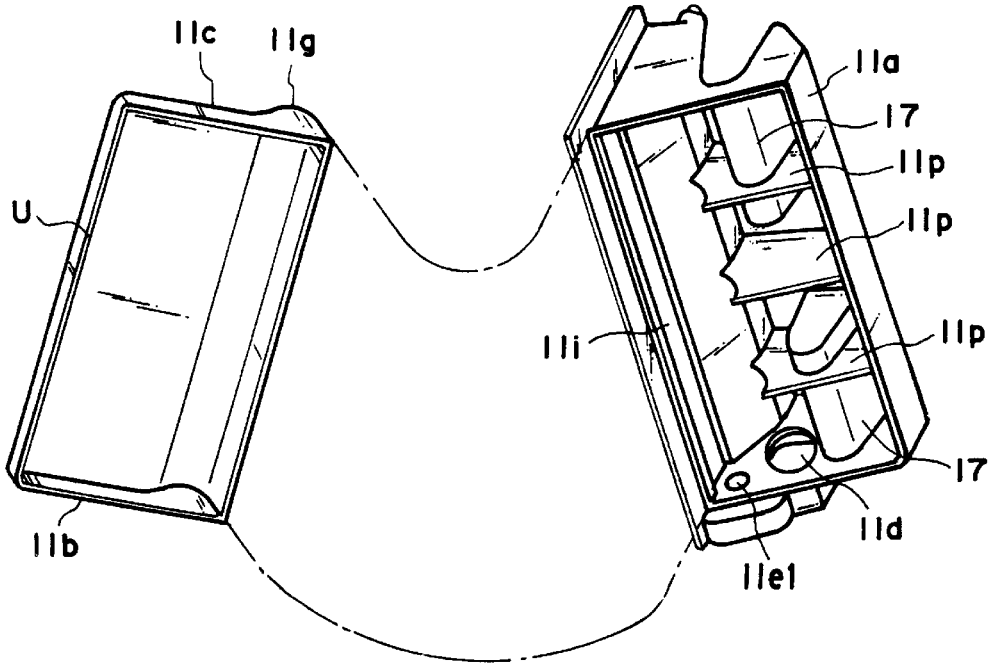
FIG. 33 is an exploded perspective view of a toner frame.

Referring to FIGS. 3, 29, 30, 32 and 33, a toner container frame (toner container) will be described in detail. FIG. 29 is a perspective view before a toner seal is welded; FIG. 30, a perspective view after the toner is filled; FIG. 32, a plan view of a top frame 11*a*; and FIG. 33 is a perspective view of the disassembled toner container frame.

A toner container frame 11 is constituted of two components: a top frame 11*a* (first frame) and a bottom frame 11*b* (second frame). On each of the longitudinal end surfaces of the top frame 11*a*, a recessed portion 17 is provided. It is disposed close to the top surface of the top frame, and serves as the handhold described above. The bottom frame 11*b* is provided with a number of ribs 11*c*. They are disposed in parallel to the longitudinal direction of the process cartridge B, with intervals of approximately 5 mm, on the exterior surface, which becomes the bottom portion when the process cartridge B is assembled. When grasping the process cartridge B, the operator uses both hands, holding onto the recessed portion 17 and ribs 11*c*; In this case, the ribs 11*c* prevent the hands from slipping when grasping the process cartridge B. The top and bottom frames 11*a* and 11*b* are joined at a welding surface U, and the welding rib is melted by forced vibration, welding the frames hla and lib together. The methods for joining two frames are not limited to the forced vibration method. For example, they may be welded using heat welding, ultrasonic welding, or the like, or may be simply glued. Before joining two frames 11*a* and 11*b*, the stirring member 9*b* is assembled into the top frame 11*a*, and then a coupling member 11*e* is put through a hole 11*e*1, and engaged to the end portion of the stirring member 9*b* (state illustrated in FIG. 29). The hole 11*e*1 is located at one of the longitudinal ends of the top frame 11*a*. On the same side as this hole 11*e*1, a toner filling opening 11*d* for filling the toner is located. The diameter of this toner filling opening 11*d* is approximately 30 mm. In other words, the hole 11*e*1 and toner filling opening 11*d* are located next to each other. The toner frame 11 is provided with an opening 11*i* for feeding the toner from the toner frame 11 to the developing frame 12, and a seal, which will be described later, is welded to cover this opening 11*i*. After the seal is welded, the toner is filled through the toner filling opening 11*d*, and then the toner filling opening 11*d* is covered with a toner cap 11*f*, completing a toner unit J. The toner cap 11*f* is formed of soft material such as polyethylene or polypropylene, and is pressed into the toner filling opening 11*d* of the toner frame 11 so that it does not come off. Next, the toner unit J is joined with the developing frame 12, which will be described later, using ultrasonic welding, constituting a part of a completed developing unit D. The joining methods are not limited to ultrasonic welding. They may be glued together, or may be snap-fitted using the elasticity of their materials.

Referring to FIG. 3, the angle θ of a slanted surface K, constituting a part of the bottom frame 11*b* of the toner frame 11, must be such an angle that the toner located in the deeper end of the toner chamber slides down, naturally and continuously, in response to toner consumption. More specifically, the angle θ is the angle formed between the slanted surface K of the process cartridge B and the horizontal surface Z, with the apparatus main assembly 14 being leveled. The preferable value for the angle θ is approximately 60 degrees. When rotating, the stirring member 9*b* reaches beyond the plane of the slanted surface K. Therefore, the bottom frame 11*b* is provided with a recessed portion 11*g* to afford a clearance for the rotating stirring member 9*b*; it bulges outward. The rotational diameter of the stirring member 9*b* is approximately 30 mm (according to this embodiment, the bottom surface of the bottom frame 1*b* dips approximately 3.6 mm, and the depth of this recessed portion has only to be approximately 2.0 mm to 10 mm.) The reason for this arrangement is as follows. If the sweeping area of the stirring member 9*b* is above the slanted surface K, it is possible that the toner settling between the tip of the toner feeding (stirring) member 9*b* and the slanted surface K is not fed into the developing frame 12, being left unused. However, in this embodiment, the toner is reliably fed from the toner frame 11 into the developing frame 12.

Referring to FIG. 29, the stirring member 9*b* is formed of a rod of steel or the like material, having a diameter of approximately 3 mm and being in the form of a rectangular frame to improve toner stirring/feeding performance. Each of the opposing longitudinal ends of the stirring member 9*b* is provided with a supporting axis 9*b*1. The supporting axis 9*b*1 on one end is fitted in a hole 11*r*, which is located on the internal surface of the top frame 11*a*, adjacent to the opening 11*i* of the top frame 11*a*, and the supporting member 9*b*1 on the other end is fixed to the coupling member 11*e*.

As described above, the toner frame 11 is constituted of two members, that is, the top and bottom frames 11*a* and 11*b*, and the bottom wall of the bottom frame 11*b* is provided with the recessed portion 11*g* to afford a clearance for the toner feeding member 9*b*; therefore, it is possible to provide even a large capacity process cartridge with reliable toner feeding performance, without increasing cost.

The foregoing can be summarized as follows.

Figure 36:
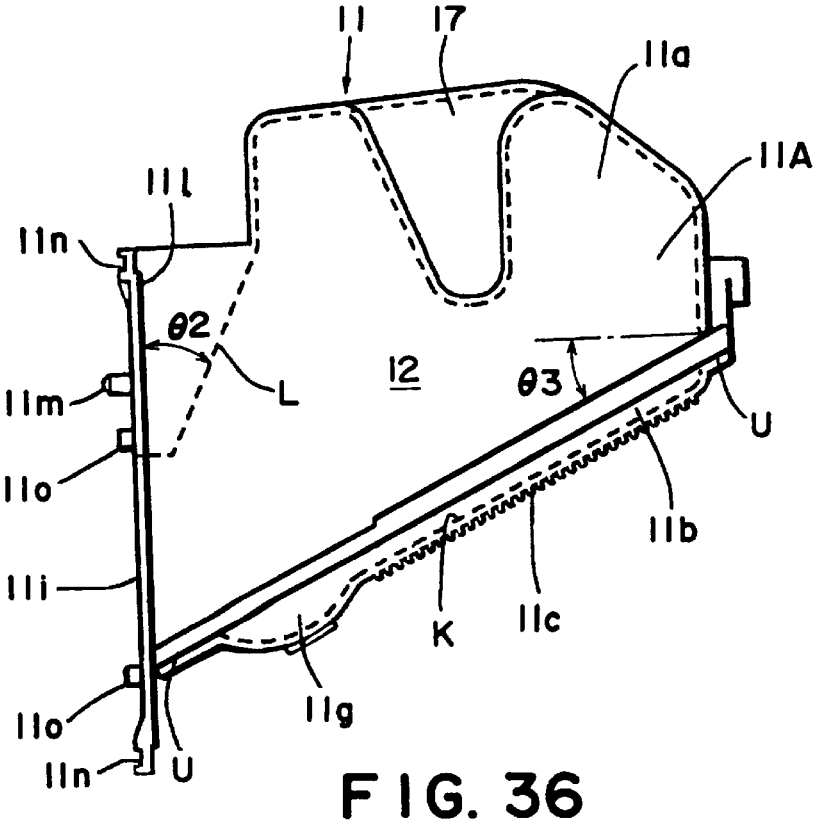
FIG. 36 is a side view of a toner frame.

The toner frame (toner container) 11 constitutes a part of a replaceable process cartridge for an electrophotographic image forming apparatus, which comprises an electrophotographic photosensitive member (7, 7*e*), and developing means 9 for developing the latent image formed on the electrophotographic photosensitive member. It stores the toner used in the developing means 9 for developing the latent image, and comprises the top frame 11*a*, and the bottom frame 11*b* which is joined with the top frame 11*a*. The top frame 11*a* comprises the opening 11*i* for supplying the stored toner to the developing means 9, and a stirring member mount 9*b*1 (FIG. 29) where the stirring member 9*b* for stirring the stored toner is rotatively mounted. The bottom frame 11*b* is provided with the recessed portion 11*g* (as seen from within), that is, a bulge (as seen from outside), to afford the clearance for the sweeping area of the stirring member 9*b*. Further, the top frame 11*a* is provided with the welding surface U (joining surface) where the bottom frame 11*b* is welded (FIG. 29, 33 and 36). The angle of this welding surface, that is, the angle which is formed between this welding surface and the horizontal line 12 when the shorter edge of the rectangular opening 11*i* (FIG. 29) is vertically oriented, is approximately 20 to 40 degrees. Further, the top frame 11*a* is provided with the hole 11*e*1 (transmission opening), through which the coupling member 11*e* (transmission member) for transmitting the driving force from the apparatus main assembly to the stirring member 9*b*, when the process cartridge is in the image forming apparatus, is put. One end of the coupling member 11*e* is engaged with the stirring member 9*b*, and the other end is engaged with the toner feeding gear 9*s* to receive the driving force. The stirring member 9*b* is formed of a metallic rod, and is in the form of a rectangular frame. Further, the top frame 11*a* is provided with the toner filling opening 11*d* (filling opening), which is disposed next to the hole 11*e*1 (FIG. 29). It is to this toner filling opening 11*d* that the toner cap 11*f* for sealing the toner filling opening lid is attached. Further, the top frame 11*a* is provided with a groove 11*n* which extends in parallel to the plane of the opening 11*i*. This groove 11*n* is where the developing frame 12, in which the developing roller 9*c* of the developing means 9 is mounted, is joined. Further, the top frame hla is provided with a cover film plate 53 (seal mount) where a cover film 51 for sealing the opening 11*i* and a tear tape 52 (toner seal) for unsealing the opening 11*i* are attached. The cover film plate 53 is also in parallel to the plane of the opening 11*i*. Further, the top frame 11*a* is provided with the handhold (recessed portion) 17, which is where the longitudinal end surfaces of the process cartridge are indented to form the handhold. The recessed portion 11*g* (bulge) of the bottom frame 11*b* is in the form of a longitudinally sliced cylinder, having an arc-shaped cross section. It is disposed close to the opening 11*i*, relative to the widthwise direction of the bottom frame 11*b*, and extends in the longitudinal direction of the opening 11*i*, along substantially the entire length of the opening 11*i*. Further, the top frame 11*a* is provided with a slanted surface L. The angle of the slanted surface L, that is, the angle which is formed between this slanted surface L and the vertical line when the shorter edge of the opening 11*i* is vertically oriented, is approximately 10 to 40 degrees (FIG. 36). This slanted surface L is located above the opening 11*i*, sloping down toward the opening 11*i* and extending in parallel to the longitudinal direction of the opening 11*i*, along substantially the entire length of the opening 11*i*.

The toner frame (toner container) 11 is assembled in the following manner. First, the top frame 11*a*, which is provided with the opening 11*i* for supplying the stored toner into the developing means 9, and the stirring member mount 9*b*1 where the stirring member 9*b* is mounted, is prepared. Next, the bottom frame 11, which is provided with the recessed portion 11*g* bulging outward to afford the clearance to the sweeping area of the stirring member 9*b*, is prepared. Finally, the two frames, 11*a* and 11*b*, are joined to complete the toner frame (toner container) 11.

It is predictable that the toner within the toner frame 11 will move suddenly due to vibration, impact, or the like, during the shipment of the process cartridge B from factory to user.

Therefore, according to the present invention, plural partitioning plates 11*p* are provided within the top frame 11*a* of the toner frame 11.

They are arranged in the longitudinal direction of the top frame 11*a* (FIGS. 3, 32 and 33). In this embodiment, three partitioning plates 11*p* are disposed at three different locations. As for the configuration of the partitioning plate 11*p*, the edge 11*p*1 facing the toner feeding member 9*b* forms a substantial quadrant in such a manner as to surround the toner feeding member 9*b*, and the edge 11*p*2 facing the bottom frame 11*b* holds a slight gap therefrom. Further, as seen from the longitudinal direction of the top frame 11*a*, the edge 11*p*1 is positioned so that the partitioning plate 11*p* partially blocks the toner filling opening ald.

In order to prevent the toner from shifting within the toner container DA, the partitioning plate 11*p* should be as large as possible. However, when the toner filling opening lid is faced upward to fill the toner, the partitioning plate lip is situated directly below the toner filling opening lid, and if the partitioning plate lip blocks the toner filling opening lid entirely, it is difficult to fill the toner into the deepest corner of the toner container 11A. Therefore, the partitioning plate 11*p* should be formed as it is in this embodiment, so that the toner can be filled a 11 the way into the deepest corner through the space which is not blocked by the partitioning plate 11*d*. Further, according to the present invention, the partitioning plate lip occupies a substantial part of the cross-sectional area perpendicular to the longitudinal direction of the toner frame 11; therefore, even when the process cartridge B is subjected to vibration, impact, or the like, the partitioning plate lip can prevent the toner from shifting an d becoming compacted.

[Toner Frame Structure Facing Developing Frame]

Figure 31A:
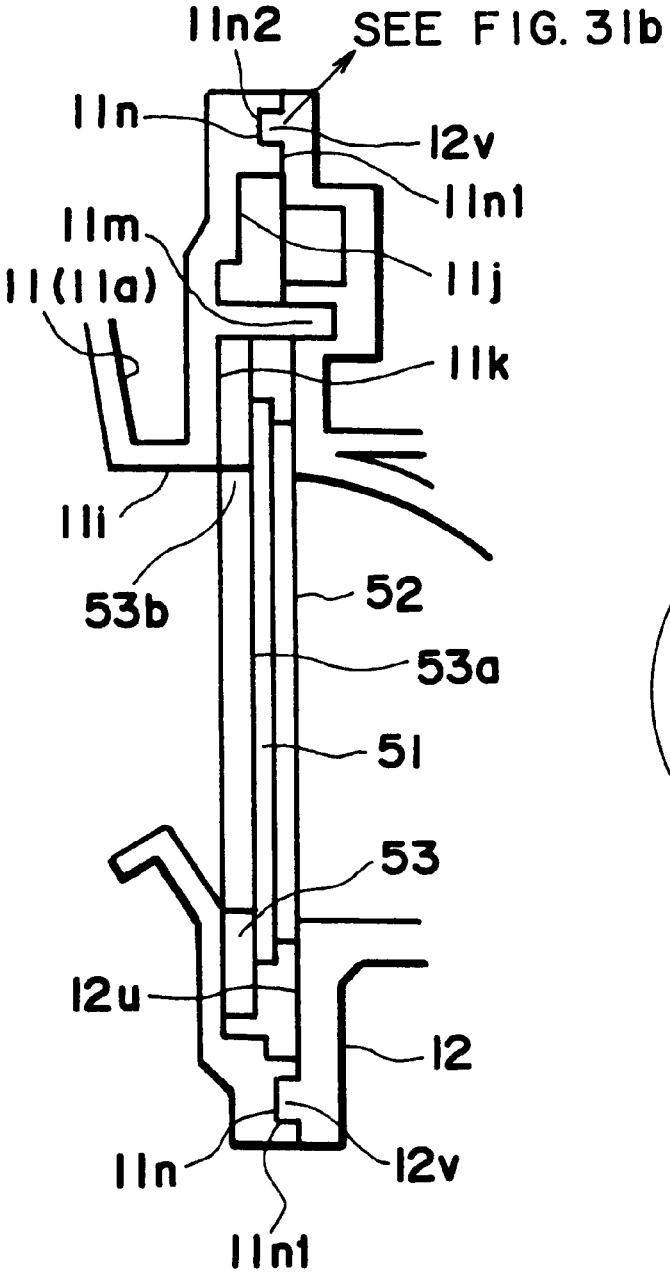
FIG. 31 is a longitudinal sectional view of the toner seal of FIG. 30.
Figure 31B:
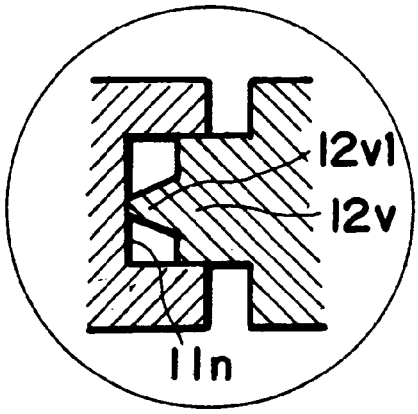

Referring to FIGS. 3, 29 and 31, at the joint between the toner frame 11 and developing frame 12, the opening 11*i* for feeding the toner from the toner frame 11 into the developing frame 12 is provided. The opening 11*i* is surrounded by a recessed surface 11*k*, on which the cover film plate 53 is thermally welded. The depth of this recessed surface 11*k* is such that after the cover film plate 53 is welded to the recessed surface 11*k*, the outward facing surface of the cover film plate 53 becomes substantilly level with the surface 11*j* of the toner frame 11 (top frame 11*a*). On the recessed surface 11*k*, plural dowels 11*m* are disposed in a straight line along one of the longitudinal edges of the opening 11*i* (in this embodiment, five dowels 11*m* are disposed at five different locations). Also, two dowels 11*o* are disposed on the surface 11*j* along one of the widthwise edges of opening 11*i*; these two dowels 11*o* are not on the recessed surface 11*k*. Further, along each of the longitudinal external edges of the surface 11*j*, a groove 11*n* is disposed in parallel to the one on the opposing side. The bottom surface 11*n*2 of this groove 11*n* is above the level of the surface 11*j* (closer to a the developing frame 12 than the surface 11*i*) (FIG. 31).

The surface of the developing frame 12, which comes directly in contact with the surface of the toner frame 11, is a surface 12*u*. Along each of the longitudinal edges of this surface 12*u*, a tongue 12*v*, which fits into the groove 11*n* of the toner frame 11, is provided. At the end surface of this tongue 12*v*, an angular ridge 12*v*1, used for ultrasonic welding, is provided (FIG. 31); the angular ridge 12*v*1 is melted by ultrasonic welding to weld the toner frame 11 and developing frame 12, along their longitudinal external edges.

Figure 27:
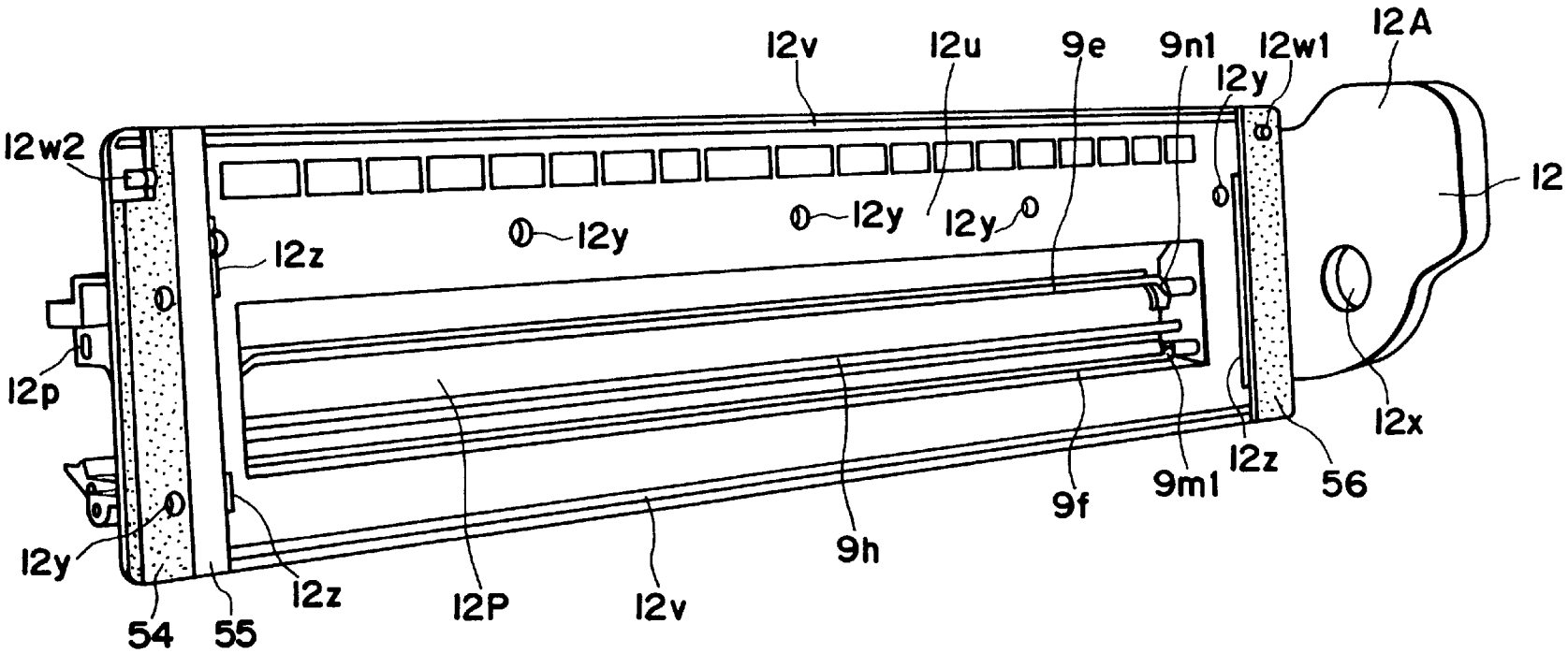
FIG. 27 is a perspective view of a developing device frame or developing frame.

Referring to FIG. 30, the cover film plate 53, which is loosely fitted onto the recessed surface 11*k* of the toner frame 11, is provided with holes 53*c*, which correspond to the plural dowels 11*m*. The holes 53*c*1, which exactly fit to the corresponding end dowels 11*m*1, are round, and the holes 53*c* other than the round holes 53*c*1 are elongated so as to be loosely fitted to the corresponding dowels 11*m* other than the end dowels 11*m*1. More specifically, the positional relationship between the dowels 11*m* and hole 53*c* is such that when the dowels 11*m*1 and 11*m* are fitted in the corresponding holes 53*c*1 and 53*c*, the dowel 11*m* is positioned at the middle of the elongated holes 53*c* in the longitudinal direction of the elongated holes 53*c*. Further, the cover film plate 53 is provided with an opening 53*b* (having approximately the same size as the opening 11*i*), which corresponds to the opening 11*i*. In order to seal this opening 53*b*, a cover film 51, which can be easily torn in the longitudinal direction, is pasted on the cover film plate 53; the four peripheral areas of the cover film 51 are pasted on four corresponding peripheral areas of the opening 53*b*. On the cover film 51, the tear tape 52 for tearing the cover film 51 to unseal the opening 53*b* is welded. The tear tape 52 is extended from one of the longitudinal ends of the opening 53*b* to the other end, where it is doubled back and put through the starting end, between the toner frame 11 and an elastic seal member 54 (FIG. 27), such as a piece of felt, which is pasted on the flat developing frame surface 12*u*, directly facing the toner frame 11, at the starting end. The doubled back end of the tear tape 52 is exposed from between the toner frame 11 and developing frame 12 (FIGS. 6 and 30). On the inward side surface of the seal member 54, a synthetic resin film tape 55 with a small friction coefficient is pasted. Also on the flat surface 12*u*, an elastic seal member 56 is pasted at the longitudinal end opposite from where the seal member 54 is pasted (FIG. 27).

In order to make it easier to align the toner frame 11 and developing frame 12 when joining two frames 11 and 12, the surface 11*j* of the toner frame 11 is provided with a round hole 11*r* and a square hole 11*q*, which engage with a cylindrical dowel 12*w*1 and square column dowel 12*w*2, respectively, provided on the developing frame 12; the round hole 11*r* engages with the dowel 12*w*1, and the square hole 11*q* loosely engages with the dowel 12*w*2. The seal member 56 is fitted around the cylindrical dowel 12*w*1, and also is glued to the flat surface 12*u*. Further, in the flat surface 12*u* of the developing frame 12, which directly comes in contact with the toner frame 11, recessed portions 12*y* are provided, in which the dowels 11*m* and 11*o* of the toner frame 11 loosely fit.

Before the toner frame 11 and developing frame 12 are joined, each frame is independently assembled as a subcomponent. Thereafter, the cylincrical positioning dowel 12*w*1 and square column positioning dowel 12*w*2 of the developing frame 12 are fitted into the round positioning hole 11*r* and square positioning hole 11*q* of the toner frame 11, respectively. Also, the tongue 12*v* of the developing frame 12 is fitted into the groove 11*n* of the toner frame 11. Then, as the toner frame and developing frame 12 are pressed together, the seal members 54 and 56 are compressed, and ridges 12*z*, which are integrally formed as spacers with the developing frame, at each of the longitudinal ends, approach the surface of the toner frame 11. The ridges 12*z* are aligned in the widthwise direction of the developing frame 12, with an interval substantially equal to the width of the tear tape 52, to allow the tear tape 52 to be put through. With the toner frame 11 and developing frame 12 being pressed together as described above, ultrasonic vibration is applied between the tongue 12*v* and groove 11*n*, whereby the angular ridge 12*v*1 is melted and welded to the bottom of the groove 11*n* by frictional heat. As a result, the edges 11*n*1 of the grooves 11*n* of the toner frame 11, and the ridges 12*z*, as the spacers, of the developing frame 12, firmly contact their counterparts, sealing the entire joint between the toner frame 11 and developing frame 12, except for the gap left between the surface 11*j* of the toner frame 11 and the flat surface 12*u* of the developing frame 12. The cover film 51 and tear tape 52 are confined in this gap.

In order to feed the toner stored in the toner frame 11 into the developing frame 12, the operator has only to pull the end portion 52*a* (FIG. 6) of the tear tape 52, which is exposed from the process cartridge B, by hand. As the tear tape 52 is pulled, the cover film 51 is torn open to unseal the opening 53*b* (11*i*), allowing the toner to be fed from the toner frame 11 into the developing frame 12.

Since the joining portions of the toner frame 11 and developing frame 12 are structured as described in the foregoing, that is, since the surface of the cover film plate 53 and the surface 11*j* of the toner frame 11 are substantilly at the same level, the tear tape 52 can be smoothly pulled out from between the two frames 11 and 12 by applying to the tear tape 52 a sufficient amount of force for tearing the cover film 51 as described above. The cover film plate 53 is located by the dowel 11*m*1 at one of its longitudinal ends, that is, the end opposite to where the tear tape 52 is pulled out, and in addition, it is disposed on the recessed surface 11*k* of the toner frame 11; therefore, it is not liable to be dislocated. Further, the dowels 11*m* are aligned in a straight line in the longitudinal direction, and the cover film plate 53 is fitted to these dowels 11*m*; therefore, even the easily deformable cover film 51 can be precisely located to allow it to remain flat. Further, even if the assembly process moves on to the subsequent steps before the welded joint between the cover film plate 53 and toner frame 11 is solidified and stabilized, the cover film plate 53 is not dislocated.

When the toner frame 11 and developing frame 12 are joined using an ultrasonic welding method, frictional heat is generated to melt the angular ridge 12*v*1. This frictional heat is liable to cause thermal stress in the toner frame 11 and developing frame 12, which might result in the thermal deformation of the toner frame 11 and developing frame 12. However, according to-this embodiment, the groove 11*n* of the toner frame 11 and the tongue 12*v* of the developing frame 12 are engaged across substantially the full length in the longitudinal direction. In other words, the joint portions between the toner frame 11 and developing frame 12 are reinforced as frames 11 and 12 are joined; therefore, the thermal deformation due to the thermal stress is not likely to occur.

As described above, the grooves 11*n,* handholds (recessed portions) 17, partitioning plates 11*p,* toner filling opening lid, hole 11*e*1, round hole 11*r,* square hole 11*q,* and cover film plate mount (recessed surface 11*k,* dowels 11*m* and opening 11*i*), of the top frame 11*a* are integrally formed with the top frame 11*a*. Also, the ribs 11*c* and recessed portion 11*g,* of the bottom frame 11*b* are integrally formed with the bottom frame 11*b*. The material for the top and bottom frames 11*a* and 11*b* is a plastic material, for example, polyethylene, ABS resin (acrylonitrilebutadiene-styrene copolymer), polycarbonate, polyethylene, and polypropylene.

FIG. 36 is a side view of the toner frame 11 used in this embodiment; the surface 11*j* of the toner frame 11, which is joined with the developing frame 12, is vertically oriented.

The toner frame 11 employed in this embodiment is provided with two slanted surfaces K and L, which allow the toner (single component toner) stored in the storage portion 11A to efficiently descend toward the opening 11*i*. Both slanted surfaces K and L extend across the entire longitudinal length of the toner frame 11. The slanted surface L is located above the opening 11*i,* and the slanted surface K is located immediately behind the opening 11*i* (being slanted in the widthwise direction of the toner frame 11). The slanted surface L belongs to the top frame 11*a*, and the slanted surface K is formed as a part of the structure of the bottom frame 11*b*. The angle 92 of the slanted surface L relative to a vertical line 11 (joining surface 11*j*) is approximately 10 degrees to 40 degrees (in this embodiment, 92 is set at 24 degrees). The angle 93 of the slanted surface K, relative to the horizontal plane 12, perpendicular to the vertical line 11, is approximately 20 to 40 degrees (in this embodiment, 93 is set at approximately 27 degrees). In other words, the configuration of the top frame 11*a* in this embodiment is regulated so that when the bottom frame 11*b* is joined with the top frame 11*a*, the joined bottom frame 11*b* holds the aforementioned angle. Therefore, even if the toner storage portion 11A is such a toner storage portion that contains a large amount (for example, no less than 800 g), the toner can be efficiently fed toward the opening 11*i*.

Next, the developing frame will be further described in detail.

[Developing Frame]

Figure 26:
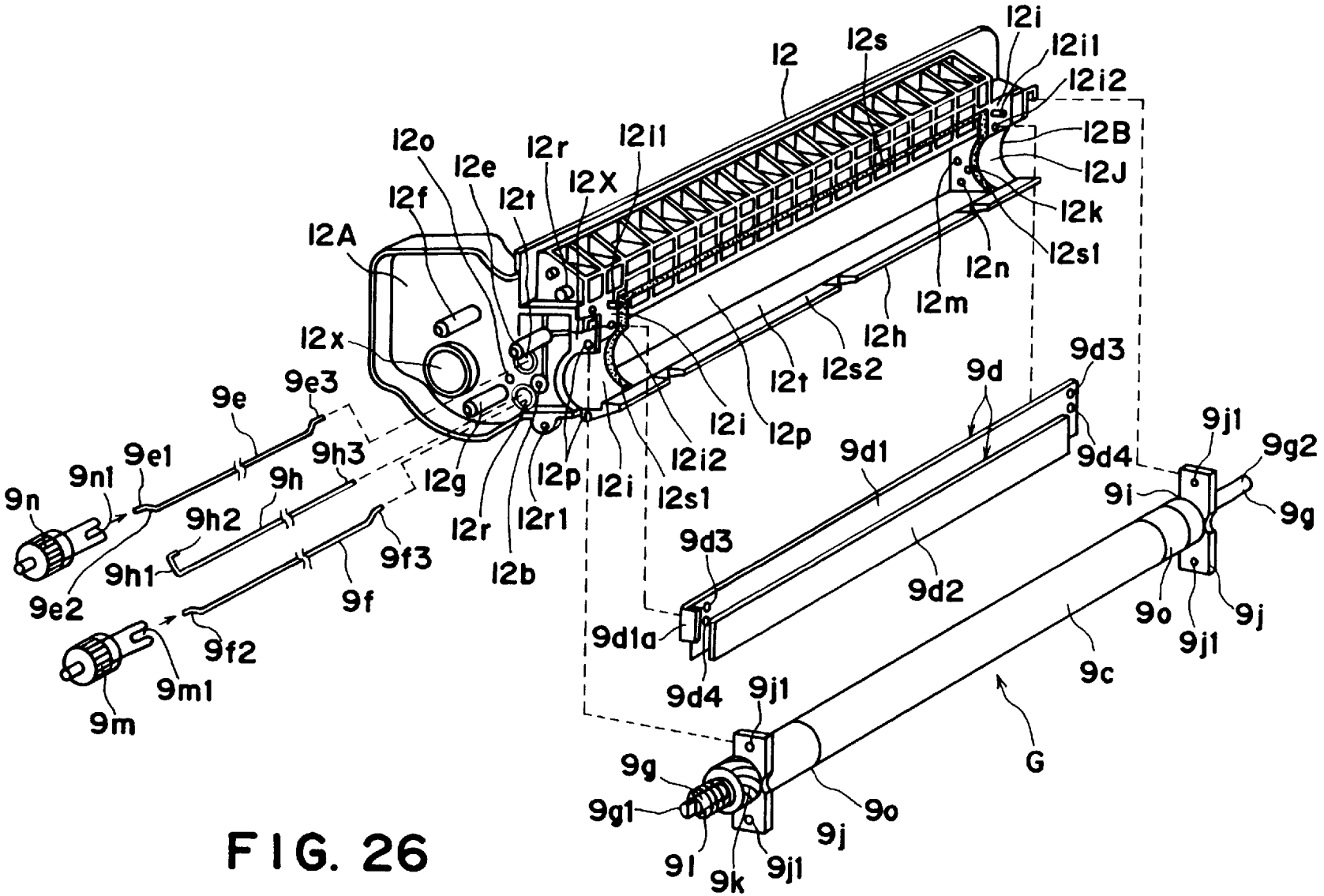
FIG. 26 is an exploded perspective view of a developing unit.
Figure 28:
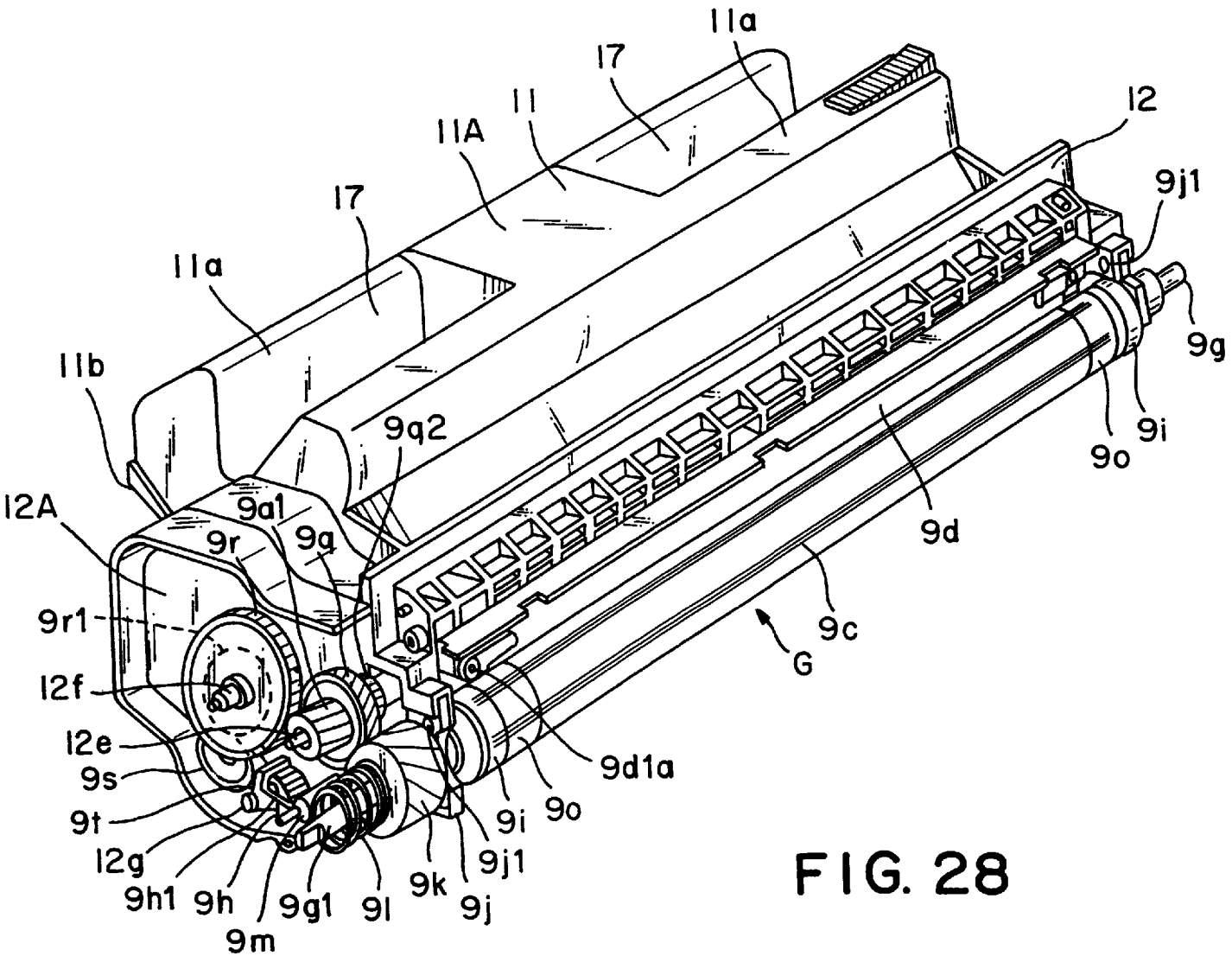
FIG. 28 is a perspective view of a developing unit without the developing holder.

The developing frame will be described with reference to FIGS. 3, 26, 27 and 28. FIGS. 26 is an exploded perspective view of the developing frame 12, illustrating how the components are assembled; FIG. 27 is a perspective view of the developing frame 12 and toner stirring member 9*e* and 9*f*, as seen from the direction of the surface to be welded, illustrating how the stirring members 9*e* and 9*f* are assembled into the frame 12; and FIG. 28 is a perspective view of the developing unit without the developing frame holder.

As described above, the developing roller 9*c*, developing blade 9*d*, toner stirring members 9*e* and 9*f*, and antenna rod 9*h* for detecting the amount of the remaining toner, are assembled into the developing frame 12.

The developing blade 9*d* comprises a 1–2 mm thick metallic plate 9*d*1, and a urethane rubber blade 9*d*2 fixed to the metallic plate 9*d*2 by means of hot melting, double-side adhesive tape, or the like. It regulates the amount of toner coated on the peripheral surface of the developing roller 9*c*. The flatness of a blade accommodating flat surface 12*i,* as a blade mount, provided on the developing frame 12 is regulated; it is approximately 0.05 mm. This flat surface 12*i* is provided with dowels 12*i*1 and screw holes 12*i*2. The dowels 12*i*1 are fitted into the holes 9*d*3 provided on the metallic plate 9*d*1. Thereafter, the metallic plate 9*d*1 is screwed onto the flat surface 12*i,* using the screw holes 9*d*4 provided on the metallic plate 9*d*1, and the screw holes 12*i*2. Also on the developing frame 12, an elastic seal member 12*s* formed of MOLTPLANE or the like is pasted to prevent toner invasion. It is disposed above the metallic plate 9*d*1, extending in the longitudinal direction thereof. In addition, an elastic seal member 12*s*1 is pasted on the developing member, at each of the longitudinal ends, covering from both ends of the elastic seal member 12*s* to a round surface 12*j,* which follows the contour developing roller 9*c*. Further, on the mandible-like portion 12*h,* a thin elastic seal member 12*s*2 is pasted. This elastic seal member 12*s*2 contracts the generatrix of the developing roller 9*c*.

One 9*d*1*a* of the longitudinal ends of the developing blade 9*d* is bent by approximately 90 degrees. This bent portion 9*d*1*a* equalizes the voltages of the metallic plate 9*d*1 and developing roller 9*c* by contacting a development bias contact point 121 (FIG. 23(*a*) and 23(*b*)), supported on a developing frame holder 40 which will be described later. This-arrangement is made because the amount of the toner is detected on the basis of the change in the capacitance between the antenna rod 9*h* for detecting the amount of the remaining toner, and the developing roller 9*c*, and this capacitance must be prevented from irregularly changing due to the influence of the metallic plate 9*d*1.

Next, a developing roller unit G will be described. The developing roller unit G comprises: (1) developing roller 9*c*; (2) spacer roller 9*i* for keeping constant the distance between the peripheral surface of the developing roller 9*c* and the peripheral surface of the photosensitive drum 7; (3) developing roller bearing 9*j* for locating the developing roller 9*c* on the developing frame 12; (4) sleeve cap 9*o* which is placed on both ends of the developing roller 9*c* so that leakage does not occur between the aluminum cylindrical portion of the photosensitive drum 7 and the aluminum cylindrical portion of the developing roller 9*c*; (5) developing roller gear 9*k* (helical gear) which rotates the developing roller 9*c* as it receives the driving force from the helical gear 7*b* mounted on the photosensitive drum 7; (6) coil spring contact point 91, one end of which is in engagement with the developing roller gear 9*k* mounted at one end of the developing roller gear 9*k;* and (7) magnet 9*g* which is contained in the developing roller 9*c* to adhere the toner to the peripheral surface of the developing roller 9*c*. This developing unit G is attached to the developing roller mount 12X of the developing frame 12 in the following manner. First, a hole 9*j*1 provided on each of the developing roller bearings 9*j* is aligned with the hole 12*p* provided at each of the longitudinal ends of the developing frame 12, and a pin provided on the development holder 40, which will be described later, is inserted through the holes 9*j*1 and 12*p*. Then, the developing frame holder 40 is fixed to the developing frame 12 using screws.

As described above, in this embodiment, when the developing roller 9*c* is mounted on the developing frame 12, the developing roller unit G is assembled first. Then, the assembled developing roller unit G is mounted on the developing frame 12 with the use of developing frame holder 40. By going through these steps, assembly efficiency is improved compared to the case in which the developing roller 9*c* along is directly mounted on the developing frame 12.

The developing roller unit G is assembled through the following steps. To begin with, each end of the developing roller 9*c* is covered with the sleeve cap 9*o*. Next, the spacer roller 9*i* is mounted at each end of the developing roller 9*c*; the spacer roller 9*i* is placed on the outward side of the sleeve cap 9*o*. Then, the developing roller bearing 9*j* is mounted on the outward side of the spacer roller 9*i*. Next, the developing roller gear 9*k* is mounted at one of the longitudinal ends of the developing roller 9*c*, on the outward side of the bearing 9*j*, and the coil spring contact point 91 is mounted on the further outward side. At this point in the assembly, one end 9*g*1 of magnet 9*g*, which has a D-shaped cross section, projects from one end of the developing roller 9*c*, that is, the end where the developing roller gear 9*k* is mounted, and the other end of the magnet 9*g*, which is cylindrical, projects from the other end of the developing roller 9*c*. This is the way developing roller unit G is assembled.

Next, the antenna rod 9*h* for detecting the amount of the remaining toner will be described. One end of the antenna rod 9*h* is U-shaped. This U-shaped portion 9*h*1 is placed in contact with, being thereby electrically connected to, the toner detection contact point 122 mounted on the developing frame holder 40 which will be described later. This antenna rod 9*h* is attached to the developing frame 12 in the following manner. First, the end portion 9*h*3 of the antenna rod 9*h* is inserted into the developing frame 12 through a through hole 12*b*, provided on the side plate 12A of the developing frame 12. Then, the inserted end portion 9*h*3 is put through a through hole 12*k* provided on the other side plate of the developing frame 12, being supported thereby. In other words, the antenna rod 9*h* is located and supported by the through holes 12*b* and 12*k*. In the through hole 12*b*, a seal member (unillustrated) formed of felt, sponge, or the like, is inserted to prevent toner invasion.

Further, the tip portion 9*h*2 of the U-shaped portion 9*h*1 is inserted into an approximately 5 mm deep hole 12*o* of the developing frame 12 to locate the antenna rod 9*h* in the axial direction. Also, this arrangement improves the rigidity of the U-shaped portion 9*h*1 as the contact point which contacts the toner detection contact point 122 which will be described later. The through hole 12*k*, into which the end portion 9*h*3 of the antenna rod 9*h* has been inserted, is plugged from outside using thermal welding or the like method, so that toner invasion can be prevented. Next, the toner stirring members 9*e* and 9*f* will be described. The toner stirring members 9*e* and 9*f* are shaped like a crank, and stir the toner as they rotate. They are disposed near the developing roller 9*c* and antenna rod 9*h*, across the toner path which the toner having been stored in the toner container 11A passes as it is fed toward the developing roller 9*c*. The toner stirring members 9*e* and 9*f* are fixed in perpendicularly to each other.

In assembling the toner stirring members 9*e* and 9*f* onto the developing frame 12, to begin with, the end portions 9*e*3 and 9*f*3 of the toner stirring members 9*e* and 9*f*, respectively, are inserted through corresponding through holes 12*t* and 12*r* provided on the side plate 12A of the developing frame 12, which is on the same side as the one through which the antenna rod 9*h* is inserted. Then, the end portions 9*e*3 and 9*f*3 are inserted into corresponding through holes 12*m* and 12*n*, provided on the side plate 12B, which is the opposite side plate of the side plate 12A. Thereafter, each of the through holes 12*m* and 12*n* are plugged from the outside by the thermal welding method, as are the through holes 12*k* for the antenna rod 9*h*. After the stirring members 9*e* and 9*f* are inserted into the developing frame 12 as described above, stirring gears 9*m* and 9*n* are fitted into the through holes 12*t* and 12*r*. At this time, notches 9*m*1 and 9*n*1, which are cut in the axial direction at the end portions of the gears 9*m* and 9*n*, respectively, are engaged with the crank arms 9*e*2 and 9*f*2 of the toner stirring members 9*e* and 9*f*, respectively. Further, the journals 9*e*1 and 9*f*1 of the stirring members 9*e* and 9*f* are fitted into center holes (unillustrated) provided at the deeper ends of the notches 9*m*1 and 9*n*1 of the gears 9*m* and 9*n*, respectively, supporting thereby the toner stirring members 9*e* and 9*f* on the developing frame 12.

When the toner frame 11 and developing frame 12 are joined, the side plate 12A of the developing frame 12, which is located on the side from which the antenna rod 9*h* and toner stirring members 9*e* and 9*f* are inserted, overlaps the side plate of the toner frame 11, covering the toner cap 11*f* provided on the top frame 11*a* of the toner frame 11. Also, on the side plate 12A, a hole 12*x* is provided, in which a toner feeding gear 9*s* (FIG. 28) for transmitting the driving force to the toner feeding member 9*b* is rotatively fitted. The toner feeding gear 9*s* is linked with the coupling member 11*e* (FIGS. 29 and 30), which is rotatively supported by the toner frame 11*a* and is engaged with the end portion of the toner feeding member 9*b*, whereby the driving force is transmitted to the toner feeding member 9*b*.

Next, how the driving force is transmitted will be described.

Figure 35:
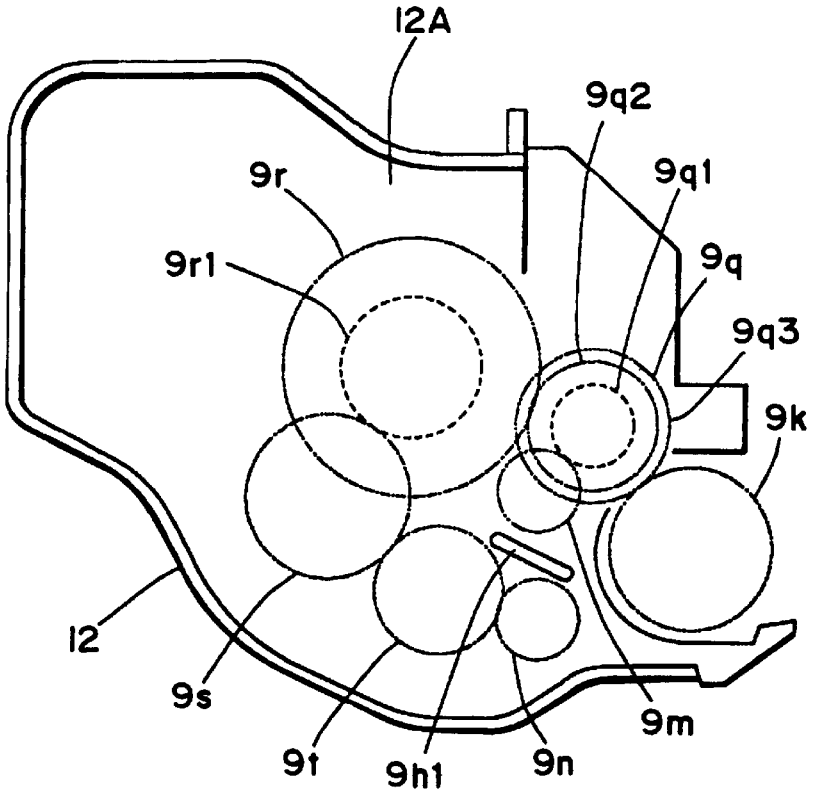
FIG. 35 is a side view illustrating a gear train of FIG. 28.

Referring to FIGS. 28 and 35, the stirring gears 9*m* and 9*n*, and the toner feeding gear 9*s*, receive the driving force from the developing roller gear 9*k*. More specifically, to begin with, the stirring gear 9*m* receives the driving force through a small gear 9*q*1 of an idler gear 9*q* as a stepped gear. Receiving this driving force, the stirring member 9*e* rotates. The idler gear 9*q* receives the driving force from the developing roller gear 9*k* since the large gear 9*q*3 of the idler gear 9*q* meshes with the developing roller gear 9*k*. The received driving force is transmitted from the middle gear 9*q*2 of the idler gear 9*q* to an idler gear 9*r* as a stepped gear. Then, the driving force is further transmitted from the small gear 9*r*1 of the idler gear 9*r* to the toner feeding gear 9*s*, rotating thereby the stirring member 9*b* (through the coupling member 11*e*). Further, the driving force is transmitted from the toner feeding gear 9*s* to the stirring gear 9*n* by way of an idler gear 9*t* to rotate the stirring member 9*f*. It should be noted here that all the idler gears, 9*q*, 9*r* and 9*t*, are rotatively mounted on corresponding dowels, 12*e* 12*f* and 12*g*, which are integrally formed with the developing frame 12. These dowels 12*e*, 12*f* and 12*g* are approximately 2 mm to 3 mm in diameter, and their end portions are supported by the developing frame holder 40 which will be described later; therefore, the dowels 12*e*, 12*f* and 12*g* do not deform due to load. Further, the rigidity of dowels 12*e*, 12*f* or 12*g* is increased by padding or stepping their base portions, or the like means.

The gear train described above is disposed on the same side surface as the previously described U-shaped portion 9*h*1 of the antenna 9*h*.

With the adoption of the above structure, a single member (in this embodiment, the developing frame holder 40) can support the gears constituting the gear train, and establish electrical connection for the toner remaining detecting contact point. In addition, all of the toner stirring members 9*e* and 9*f*, antenna rod 9*h*, gears 9*o*, 9*r*, 9*s* and 9*t* constituting the gear train, and stirring gears 9*m* and 9*n*, can be assembled into the developing frame 12 from the same side relative to the longitudinal direction of the developing frame 12. Therefore, assembly effeciency can be greatly improved.

The mandible-like portion 12*h* of the developing frame 12 doubles as a conveying guide for the recording medium 2, such as recording paper. In order to increase the rigidity, the developing frame 12 may be formed using the blow molding method.

Referring to FIG. 27, a reference numeral 12P designates an opening which extends in the longitudinal direction of the developing frame 12. As the toner frame 11 and developing frame 12 are joined, this opening 12P aligns with the opening 11*i* of the toner frame 11, allowing the toner stored in the toner frame 11 to be supplied to the developing roller 9*c*. The aforementioned stirring members 9*e* and 9*f*, and antenna rod 9*h*, are mounted across the entire longitudinal length of this opening 12P.

Further, according to this embodiment, the developing frame 12 comprising the developing roller mount 12X, side plate 12A, developing blade mount (blade accommodating flat surface 12*i*), antenna rod 9*h* mount (through holes 12*b*, 12*k* and 12*o*), stirring member mount (through holes 12*t*, 12*r*, 12*m* and 12*n*), gear mount (dowels 12*e*, 12*f* and 12*g*), and the like, is integrally formed with these portions. The material for the developing frame 12 is the same as the aforementioned material for the toner frame 11.

[Developing frame holder 40]

Next, the developing Frame Holder 40 will be described.

Figure 24:
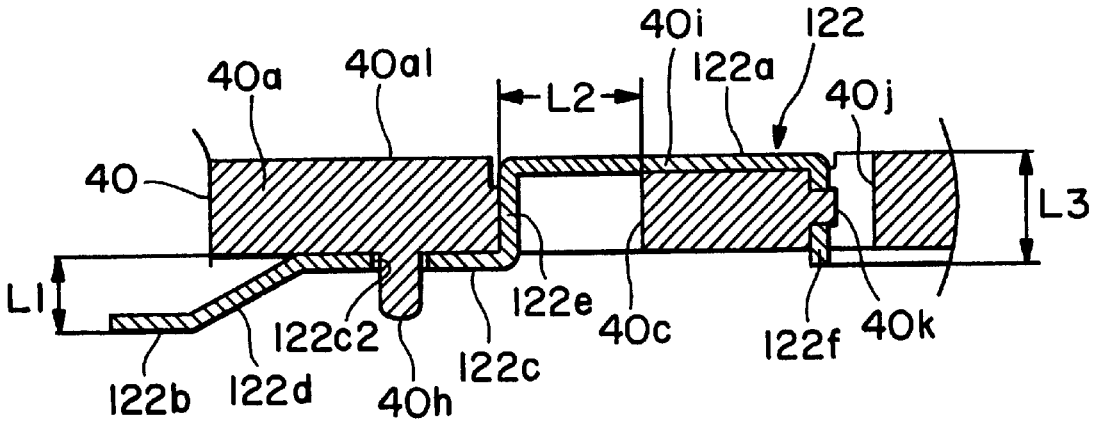
FIG. 24 is a sectional view taken along a line I—I in FIG. 23, (a).
Figure 25:
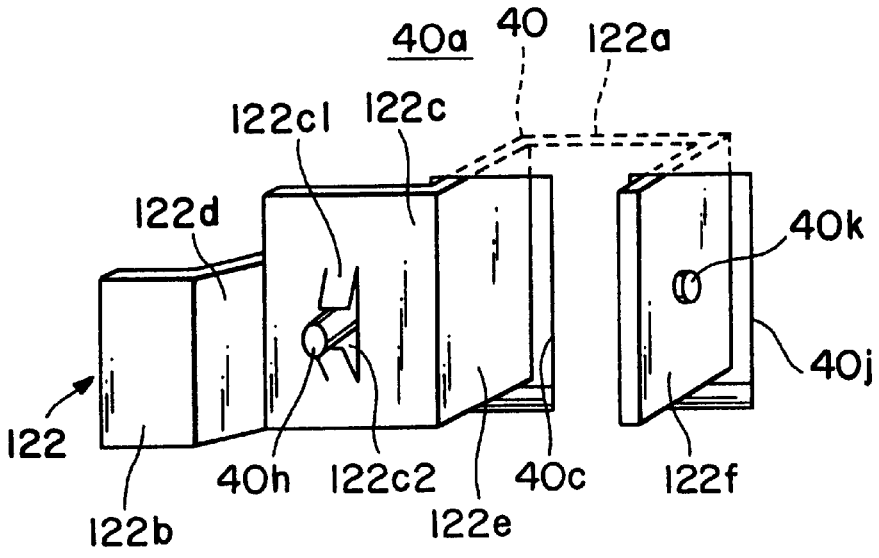
FIG. 25 is an enlarged view of a toner detection point in FIG. 23.

Referring to FIGS. 4–9 and FIGS. 23–25, description will be given as to the developing frame holder 40. FIG. 23(*a*) is a perspective view of the developing frame holder, which is mounted on the driving side, as seen from the outside of the developing frame 12; FIG. 23(*b*) is a perspective view of the same as seen from inside; FIG. 24 is an enlarged sectional view of the FIG. 3(*b*) at (I)—(I) line; and FIG. 25 is an enlarged perspective view of the toner detecting contact point.

The developing unit D is completed by attaching the development holders 40 and 41 at the corresponding lateral ends of the developing frame assembly, having been finished up to the stage illustrated in FIG. 28. In this case, the developing roller unit G is mounted in the following manner. First, one of two pins 40*d* provided at different locations of the developing frame holder is engaged with the hole 9*j*1 of the aforementioned developing roller bearing, and the other pin 40*d* is engaged with the hole 12*p* of the developing frame 12.

Next, the developing frame holders 40 and 41 are fixed to the developing frame 12 with screws, in such a manner that the developing roller bearings 9*j* are sandwiched between the corresponding developing frame holder s 40 and 41, and the developing frame 12. At this time, the screws are put through the corresponding holes 40*l* of the holders 40 and 41. Next, one end 9*g*1 of the magnet 9*g* (FIGS. 3 and 28) contained in the developing roller 9*c* is engaged with a D-shaped hole 40*e* provided on the developing frame holder 40, and the other end 9*g*2 is engaged with a hole (unillustrated) provided on the developing frame holder 41, whereby the position of the magnet 9*g* in the longitudinal direction is fixed. The angles of the magnetic poles of the magnet 9*g* are determined as the end portion 9*g*1, having the aforementioned D-shaped section, is engaged with the D-shaped hole 40*e* of the developing frame holder 40.

Next, rotational shafts 20, which are integrally formed with the developing frame holders 40 and 41 and project therefrom, are placed into recessed portions 21 (FIG. 9(*b*)) of the cleaning frame, and covered with-connector members 22 (FIG. 7), whereby the developing unit D is rotatively supported on the cleaning frame 13 which supports the photosensitive drum 7, and in addition, the compression spring 22*c* attached to the connector members 22 is compressed against the spring seats 22*b* of the developing frame holders 40 and 41, stabilizing the distance between the photosensitive drum 7 and developing roller 9*c* (preventing the distance from widening).

As already described, the long guide 12*a* is disposed on the external surfaces of the developing frame holders 40 and 41. In addition, the metallic plate toner detecting contact point 122 for detecting the amount of the remaining toner, and the developing bias contact point 121, are fitted on the developing frame holder 40; these contact points 121 and 122 are fixed to the developing frame holder 40 as the dowels provided on the internal surface of the developing frame holder 40 are forced into the locking hole of the contact points.

To begin with, how the toner detection contact point 122 is attached will be described with reference to the drawings.

FIG. 24 is a sectional view of FIG. 23(*b*), at the (I)—(I) line, and FIG. 25 is an enlarged view of the toner detection contact point illustrated in FIG. 23(*b*) and the adjacent portions thereof. The toner detection contact point 122 has an external contact point portion 122*a* and an internal contact point portion 122*b*. The external contact point portion 122*a* is disposed on the external surface of the holder 40, and when the process cartridge B is in the apparatus main assembly 14, it contacts a toner detection contact point member 126 provided on the apparatus main assembly 14. The internal contact point portion 122*b* presses on the U-shaped portion 9*h*1 of the antenna rod 9*h*. Referring to FIG. 24, the external contact point portion 122*a* is at substantially the same level as the side plate 40*a* of developing frame holder 40. The internal contact point portion 122*b* is disposed within the developing frame holder 40, opposing the antenna rod 9*h*.

Referring to FIG. 25, the toner detection contact point 122 is mounted on the developing frame holder 40, with its locking flap 122*c*1 cut out of the mounting base 122*c* being fitted around the dowel 40*h* which projects inwardly from the side plate 40*a*, and the mounting base 122*c* being in contact with the side plate 40*a*. Further, from the mounting base 122*c*, an angled portion 122*d* is extended at an angle, and from the angled portion 122*d*, the internal contact point 122*b* is extended at an angle, so that the internal contact point 122*b* becomes parallel to the side plate 40*a*. Further, a connective portion 122*e*, which is bent outward at 90 degrees from the mounting base 122*c*, projects outward along one of the edges of the first rectangular hole 40*c* formed in the side plate 40*a*. Then, the connective portion 122*e* is bent at 90 degrees in the direction opposite to the direction in which the connective portion 122*e* is already bent, constituting the external contact point portion 122*a*. The external contact point portion 122*a* is in contact with the bottom surface of a recessed portion 40*i* formed in the side plate 40*a*. The depth of this recessed portion 40*i* is substantially the same as the thickness of the external contact point portion 122*a* (FIG. 24). Therefore, the outward facing surface of th e external contact point portion 122*a*, and the outward facing surface 40*a*1 of the side plate 40, are at substantially the same level. Further, the end portion of the external contact point portion 122*a* is put through the second rectangular hole 40*j* formed in the side plate 40*a*, reaching the interior of the side wall 40*a*, with an end fixing portion 122*f* being engaged with a dowel 40*k* projecting from one of the walls of the second rectangular hole 40*j*. This is the way t hat toner detection contact point is mounted on the developing frame holder 40.

Referring to FIG. 24, a width L2 of the first hole 40*c*, of the side plate 40*a*, is greater than a distance L1 between the side wall facing surface of the mounting base 122*c* of the toner detection contact point 122 and the outwardly facing surface of the external contact point portion 122*a*, and is also greater than the height of the end fixing portion 122*f*. Further, a gap large enough to allow the end fixing portion 122*f* of the toner detection contact point 122 to be passed through is provided between the end surface of the dowel 40*k* within the second hole 40*j* and the opposing surface of the second hole.

The toner detection contact point 122 is mounted in the following manner. First, the end fixing portion 122*f* is inserted into the first hole 40*c*, from the inside of the developing frame holder 40. Then, the end fixing portion 122*f* is inserted into the second hole 40*j* by rotating the toner detection contact point 122 in the clockwise direction of FIG. 24. Subsequently, the hole 122*c* of the mounting base 122*c* is engaged with the dowel 40*k*. On the other hand, the end fixing portion 122*f* rides over the dowel 40*k* due to its own elasticity, and th hole of the end fixing portion 122*f* engages with the dowel 40*k*.

The developing bias contact point 121 will be described.

The developing bias contact point 121 comprises a plate spring portion 121*a* located within the developing frame holder 40; an internal contact point portion 121*b* ; and an external contact point portion 121*c* located on the outwardly facing surface 40*a*1. As the developing frame holder 40 is attached to the developing frame 12, the plate spring portion 121*a* elastically contacts the bent portion 9*d*1*a* of the metal plate substantially equal to the potential of the developing roller 9*c*. The internal contact point portion 121*b* is fitted around a boss 40*f* provided with the aforementioned hole 40*e*, being elastically in contact with the coil spring contact point 91 which is fitted around the 40*f* (contact pressure is approximately 100 g to 300 g). The frictional area of the internal contact point portion 121*b* may be coated with electrically conductive grease if desired. The external contact point portion 121*c* is disposed in the recessed portion of the side plate 40*a*, and its external surface outwardly facing surface 40*a*1 of the developing frame holder 40. When the process cartridge B is in the apparatus main assembly 14 external contact point portion 121*c* is in contact with a developing frame contact point member 125 provided in the apparatus main assembly 14, and receives the developing bias to be applied from the apparatus main assembly 14 to the developing roller 9*c*. The developing bias received from the apparatus main assembly 14 is applied to the developing roller 9*c* through the developing bias contact point 121 and coil spring contact point 91.

As the developing frame holder 40 is attached to the developing frame 12, the internal contact point portion 122*b* in the form of a plate spring comes in contact with the U-shaped portion 9*h*1 of the antenna rod 9*h* illustrated in FIG. 28; therefore, the toner detection contact point 122 is electrically connected to the antenna rod 9*h*. The contact pressure between the antenna rod 9*h* and internal contact point portion 122*b* is approximately 100 g. When the process cartridge B is in the apparatus main assembly 14, the external contact point portion 122*a* provided on the outwardly facing surface 40*a*1 of the developing frame holder 40 is electrically connected to the contact point member 126 provided in the apparatus main assembly 14. Therefore, an electrical signal, corresponding to the capacitance which changes in response to the change in the amount of toner between the developing roller 9*c* and antenna rod 9*h* is transmitted to the developing frame 12 through the antenna rod 9*h*, and toner detection contact point 122. As the control section (not shown) detects that the electric signal transmitted to the contact point member 126 has reached a predetermined value, it signals a need for process cartridge exchange. Three engagement holes 40*g* provided in the internal surface of the developing frame holder 40 are engaged with the corresponding end portions of the dowels 12*e*, 12*f* and 12*g* which serve as the gear shafts for the gears 9*q*, 9*r* and 9*t* illustrated in FIG. 35. In other words, the dowels 12*e*, 12*f* and 12*g* are supported by the developing frame holder 40 and the developing frame 12, coming between the two. The engagement hole 40*m* provided in the internal surface of the developing frame holder 40, rotatably supports the stirring gear 9*m*.

As is evident from the foregoing description, the fact that various functions are assigned to a single component (developing frame holder) leads to improvement in assembling efficiency, and also, cost reduction.

Further, according to this embodiment, developing frame holder 40 comprises the rotatable shaft 20, spring seat 40*b*, long guide 12*a*, engagement hole (hole 40*a*) for magnet 9*g*, mount (boss 40*f* and the like) for the developing bias contact point 121, mount (dowel 40*h*, first hole 40*c*), developing frame holder 40 (dowel 40*k* and the like) for the toner detection contact point 122, engagement hole 40*m*, pin 40*d*, screw hole 401, and the like, and these portions are integrally formed with the developing frame holder 40. The developing frame holder 41 comprises the rotatable shaft 20, spring seat 40*b*, long guide 12*a*, and the like, and these portions are integrally formed with the developing frame holder 41. Each of the developing frame holders 40 and 41 is formed, as a single piece component of acrylonitrile-styrene copolymer resin (containing glass filler by 20%).

The positions of the developing frame holders 40 and 41 are fixed as the pins 40*d* of the developing frame holders 40 and 41 are inserted into the corresponding holes 12*p* of the developing frame 12. Then, the developing frame holders 40 and 41 are fixed to the developing frame 12 with the use of screws put through the screw holes 401 (developing frame holders 40 and 41), and screw holders 12*r*1 (developing frame 12).

[Structure of Bottom Surface of Cleaning Frame]

Figure 34:
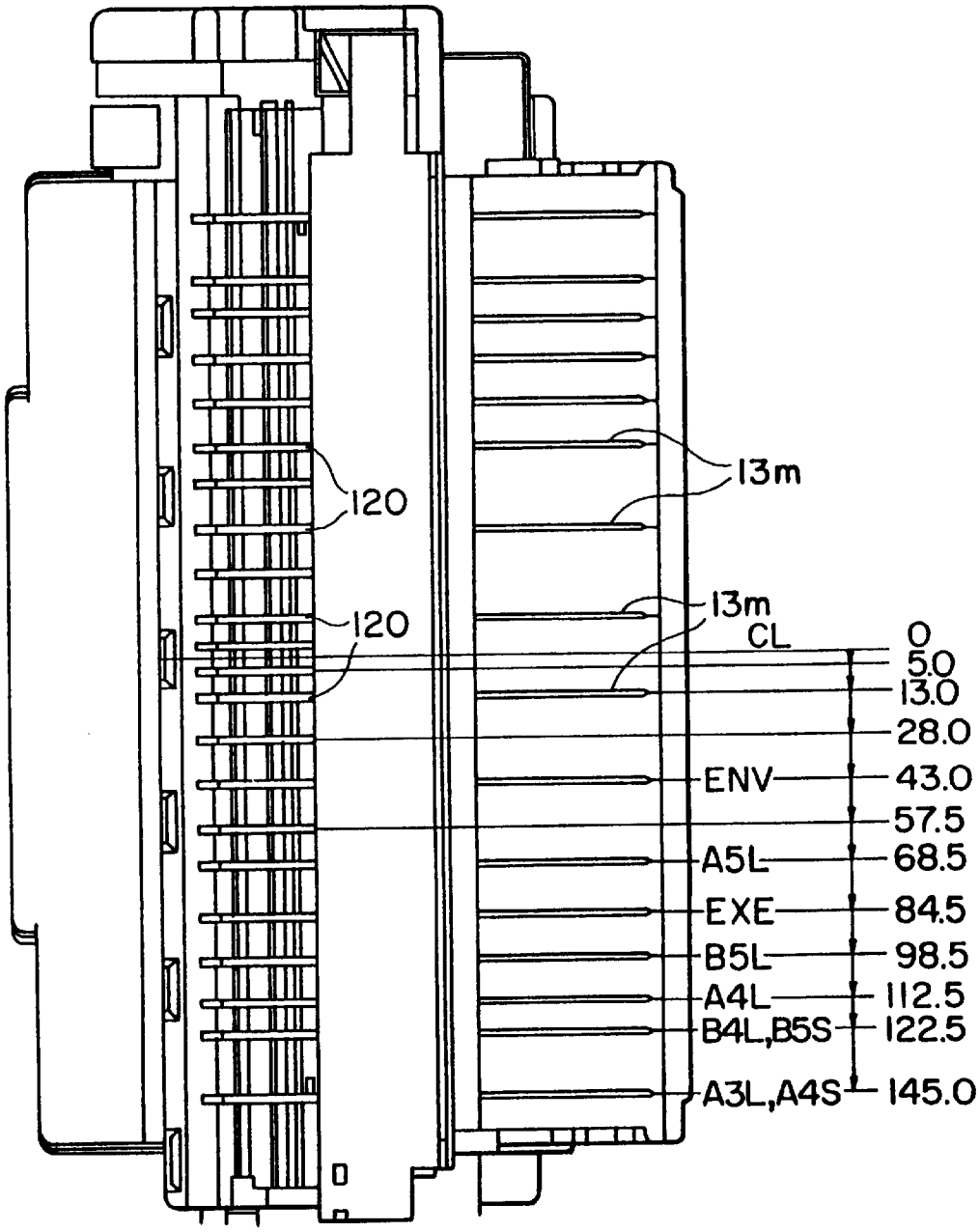
FIG. 34 is a bottom view of a process cartridge.

The developing frame 12 and cleaning frame 13 are provided with guide ribs 12*l* and 13*m*, which project from the bottom surfaces thereof, respectively, extending in parallel in the moving direction of the recording medium or material 2. Both guide ribs 12*l* and 13*m* are arranged in such a manner that the outermost ribs 12*l* and 13*m* fall within the path of the widest piece of recording medium 2 by a small margin. In this embodiment, the outermost ribs are located approximately 5 mm inwardly from the edges of the path of the widest piece of recording medium 2. The remainder of the ribs are spread between the outermost ribs to facilitate conveyance of the recording medium 2. The image forming apparatus in this embodiment is of a type that can accommodate recording medium 2 of different sizes, and the recording medium 2 is centered regardless of size (center line CL coincides with the center line of the recording medium 2). Therefore, the arrangement of the ribs provided on the bottom surface of the developing frame 12 and cleaning frame 13 is symmetrical relative to the (center line CL). The rib height is a predetermined value for the developing frame 12 and cleaning frame 13, respectively, to facilitate conveyance of the recording medium 2. By adopting the above structure, the image disturbance due to the contact between the pre-fixation toner image and the bottom surface of the cleaning frame 13 can be prevented, while improving conveyance efficiency. FIG. 34 shows an example of measurement in millimeters between the center line CL and various ribs, along with the symbols corresponding to the standard sizes (Japan Industrial Standard) for the recording medium 2. For example, a symbol A3L stands for an A3 size recording medium fed in the longitudinal direction; a symbol A4S stands for an A4 size recording medium fed in the widthwise direction. A symbol ENV stands for a recording medium of envelope size, and EXE corresponds to a recording medium of an EXE size. The guide ribs 12*l* and/or 13*m,* located 5.0 mm, 13.0 mm and 28 mm away from the center line CL, are the ribs which make contact with the center line of the recording medium 2.

FIG. 34 is a schematic view of the bottom portion of the cleaning frame 13 as seen from the sheet conveyance direction. This embodiment is different in that the height of guide ribs 13*m* is symmetrically increased in relation to the distance from the center line; both ribs of each rib pair corresponding to one of the various sheet sizes of the recording medium 2 have the same height. This rib arrangement can reliably prevent the ribs located toward the center line CL from coming in contact with the image bearing surface of the recording medium 2, reliably preventing the image disturbance. The horizontal rib arrangement in this embodiment is the same as the embodiment in which the rib height is the same for all ribs.

[Structure of Electrical Contact Points]

Hereinafter referring to FIGS. 5, 8, 9 and 19, the connection and placement of the contact points, which establishes electrical connections between the process cartridge B and the laser beam printer main assembly 14 when the former is installed into the latter, will be described.

The process cartridge B is provided with a plurality of electrical contact points: (1) Electrically conductive grounding contact point 119 electrically connected to the photosensitive drum 7 to ground the drum 7 through the apparatus main assembly 14; (2) Electrically conductive charging bias contact point 120 electrically connected to the charging roller shaft 8*a* in order to apply a charge bias from the apparatus main assembly 14 to the charging roller 8; (3) Electrically conductive developing bias contact point 121 electrically connected to the developing roller 9*c* in order to apply a developing bias from the apparatus main assembly 14; and (4) Electrically conductive toner remaining detecting contact point 122 electrically connected to an antenna rod 9*h* in order to detect the amount of the remaining toner. All of these four contact points 119–122 are exposed on the lateral surface (right-hand side) of the cartridge frame, with intervals large enough to prevent electrical leakage among them. As described before, the ground contact point 119 and charge bias contact point 120 are disposed on the cleaning means frame 13, and development bias contact 121 and toner remainder detecting contact point 122 are disposed on the development chamber frame 12 (developer holder 40). It should be noted here that the toner remaining detecting contact point 122 doubles as a cartridge detecting contact point for detecting the presence (or absence) of the process cartridge within the apparatus main assembly 14.

The grounding contact point 119 is constituted of the electrically conductive axial shaft 7*a* of the photosensitive drum 7, or an electrically conductive insert molded in the shaft 7 of resin material. In this embodiment, it is constituted of a metallic shaft 7*a* of iron or the like. The other contact points 120, 121 and 122 are approximately 0.1 mm to 0.3 mm thick electrically conductive metallic pieces, for example, stainless steel pieces, phosphor bronze pieces, or the like, which are planted on the surface so as for their leg portions to reach into the process cartridge interior. The charging bias contact point 120 is exposed on the driving side surface (lateral side C1) of the cleaning unit C, and the developing bias contact point 121 and toner remaining detecting contact point 122 are exposed on the driving side surface (lateral side D1) of the developing unit D.

More specifically, referring to FIG. 20, in this embodiment, the helical drum gear 7*b* is provided at one end of the photosensitive drum 7 in the axial direction of the drum 7 as described before. This helical drum gear 7*b* engages with the helical driver gear 28 provided on the apparatus main assembly 14 to rotate the drum 7. As this helical gear 7*b* rotates, it generates a thrust (in the direction of an arrow d in FIG. 20), pressing thereby the drum 7, which is mounted on the cleaning means frame portion 13 with the allowance of some play in its longitudinal direction, toward the direction of the helical gear 7*b*. As a result, one 7*b*1 of the lateral surfaces of the helical gear 7*b* remains in contact with the internal surface 13*k*1 of one 13*k* of the lateral surfaces of the cleaning means frame portion 13 of the cartridge frame, whereby the position of the drum 7 within the cartridge B in the axial direction is regulated. The grounding contact point 119 and charging bias contact point 120 are exposed on one of the lateral surfaces 13*k* of the cleaning means portion 13 of the frame, wherein the grounding contact point 119 is at the end of the drum shaft 7*a*, and projects outward slightly (approximately 0.8 mm) beyond the end of the aforementioned cylindrical guide 13*a*. This drum shaft 7*a* is put through the drum cylinder 7*d* (aluminum cylinder in this embodiment) covered with a photosensitive layer 7*e*, and is supported at each end by the cylindrical guide 13*a*, which in turn is supported on the lateral walls 13*c* and 13*d*. The drum cylinder 7*d* and shaft 7*a* are connected with a grounding plate 7*f*, which is in contact with both the internal surface 7*d*1 of the drum cylinder 7*d* and the peripheral surface 7*a*1 of the shaft 7*a*.

The charging bias contact point 120 is located almost directly above the long guide 12, that is, adjacent to the cleaning means portion 13 of the frame, which supports the charging roller 8 (FIG. 9(*a*)). Also, the charging bias contact point 120 is electrically connected to the charging roller shaft 8*a* through an electrically conductive member 120*a*, which is in contact with the charging roller shaft 8*a*.

Next, the developing bias contact point 121 and toner remaining detecting contact point 122 will be described. These two contact points 121 and 122 are located on one surface, D1, of the lateral surface of the developing unit D, that is, the same side as the lateral surface 13*k* of the cleaning means portion 13 of the frame. The developing bias contact point 121 is located directly below the long guide 12*a* and adjacent to the right-hand end of the frame portion 12*c* where the magnet 9*g* contained in the developing roller 9*c* is supported (FIG. 5), and is electrically connected to the developing roller 9*c* through the coil spring contact point 91, which is in contact with the lateral end of the developing roller 9*c* (FIG. 9(*b*)). Referring to FIG. 5, the toner remaining detecting contact point 122 is disposed on the upstream side of the long guide 12*a* relative to the cartridge inserting direction (arrow X direction in FIG. 8), and is connected to an antenna rod 9*h,* which is disposed on the side of the toner container 11A and extends in the longitudinal direction of the developing roller 9*c* in parallel with the developing roller 9*c* as shown in FIG. 9(*b*), through the electrically conductive member 9*f*, which is in contact with an antenna rod 9*h*. The antenna rod 9*h* is disposed so as to hold a predetermined distance from the developing roller 9*c*. The capacitance between this antenna rod 9*h* and developing roller 9*c* varies in response to the amount of the toner present between two components; therefore, the amount of the remaining toner is detected by measuring this capacitance change as a potential difference change, through a control section (unillustrated) in the apparatus main assembly 14.

Here, the terminology "amount of the remaining toner" means an amount of the toner that creates a predetermined amount of capacitance by being present between the developing roller 9*c* and antenna rod 9*h*. In other words, the detection of the predetermined amount of capacitance means that the amount of the toner remaining in the toner chamber 11A has reached the predetermined amount.

Thus, it is detected by the control section, which is provided in the apparatus main assembly 14 and is connected to the cartridge B through the toner remaining detecting contact point 122, that the capacitance has reached a predetermined first value; whereby it is determined that the amount of the toner remaining in the toner chamber 11*a* has reached the predetermined amount. When it is detected that the capacitance has reached the aforementioned first determined value, the apparatus main assembly 14 signals the need for process cartridge B exchange (for example, a flashing light or a buzzing sound). When the capacitance detected by the control section matches a predetermined second value, which is smaller than the first value, the detecting circuit determines that the cartridge B has been installed in the apparatus main assembly 14. The control section circuit does not allow the apparatus main assembly 14 to be driven unless it detects that the cartridge B has been installed in the apparatus main assembly. In other words, the control section does not allow the apparatus main assembly 14 to start forming images.

It may be arranged so that a warning signal (for example, a blinking light or the like) may be provided to inform the operator of the absence of the cartridge B in the apparatus.

Next, a description will be given as to the connection between the contact point provided on the cartridge B and the contact point member provided on the apparatus main assembly 14.

Referring to FIG. 19, four contact point members, which make contact with corresponding contact points 119–122 when the process cartridge is installed in the apparatus A, are provided on one of the lateral walls of the cartridge accommodating space S of the image forming apparatus A (grounding contact point member 123 which electrically contacts the grounding contact point 119, charging bias contact point member 124 which electrically contacts the charging bias contact point 120, developing contact point member 125 which electrically contacts the developing bias contact point 121, and toner detection contact point member 126 which electrically contacts the toner remaining detecting contact point 122).

As shown in FIGS. 19(*a*) and 19(*b*), the grounding contact point member 123 is disposed in correspondence to the groove 16*a*5. The developing bias contact point member 125 and toner remaining detecting contact point member 126 are disposed below the first guide portion 16*a*. The charging bias contact point member 124 is disposed above the second guide portion 16*b*.

Here, the positional relationship between the contact points and guides will be described.

First, referring to FIG. 5, as for the positional relationship in the vertical direction (as seen from the horizontal direction), the developing bias contact point 121 is the bottommost one; the toner remaining detecting contact point 122, long guide 12*a* and cylindrical guide 13*a* (grounding contact point 119) are disposed above the bias contact point 121, being at about the same level; above them is the short guide 13*b*, and the topmost one is the charging bias contact point 120. As for the positional relationship in the cartridge inserting direction (arrow X direction), the toner remaining detecting contact point 122 is the most upstream one; next is the long guide 12*a*; at a further downstream location is the charging bias contact point 120 and developing bias contact point 121; and at the most downstream locations are short guide 13*b* and cylindrical guide 13*a* (grounding contact point 119). Arranging the contact points as described above allows the charging bias contact point 120 to be positioned near the charging roller 8; the developing bias contact point 121, near the developing roller 9*c*; the toner remaining detecting contact point 122, near the antenna rod 9*h;* and the grounding contact point 119 to be positioned near the photosensitive drum 7. Therefore, the wiring for the contact points can be shortened.

The measurements of the contact points are as follows: the charging bias contact point 120 is approximately 10.0 mm in height and width (tolerable range of 8.0 mm to 12.0 mm); developing bias contact point 121, approximately 9.0 mm in height (tolerable range of 6.0 mm to 12.0 mm) and approximately 8.0 mm (tolerable range of 5.0 mm to 11.0 mm): toner remaining detecting contact point 122, approximately 8.0 mm (tolerable range of 6.0 mm to 10.0 mm) in height and approximately 9.0 mm (tolerable range of 7.0 mm to 11.0 mm) in width; and grounding contact point 119 is circular and its diameter is approximately 7.0 mm. The charging bias contact point 120, developing bias contact point 121, and toner remaining detecting contact point 122 are rectangular.

The grounding contact point member 123 is an electrically conductive plate spring member, and is mounted in the groove 16*a*5, in which the cylindrical guide 13*a* (in which the drum shaft 7*a* of the photosensitive drum 7 is fitted), on which the grounding contact point 119 of the cartridge B is mounted, is disposed to fix the position of the cartridge B, whereby the grounding contact point member 123 is grounded through the chassis of the apparatus main assembly (FIGS. 19 and 26). The other contact point members 124, 125 and 126 are mounted in the corresponding holder covers 127 in such a manner as to be projected therefrom by the corresponding compression springs 129. This arrangement will be described referring to the charging bias contact point member 124. Referring to FIG. 20, the charging bias contact point member 124 is placed under a holder cover so that it projects but does not come off, and then, this holder cover 127 is fixed to a circuit board 128 mounted on one of the lateral walls of the apparatus main assembly, whereby the contact point members are electrically connected to the wiring patterns by the electrically conductive compression springs 129, correspondingly.

Next, referring to FIG. 21, it will be described with reference to the charging bias contact point member 120 how the contact points on the cartridge side come in contact with the corresponding contact point members on the image forming apparatus side when the process cartridge B is installed into the image forming apparatus A. FIG. 21 is an explanatory drawing, which depicts the state of the process cartridge B in the image forming apparatus A, wherein an arrow mark H designates the movement of the charging bias contact point 124 on the apparatus main assembly, relative to the process cartridge B, when the cartridge B is installed into the image forming apparatus A. It should be noted here that FIG. 21 is a cross-section of FIG. 5 at a line 0.

During the installation of the process cartridge B into the image forming apparatus A using the guide members 16*a* and 16*b* as the guide, the charging bias contact point member 124 is in the state (a) depicted in FIG. 21 before it reaches the predetermined position where it is to be fixedly disposed. At this time, the charging bias contact point member 124 is not in contact with the flat surface 20 of the cleaning means portion 13 of the frame. As the cartridge B is further inserted, the charging bias contact point member 124 is advanced to a position (b) in FIG. 21. In this state, it remains in contact with the slanted surface 31 (FIG. 5) formed on the right lateral wall 13*c* of the cleaning means portion 13 of the frame; slides on this slanted surface 31, whereby it is gradually pressed, compressing thereby gradually the compression spring 129; and smoothly moves onto the flat surface 32 where the charging bias contact point 120 is exposed. When the inserted cartridge B arrives at the predetermined location, the contact member 124 arrives at a position (c) in FIG. 21, where it makes contact with the charging bias contact point 120. The other contact point members 125 and 126 come in contact with the contact points 121 and 122, respectively, in the same manner.

With such an arrangement as described above being in place, when the cartridge B is guided by the guide member 16 into the predetermined cartridge accommodating location, the contact points and the corresponding contact point members are reliably placed in contact with each other.

Further, when the process cartridge B is positioned at the predetermined location in the apparatus main assembly 14, the grounding contact point member 123 in the form of a plate spring makes contact with the grounding contact point 119 projecting from the cylindrical guide 13*a* (FIG. 20). As the process cartridge B is inserted into the apparatus main assembly 14, the grounding contact point 119 and grounding contact member 123 electrically contact with each other, thereby grounding the photosensitive drum 7. The charging bias contact point 120 and charging bias contact member 124 electrically contact with each other, thereby allowing a high voltage (superposed voltage of AC and DC voltages) to be applied to the charging roller 8. The developing bias contact point 121 and developing contact member 125 make electrical contact with each other, thereby allowing a high voltage to be applied to the developing roller 9*c*. The toner remaining detecting contact point 122 and toner remaining detecting contact member 126 make electrical contact with each other, thereby allowing information reflecting the capacitance to be transmitted to the apparatus main assembly 14.

Next, a case in which the photosensitive drum 7 is rotated by driving the image forming apparatus A, will be described. The photosensitive drum 7 is given an approximately 2 mm to 3 mm thrust play in the axial direction so that it is easier to install the process cartridge B into the image forming apparatus A. Therefore, it is necessary for the charging bias contact point member 124 or the like to be capable of projecting by a distance larger than the thrust play. Further, in this embodiment, a plate spring 45 is provided, which presses the process cartridge B toward one side (side where the contact point members 123–126 are located) of the apparatus main assembly when the cartridge B is in the apparatus main assembly. This plate spring 45 is on the side opposite to the side where the contact point members are located, above the first installation guide 16*a*.

Further, when the contact points 119–122 of the process cartridge B are disposed, as they are in this embodiment, on the side where the helical drum gear 7*b* is disposed (lateral wall on the driving side), the connection for mechanically driving the cartridge B by the apparatus main assembly through the helical drum gear 7*b*, and the electrical connection between the cartridge B and apparatus main assembly through the contact points 119–122, can be made on the same side of the cartridge B. Therefore, when the aforementioned side of the cartridge B is used as the reference side, the integrated error in the component sizes can be reduced, which makes it possible to mount more accurately the contact points and helical gear. Further, when a helical drum gear with teeth cut in such a direction as to generate a thrust directed toward the side where the helical drum gear is positioned is used, the position of the photosensitive drum 7 in the axial direction is fixed on the side where the contact points are located; therefore, in this case, the accuracy in the positional relationship between the photosensitive drum 7 and the contact points is also improved, in addition to the aforementioned effects. Further, when a lever 23 (FIG. 6) for opening or closing the drum shutter 18 is located, as it is in the aforementioned embodiment, on the side opposite to the one where the contact points 119–122 are located, the frictional resistance generated on one side of the cartridge by the contact points 119–122 as the cartridge B is inserted into the image forming apparatus A, and the resistance (or pressure), which is made by the lever 23 (FIG. 6) for opening or closing the drum shutter member 18, are distributed toward the longitudinal ends of the cartridge B when the process cartridge B is inserted into the image forming apparatus A; in other words, the resistance generated when the cartridge B is inserted is evenly distributed in the longitudinal direction of the cartridge B. Therefore, the cartridge B can be smoothly inserted.

Further, as described in the preceding embodiment, when all the contact points of the process cartridge B are positioned on one and the same lateral wall of the cartridge frame, and the process cartridge B is placed under the elastic pressure generated by the plate spring, it is possible to provide stable electrical connections between the contact points and the corresponding contact point members on the apparatus main assembly side.

Figure 22:
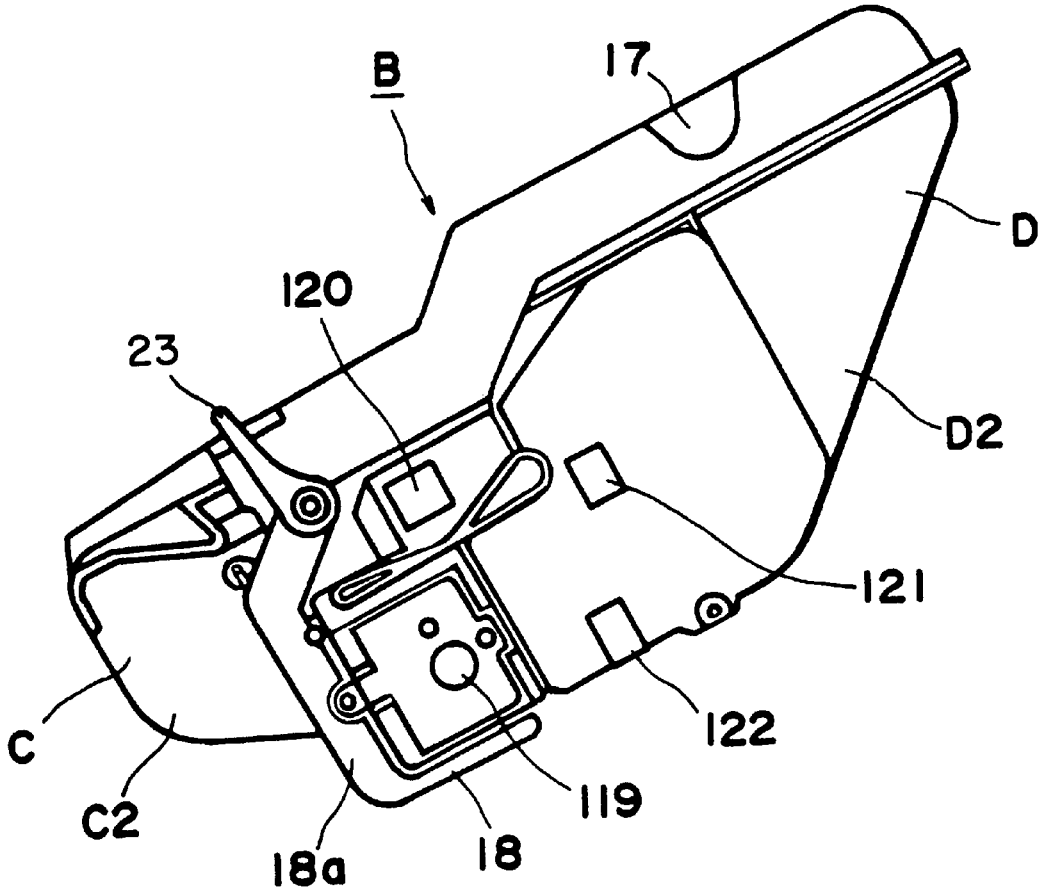
FIG. 22 is a side view of a process cartridge according to an embodiment of the present invention.

FIG. 22 illustrates an arrangement in which the contact points are located on the side where the aforementioned lever 23 is located. This arrangement can also sufficiently provide the aforementioned effects.

Hereinafter, other embodiments of the present invention will be described with reference to FIGS. 37–40.

[Structure of Housing]

The housing of the process cartridge B in this embodiment is formed by joining the toner container 111, developing frame 112, and cleaning frame 113. The structure of this housing will be described below.

Figure 37:
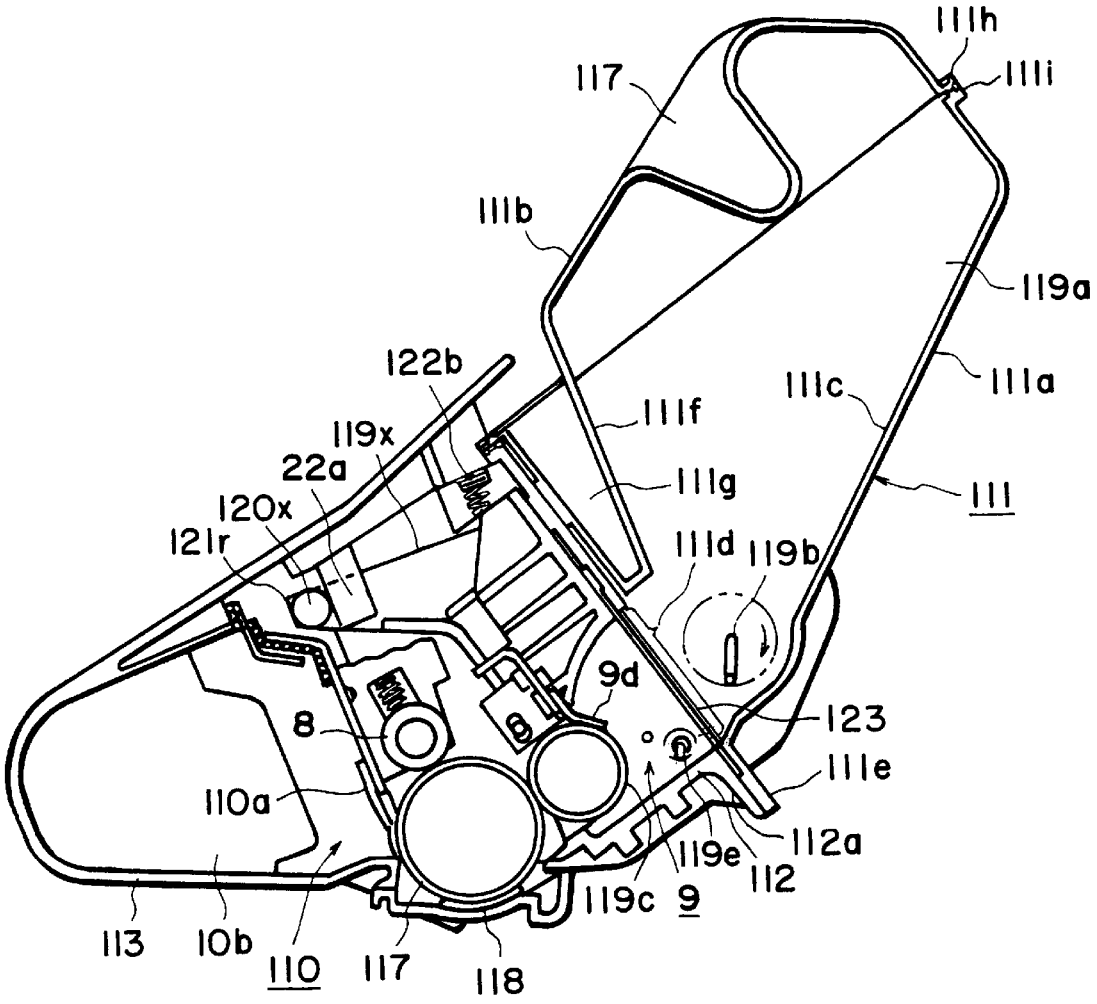
FIG. 37 shows an internal structure of a process cartridge.

Referring to FIGS. 37, the toner container 111 comprises a toner storing portion 119*a*, in which the toner stirring member 119*b* is mounted. The developing roller 119*c* and developing blade 119*d* are mounted on the developing chamber frame 112, and the stirring member 119*e*, which circulates the toner within the developing chamber, is rotatively mounted adjacent to the developing roller 119*c*. The aforementioned toner container 111 and developing chamber frame 112 are melt-welded to form a developing unit.

The photosensitive drum 117, charging roller 118, and cleaning means 110 are mounted on the cleaning means frame 113. Further, a drum shutter member 118, which covers and protects the photosensitive drum 117 when the process cartridge B is out of the apparatus main assembly 14 (FIG. 1), is attached to the cleaning frame 113 to form a cleaning unit.

Figure 38A:
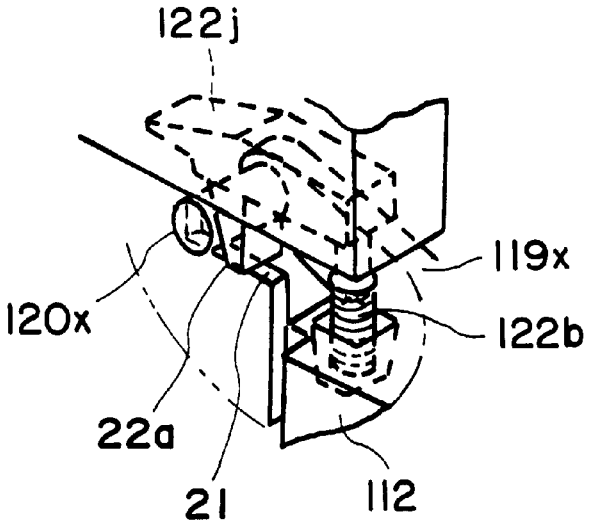
FIGS. 38(*a*) and 38(*b*) illustrate a coupling between a developing unit and a cleaning unit.
Figure 38B:
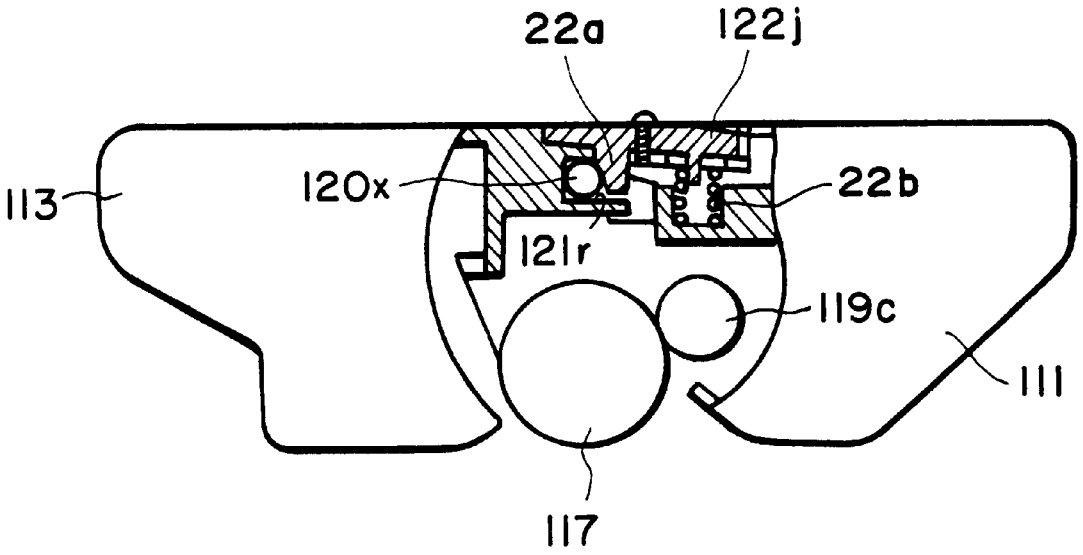

Then, the developing unit and cleaning unit are joined to complete the process cartridge B. More specifically, referring to FIGS. 38(*a*) and 38(*b*), a cover member for rotatively supporting each of the end portions of the developing roller 119*c* is attached to each of the longitudinal ends of the developing frame 112. An axis 120*x* is provided at the end of an arm portion 119*x* formed on this cover member (FIG. 38 illustrates only one side). On the other hand, a recessed portion 121*r,* is provided at each of the longitudinal ends of the cleaning frame. The joining member 122, with a recess portion 112*a* is mounted on the cleaning frame 113 with the use of screws after inserting the axis 120*x* into the recessed portion 121*r,* whereby the developing and cleaning units and are jointed in a manner so as to pivot from each other about the axis 120*x,* allowing thereby the developing roller 119*c* to be pressed toward the photosensitive drum 117 due to the weight of the developing unit D itself. Also, the joining member 122*r* is provided with a compression spring 122*b*, so that the developing frame 112 is pressed to reliably press the developing roller 119*c* toward the photosensitive drum 117. Further, a spacer ring 119*f* (unillustrated) is provided at each of the longitudinal end portions of the developing roller 119*c*, wherein this ring 119*f* is pressed on the photosensitive drum 117 to keep a predetermined distance between the photosensitive drum 117 and developing roller 119*c*.

[Structure of Toner Container]

Next, the structure of the toner container 111 will be described in further detail. Referring to FIG. 37, the toner container 111 is formed by welding together an actual container portion 111*a*, which is the first container portion, and a cover member 111*b*, which is the second container portion.

The actual container portion 111*a* is shaped like a bathtub. As the toner container is joined with the developing frame 112, its bottom wall constitutes the first toner descension surface 111*c*, which slopes down toward the developing roller 119*c*. The actual container portion 111*a* is structured so that when the process cartridge B is in the image forming apparatus A (FIG. 1), the first toner descension surface 111*c* is inclined approximately 65° to 80°, relative to the horizontal line, allowing the toner within the toner storing portion 119*a* to descend due to its own weight along the first toner descension surface toward the developing roller 119*c*.

In the bottommost end of the first toner descension surface 111*c*, a toner discharge opening 111*d* is provided, through which the toner stored in the toner storing portion 119*a* is discharged into the developing chamber. The toner discharge opening 111*d* is provided with a flange 111*e*, which is welded to the flange 112*a* of the developing frame 112 to unite the toner container 111 and developing frame 112.

The cover member 111*b* is welded to the actual container portion 111*a* to cover the top of the actual container portion 111*a*. The top surface of the cover member 111*b* has a recessed portion 117 as a handhold. A portion of the cover member 111*b*, on the developing frame side, constitutes the second toner descension surface 111*f*, which projects into the actual container portion 111*a*, thereby creating a recessed portion 111*g* in the external surface of the cover member 111*b*.

The second toner descension surface 111*f* slopes down toward the toner discharge opening 111*d* of the actual container portion 111*a*. The top cover 111*a* is structured so that when the process cartridge B is in the image forming apparatus A, the angle of the second toner descension surface 111*f*, relative to the horizontal line, falls within a range of approximately 60° to 70°. Therefore, the toner in the toner storing portion 119*a* descends due to its own weight along the toner descension surface 111*f* toward the toner discharge opening 111*d*.

The recessed portion 111*g* constitutes a tool recess in which tools are inserted when assembling the developing unit, which will be described later.

As described above, the first and second toner descension surfaces 111*c* and 111*f* leading, respectively, to the toner discharge opening 111*d* are inclined at such an angle as to allow the toner to descend due to its own weight; therefore, the entire amount of the toner in the toner storing portion 119*a* successfully descends toward the toner discharge opening 111*d*. It is understood that the toner descending along the first toner descension surface 111*c*, and the toner descending along the second toner descension surface 111*f* interfere with each other, becoming compacted, near the toner discharge opening 111*d*. However, in this embodiment, the toner stirring/feeding member 119*b* is disposed adjacent to the toner discharge opening 111*d;* therefore, the toner is fed by the stirring/feeding member 119*b* into the developing chamber through the toner discharging opening 111*d*, without becoming caked.

The stirring member 119*b* is formed by bending a rod into a shape of a crank. With one end projecting outward from the toner container 111, and linking with unillustrated driving means, the stirring member 119*b* is rotatable in the direction of an arrow mark in FIG. 37. As the stirring member 119*b* rotates, the toner is conveyed while being loosened.

Figure 39:
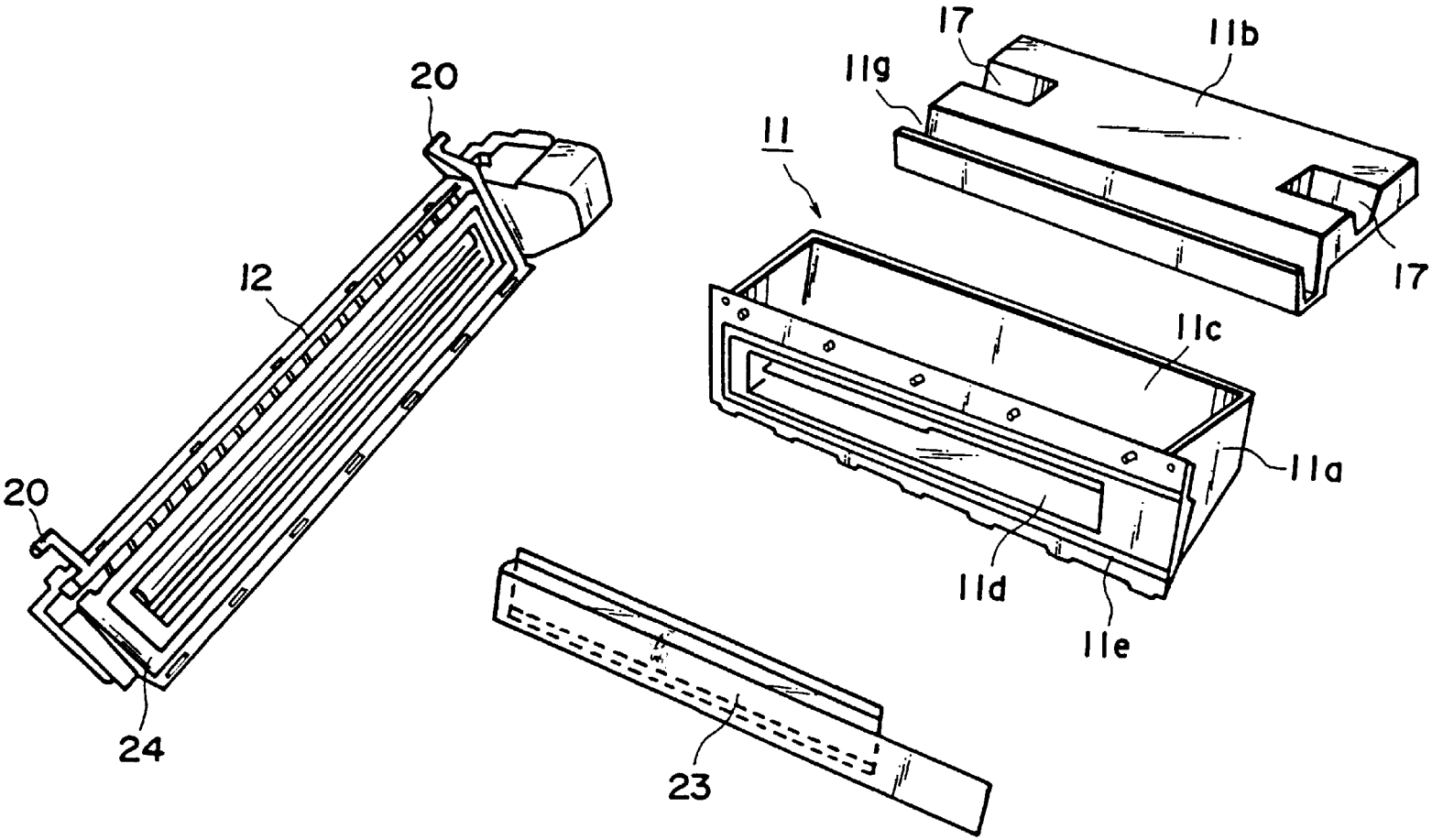
FIG. 39 illustrates separation between a toner container and a developing frame.

Referring to FIG. 39, when assembling the toner container 111, it is started from the actual container portion 111*a* among the various components. First, the toner discharge opening 111*d* of the actual container portion 111*a* is sealed with a sealing member 123. The sealing member 123 is no less than twice as long as the toner discharge opening 111*d* in the longitudinal direction. It is welded to the flange 111*e* formed around the discharge opening 111*d,* being extended from one longitudinal end of the toner discharge opening 111*d* to the other, and the remainder of the sealing member 123 is doubled back, so that the loose end of the sealing member 123 is exposed from between the joint of the toner container 111 and developing frame 112. When the process cartridge B is put to use, a user pulls the sealing member 123 out by grasping the exposed loose end of the sealing member 123, peeling it from the flange 111*e* to expose the toner discharge opening 111*d*.

When welding the sealing member 123, the cover member 111*b* will not have been attached to the actual container portion 111*a;* therefore, the top of the actual container portion 111*a* is open. Consequently, a welding pad for welding the sealing member 123 can be inserted from the top of the actual container portion 111*a,* to be placed behind the flange 111*e*, making it easier to weld the sealing member 123.

After the toner discharge opening 111*d* is sealed with the sealing member 123 as described above, the cover member 111*b* is welded to the top portion of the actual container portion 111*a*. In order to weld together the cover member 111*b* and actual container portion 111*a,* an energy director 111*h* and an accommodating portion 111*i* are provided on the cover member 111*b* and the actual container portion 111*a,* respectively. Since the energy director 111*h* and accommodating portion 111*i* are formed so as to project outward from the toner container 111, the welding horn and welding pad can be placed at a predetermined location, with no difficulty.

After the sealing member 123 and cover member 111*b* are welded to the actual container portion 111*a,* a predetermined amount of toner is filled into the toner container 111 through an unillustrated toner filling opening, and then, the toner filling opening is sealed with a cap or the like.

Then, the toner container 111 and developing frame 112 are welded together. In this case, the flange 111*e* of the toner container 111 is joined with the flange 112*a* of the developing frame 112, and the longitudinal edges of these flanges 111*e* and 112*a* are welded together. As for the widthwise edges of the flanges 111*e* and 112*a*, they are not welded so that the sealing member 123 can be exposed as described above. In order to prevent toner leakage from these portions which are not welded, a toner leakage prevention seal 124 formed of foamed polyurethane or the like is attached to the pertinent portions of the flange 112*a* of the developing frame 112, which is joined with the counterpart of the toner container 111, as illustrated in FIG. 39.

Referring to FIG. 37, since these flanges 111*e* and 112*a* are formed so as to project downward from the process cartridge B, the welding horn and welding pad can be applied with no difficulty when they are welded together along their longitudinal edges.

In this embodiment, in order to increase the capacity of the toner storing portion 119*a*, the cover member 111*b* is rendered to bulge upward. However, the cover member 111*b* is provided with the recessed portion 111*g;* therefore, welding tools such as the welding pad can be inserted through this recessed portion 111*g,* making it easier to weld the top portion of the welding joint between the flanges 111*e* and 112*a*.

After the toner container 111 and developing frame 112 are united as described above, the developing members such as the developing roller 119*c*, developing blade 119*d*, stirring member 119*e*, and the like, are assembled into the united frames, completing the developing unit.

Even when the toner container 111 is rendered to bulge upward in order to increase the capacity of the toner storing portion 119*a* as described above, the toner can be reliably fed into the developing chamber by forming the aforementioned two slanted surfaces, the first and second toner descension surface 111*c* and 111*f*, without a need for a dedicated toner feeding mechanism.

Further, the toner container 111 is constituted of two components; the actual container portion 111*a* and a cover member, which have no undercut portion, and therefore, can be easily formed of plastic material by injection molding. As a result, the toner container 111 can be manufactured with low cost.

Further, the container 111 is provided with the recessed portion 111*g* to accommodate the welding tools; therefore, even when the capacity of the toner container 111 is increased, the toner container 111 and developing frame 112 can be easily welded together.

Next, another embodiment will be described with reference to FIG. 40. In this drawing, the members with the same functions as those of the preceding embodiment (FIGS. 37–39) are assigned the same reference symbols to adopt their descriptions.

The process cartridge B of this embodiment is different from the one in the preceding embodiment in that the actual container portion 111*a* is open at the bottom though it is also shaped like a bathtub, and therefore, the cover member 111*b* must be welded to the bottom of the actual container portion 111*a*. It is also different in that the cover member 111*b* and sealing member are attached in a different order.

Figure 40:
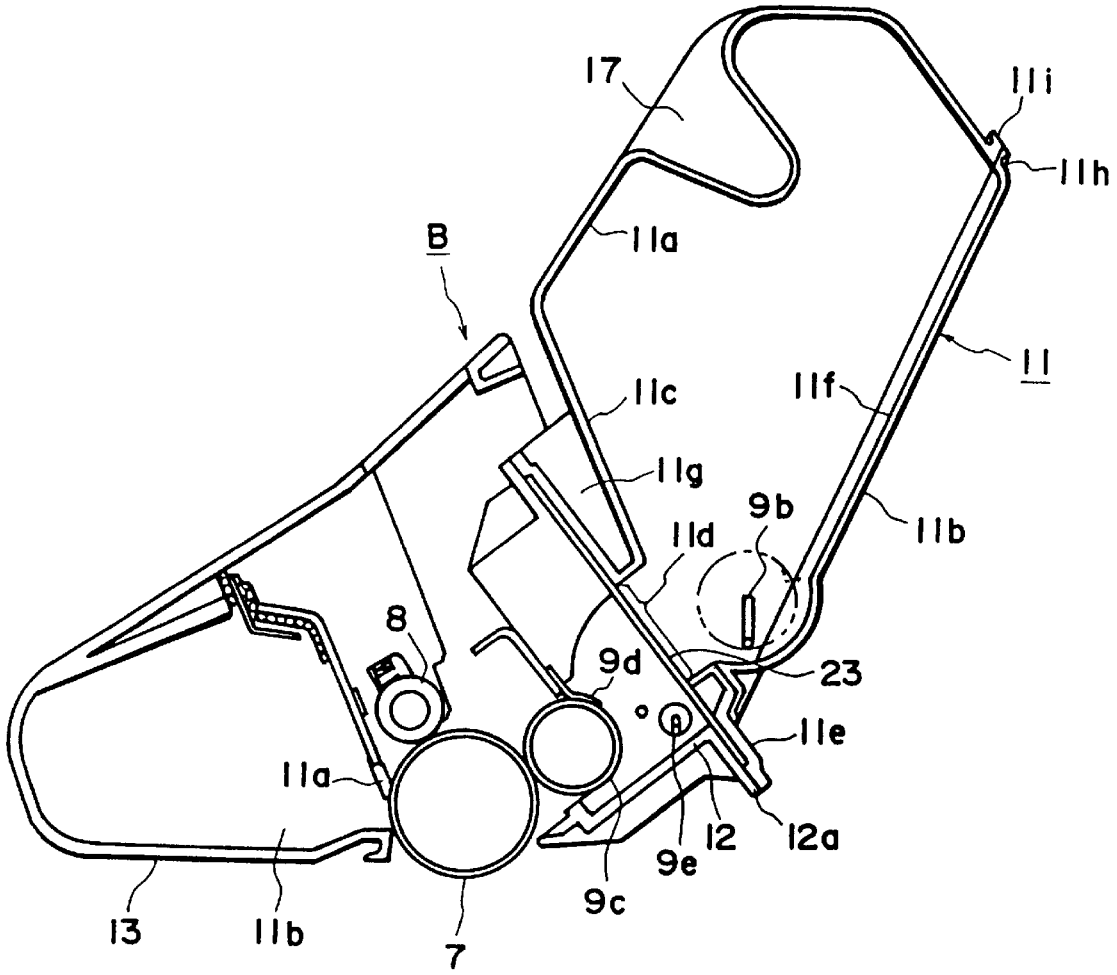
FIG. 40 illustrates a process cartridge according to a further embodiment of the present invention.

Referring to FIG. 40, the actual container portion 111*a*, that is, the first container portion, of the toner container 111 in this embodiment is shaped like an inverted bathtub, with the bottom being open. The top surface of the actual container portion 111*a* is provided with the recessed portions 117 as the handholds. One of the walls of the actual container portion 111*a*, on the side of the developing frame 112, projects inward, constituting the first toner descension surface 111*c*; the exterior side of the first toner descension surface Ill constitutes the recessed portion 111*g*. The angle of the first toner descension surface 111*c* is the same as the angle of the second toner descension surface formed on the cover member 111*b* of the preceding embodiment.

On the other hand, the cover member 111*b* welded to the bottom of the actual container portion 111*a* is provided with the second toner descension surface 111*f*. The angle of the second toner descension surface 111*f* is the same as the angle of the first toner descension surface 111*c* of the first toner descension surface 111*c* formed on the actual container portion 111*a* in the preceding embodiment.

With the structure described above, the toner in the toner storing portion 119*a* descends due to its own weight along the toner descension surfaces 111*c* and 111*f* toward the toner discharge opening 111*d*.

When assembling the toner container 111 from the bathtub shaped actual container portion 111*a* with the open bottom, the cover member 111*b* is first welded to the actual container portion 111*a*. In this case, the welding pad is inserted from the side of the toner discharge opening 111*d* to weld the joint adjacent to the edges of the toner discharge opening 111*d*. Therefore, in this embodiment, the cover member 111*b* is welded to the actual container portion 111 before the toner discharge opening 111*d* is sealed with the sealing member 123, which makes this embodiment different from the first embodiment.

After the cover member 111*b* is welded, the toner discharge opening is sealed by welding the sealing member 123 thereon. When welding the sealing member 123, the welding pad can be inserted from the recessed portion 111*g* provided on the actual container portion 111*a*; therefore, the sealing member 123 can be easily welded to the flange 111*c*.

Thereafter, the toner is filled, and the developing members such as the developing roller 119*c* and the like are assembled into the pertinent frame portions, to complete the developing unit. This step is the same as the one in the preceding embodiment.

Even when the actual container portion 111*a* with the open bottom is employed, the same results as the preceding embodiment can be obtained by providing the actual container portion 111*a* with the first and second toner descension surface 111*c* and 111*f*.

As described above, according to the present invention, predetermined sections of the toner container are formed into the first and second slanted toner descension surfaces; therefore, even when the toner container is bulged upward in order to increase the capacity of the toner storing portion in the developing apparatus or process cartridge, the toner can be reliably fed into the developing chamber.

Further, the toner container is assembled from two components; the actual container portion and a cover member, which have no undercut portion, and therefore, can be easily formed of plastic material by injection molding. As a result, the toner container can be manufactured with low cost.

Further, the toner container is provided with the recessed portion for the welding tools; therefore, even when the capacity of the toner container is increased, the toner container and developing frame can be easily welded together.

Further, in each of the preceding embodiments, the process cartridge B is of a type which is used to form a monochrome image, but the present invention is also applicable to a multicolor process cartridge, which comprises two or more developing means and is used to form a multicolor image (image of two colors, three colors, or full-color).

As for the electrophotographic photosensitive member, it is not limited to the aforementioned photosensitive drum 7. The present invention is also applicable to the following. To begin with, the photoconductive material is usable as the photosensitive material. As for the photoconductive material, amorphous silicon, amorphous selenium, zinc oxide, titanium oxide, organic photoconductor (OPC), or the like, is usable. Further, as for the configuration of a base member on which the photosensitive material is placed, a base member in the form of a drum or a belt is used. For example, in the case of the base member of the drum type, the photoconductive material is coated, deposited, or placed by the like means on a cylinder of aluminum alloy or the like.

As for the developing method, the present invention is compatible with various well-known methods such as the double component magnetic brush developing method, cascade developing method, touch down developing method, cloud developing method, and the like.

Further, as to the structure of the charging means, the so-called contact charging method is employed in the first embodiment, but it is needless to say that the present invention is also applicable to other conventional charging methods such as the one in which a metallic shield of aluminum or the like is placed on three sides of a tungsten wire, and positive or negative ions generated by applying a high voltage to the tungsten wire are transferred onto the surface of the photosensitive drum to charge it uniformly.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constituted of a blade, fur brush, magnetic brush, or the like.

As described above, all of the plural electrical contact points of the process cartridge are disposed on only one of the lateral surfaces of the cartridge frame; therefore, the electrical connection between the process cartridge and image forming apparatus can be reliably established by positioning the process cartridge in such a manner as to be pressed by elastic means toward its lateral surface where the electrical contact points are disposed.

Further, the electrical connection, as well as the driving mechanism connection, between the process cartridge and image forming apparatus can be more reliably established by means of disposing the helical gear-and electrical contact points on the side toward which the electrophotographic photosensitive member is pressed by the rotation of the helical gear for transmitting the driving force to the photosensitive member.

Further, the distance the wiring must be routed within the process cartridge can be shortened by means of disposing each of the contact points in the same manner as described in the preceding embodiments.

Further, according to the present invention, the electrical circuit board of the apparatus main assembly, to which the aforementioned electrical contact points are to be connected, can be vertically arranged on the lateral surface of the apparatus main assembly; therefore, the apparatus size can be reduced.

As described in the foregoing, according to the present invention, the toner supply performance is high even if the amount of toner is large.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

(i) an electrophotographic photosensitive member;

(ii) a developing member configured and positioned with respect to said electrophotographic photosensitive member to develop a latent image formed on said electrophotographic photosensitive member;

(iii) a developer accommodating container configured to accommodate a developer to be used by said developing member to develop the latent image; and (iv) a driving force transmission member, said developer container including:

(a) a developer stirring member configured and positioned to stir the developer which is contained in said developer accommodating container and which is to be fed toward said developing member, said developer stirring member being driven by said driving force transmission member;

(b) a first frame including:

a supporting portion, provided at a longitudinal end of said first frame, configured and positioned to support an end of said developer stirring member;

an end opening, provided at the other longitudinal end of said first frame, configured and positioned to permit transmission of a rotational driving force from said driving force transmission member to said developer stirring member;

a developer supply opening configured and positioned to permit the developer to pass toward said developing member, the developer supply opening extending in a longitudinal direction; and a developer filling opening configured and positioned to permit the developer accommodating container to be filled with developer; and (c) a second frame connected with said first frame so as to close said first frame, thus constituting with said first frame said developer accommodating container for the developer; and (d) a gripping portion configured and positioned to permit said process cartridge to be gripped, said gripping portion being constituted by a part of said first frame and a part of said second frame.

2. A process cartridge according to claim 1, wherein said photosensitive member is in the form of a drum, wherein a longitudinal end of said photosensitive member is provided with a helical gear for receiving the driving from the main assembly when said process cartridge is mounted to the main assembly, and wherein said driving force transmission member transmits the driving force received by the helical gear from the main assembly, to said developer stirring member.

3. A process cartridge according to claim 2, wherein said helical gear is provided at the same longitudinal end of said process cartridge as an end having said end opening and said developer filling opening.

4. A process cartridge according to claim 3, wherein said end opening and said developer filling opening are covered by a side cover.

5. A process cartridge according to claim 4, wherein said developer supply opening is sealed by a removable seal, wherein said seal is pulled out of said process cartridge before said process cartridge is mounted to the main assembly, by which said developer supply opening is opened.

6. A process cartridge according to claim 4, wherein said side cover is provided with a developing bias contact for receiving, from the main assembly, a developing bias voltage to be applied to said developing member.

7. A process cartridge according to claim 4, wherein said developer supply opening is sealed by a removable seal, wherein said seal is pulled out of said process cartridge before said process cartridge is mounted to the main assembly, by which said developer supply opening is opened.

8. A process cartridge according to claim 4, wherein said side cover is provided with a developing bias contact for receiving, from the main assembly, a developing bias voltage to be applied to said developing member.

9. A process cartridge according to claim 1, wherein said developer supply opening is sealed by a seal, wherein said seal is pulled out of said process cartridge before said process cartridge is mounted to the main assembly, by which said developer supply opening is opened.

10. A process cartridge according to claim 1, wherein said first frame further includes a plurality of partition members, extending in a widthwise direction of said first frame, for preventing the developer in said developer accommodating container from moving in the longitudinal direction.

11. A process cartridge according to claim 10, wherein as seen from the longitudinal direction of said first frame, a part of each of said partition members partly blocks the view through said developer filing opening.

12. A process cartridge according to any one of claims 1–11, wherein said driving force transmission member enters said end opening.

13. A process cartridge according to any of claims 1–11, wherein said end opening and said developer filling opening are provided at the same side in the longitudinal direction of said first frame.

14. A process cartridge according to claim 13, wherein said driving force transmission member enters said end opening.

15. A process cartridge according to claim 13, wherein said photosensitive member is in the form of a drum, wherein a longitudinal end of said photosensitive member is provided with a helical gear for receiving the driving force from the main assembly when said process cartridge is mounted to the main assembly, and wherein said driving force transmission member transmits the driving force received by the helical gear from the main assembly, to said developer stirring member.

16. A process cartridge according to claim 15, wherein said helical gear is provided at the same longitudinal end of said process cartridge as an end having said end opening and said developer filling opening.

17. A process cartridge according to claim 16, wherein said end opening and said developer filling opening are covered by a side cover.

18. A process cartridge according to claim 17, wherein said developer supply opening is sealed by a removable seal, wherein said seal is pulled out of said process cartridge before said process cartridge is mounted to the main assembly, by which said developer supply opening is opened.

19. A process cartridge according to claim 17, wherein said side cover is provided with a developing bias contact for receiving, from the main assembly, a developing bias voltage to be applied to said developing member.

20. A process cartridge according to claim 1, wherein the part of said first frame constituting said gripping portion is in the form of a recess.

21. A process cartridge according to claim 1 or 20, wherein said second frame is provided on its outer surface with a plurality of ribs extending in the longitudinal direction, as the part of said second frame constituting said gripping portion.

22. A process cartridge according to claim 21, wherein said end opening and said developer filling opening are provided at the same side in the longitudinal direction of said first frame.

23. A process cartridge according to claim 22, wherein said driving force transmissin member enters said end opening.

24. A process cartridge according to claim 22, wherein said photosesitive member is in the form of a drum, wherein a longitudinal end of said photosensitive member is provided with a helical gear for receiving the driving force from the main assembly when said process cartridge is mounted to the assembly, wherein said driving force transmission member transmits the driving force received by the helical gear from the main assembly, to said developer stirring member.

25. A process cartridge according to claim 24, wherein said helical gear is provided at the same longitudinal end of said process cartridge as an end having said end opening and said developer filling opening.

26. A process cartridge according to claim 25, wherein said end opening and said developer filling opening are covered by a side cover.

27. A process cartridge according to claim 26, wherein said developer supply opening is sealed by a removable seal, wherein said seal is pulled out of said process cartridge before said process cartridge is mounted to the main assembly, by which said developer supply opening is opened.

28. A process cartridge according to claim 26, wherein said side cover is provided with a developing bias contact for receiving, from the main assembly, a developing bias voltage to be applied to said developing member.

29. A process cartridge according to claim 21, wherein said driving force transmission member enters said end opening.

30. A process cartridge according to claim 21, wherein said photosensitive member is in the form of a drum, wherein a longitudinal end of said photosensitive member is provided with a helical gear for receiving the driving force from the main assembly when said process cartridge is mounted to the main assembly, and wherein said driving force transmission member transmits the driving force received by the helical gear from the main assembly, to said developer stirring member.

31. A process cartridge according to claim 30, wherein said helical gear is provided at the same longitudinal end of said process cartridge as an end having said end opening and said developer filling opening.

32. A process cartridge according to claim 31, wherein said end opening and said developer filling opening are covered by a side cover.

33. A process cartridge according to claim 32, wherein said developer supply opening is sealed by a removable seal, wherein said seal is pulled out of said process cartridge before said process cartridge is mounted to the main assembly, by which said developer supply opening is opened.

34. A process cartridge according to claim 32, wherein said side cover is provided with a developing bias contact for receiving, from the main assembly, a developing bias voltage to be applied to said developing member.

35. A process cartridge according to claim 20, wherein said second frame is provided on its outer surface with a plurality of ribs as said gripping portion, extending in the longitudinal direction.

36. A process cartridge according to claim 35, wherein said driving force transmission member enters said end opening.

37. A process cartridge according to claim 35, wherein said photosensitive member is in the form of a drum, wherein a longitudinal end of said photosensitive member is provided with a helical gear for receiving the driving force from the main assembly when said process cartridge is mounted to the main assembly, and wherein said driving force transmission member transmits the driving force received by the helical gear from the main assembly, to said developer stirring member.

38. A process cartridge according to claim 37, wherein said helical gear is provided at the same longitudinal end of said process cartridge as an end having said end opening and said developer filling opening.

39. A process cartridge according to claim 38, wherein said end opening and said developer filling opening are covered by a side cover.

40. A process cartridge according to claim 39, wherein said developer supply opening is sealed by a removable seal, wherein said seal is pulled out of said process cartridge before said process cartridge is mounted to the main assembly, by which said developer supply opening is opened.

41. A process cartridge according to claim 39, wherein said side cover is provided with a developing bias contact for receiving, from the main assembly, a developing bias voltage to be applied to said developing member.

42. A process cartridge according to claim 20, wherein said end opening and said developer filling opening are provided at the same side in the longitudinal direction of said first frame.

43. A process cartridge according to claim 42, wherein said driving force transmission member enters said end opening.

44. A process cartridge according to claim 42, wherein said photosensitive member is in the form of a drum, wherein a longitudinal end of said photosensitive member is provided with a helical gear for receiving the driving force from the main assembly when said process cartridge is mounted to the main assembly, and wherein said driving force transmission member transmits the driving force receive by the helical gear from the main assembly, to said developer stirring member.

45. A process cartridge according to claim 44, wherein said helical gear is provided at the same longitudinal end of said process cartridge as an end having said end opening and said developer filling opening.

46. A process cartridge according to claim 45, wherein said end opening and said developer filling opening are covered by a side cover.

47. A process cartridge according to claim 46, wherein said developer supply opening is sealed by a removable seal, wherein said seal is pulled out of said process cartridge before said process cartridge is mounted to the main assembly, by which said developer supply opening is opened.

48. A process cartridge according to claim 46, wherein said side cover is provided with a developing bias contact for receiving, from the main assembly, a developing bias voltage to be applied to said developing member.

49. A process cartridge according to claim 20, wherein said driving force transmission member enters said end opening.

50. A process cartridge according to claim 20, wherein said photosensitive member is in the form of a drum, wherein a longitudinal end of said photosensitive member is provided with a helical gear for receiving the driving force from the main assembly when said process cartridge is mounted to the main assembly, and wherein said driving force transmission member transmits the driving force received by the helical gear from the main assembly, to said developer stirring member.

51. A process cartridge according to claim 50, wherein said helical gear is provided at the same longitudinal end of said process cartridge as an end having said end opening and said developer filling opening.

52. A process cartridge according to claim 51, wherein said end opening and said developer filling opening are covered by a side cover.

53. A process cartridge according to claim 52, wherein said developer supply opening is sealed by a removable seal, wherein said seal is pulled out of said process cartridge before said process cartridge is mounted to the main assembly, by which said developer supply opening is opened.

54. A process cartridge according to claim 52, wherein said side cover is provided with a developing bias contact for receiving, from the main assembly, a developing bias voltage to be applied to said developing member.

55. A process cartridge detachably mountable to a main assembly of an electrophotographic image forming apparatus, said process cartridge comprising:

(i) an electrophotographic photosensitive drum;

(ii) a helical gear, provided at a longitudinal end of said photosensitive drum, configured and positioned to receive a driving force from the main assembly when said process cartridge is mounted to the main assembly;

(iii) a charging member configured and positioned to electrically charge said photsensitive drum;

(iv) a drum frame configured and positioned to support said photosensitive drum and said charging member;

(v) a developing roller configured and positioned to develop a latent image formed on said photosensitive drum;

(vi) a developing frame configured and positioned to support said developing roller; and (vii) a developer accommodating container configured and positioned to accommodate a developer to be used by said developing roller to develop the latent image, said developer accommodating container being connected with said developing frame;

(viii) a driving force transmission member, said developer accommodating container including:

(a) a developer stirring member configured and positioned to stir the developer that is contained in said developer accommodating container and that is to be fed toward said developing roller, said developer stirring member being driven by said driving force transmission member;

(b) a first frame including:

a supporting portion, provided at a longitudinal end of said first frame, configured and positioned to support an end of said developer stirring member;

an end opening, provided at the other longitudinal end of said first frame, configured and positioned to permit transmission of a rotational driving force from the driving force transmission member to said developer stirring member;

a developer supply opening configured and positioned to permit the developer to pass toward said developing roller, the developer supply opening extending in a longitudinal direction; and a developer filling opening configured and positioned to permit the developer accommodating container to be filled with developer; and (c) a second frame connected with said first frame so as to close said first frame, thus constituting with said first frame said developer accommodating container for the developer, wherein said developing frame and said developer accommodating container connected with each other are rotatably connected with said drum frame;

(ix) a removable toner seal configured and positioned to seal said developer supply opening, wherein said toner seal is pulled out of said process cartridge before said process cartridge is mounted to the main assembly by which the developer supply opening is opened; and (x) a gripping portion configured and positioned to permit said process cartridge to be gripped provided in said frist frame and said second frame, wherein said end opening and said developer filling opening are provided at the same side in the longitudinal direction of said first frame.

56. A process cartridge according to claim 55, wherein said first frame further includes a plurality of partition members, extending in a widthwise direction of said first frame, for preventing the developer in said developer accommodating container from moving in the longitudinal direction.

57. A process cartridge according to claim 56, wherein as seen from the longitudinal direction of said first frame, a part of each of said partition members partly blocks the view through said developer filling opening.

58. A process cartridge according to claim 55, wherein said developing frame and said developer accommodating container are connected to each other by welding.

59. A process cartridge according to claim 58, wherein the welding is ultrasonic welding.

60. A process cartridge according to claim 55, wherein the part of said first frame constituting said gripping portion is in the form of a recess.

61. A process cartridge according to claims 55 or 60, wherein said second frame is provided on its outer surface with a plurality of ribs extending in the longitudinal direction, as the part of said second frame constituting said gripping portion.

62. A process cartridge according to claim 61, wherein said end opening and said developer filling opening are covered by a side cover, and wherein said side cover is provided with a developing bias contact for receiving, from the main assembly, a developing bias voltage to be applied to said developing roller.

63. A process cartridge according to claim 1 or 55, wherein said first and second frames are made of plastic resin material.

64. A process cartridge detachably mountable to a main assembly of an electrophotographic image forming apparatus, said process cartridge comprising:

(i) an electrophotographic photosensitive drum;

(ii) a first helical gear, provided at a longitudinal end of said photosensitive drum, configured and positioned to receive a driving force from the main assembly when said process cartridge is mounted to the main assembly;

(iii) a charging roller configured and positioned to electrically charge said photosensitive drum, wherein said charging roller is contacted to said photosensitive drum;

(iv) a drum frame configured and positioned to support said photosensitive drum and said charging roller;

(v) a developing roller configured and positioned to develop a latent image formed on said photosensitive drum, wherein said developing roller is provided at a longitudinal end thereof with a second helical gear engaged with said first helical gear to receive a driving force for rotating said developing roller;

(vi) a developing frame configured and positioned to support said developing roller; and (vii) a developer accommodating container configured and positioned to accommodate a developer to be used by said developing roller to develop the latent image, said developer accommodating container being connected with said developing frame;

(viii) a driving force transmission member, said developer accommodating container including:

(a) developer stirring member configured and positioned to stir the developer that is contained in said developer accommodating container and that is to be fed toward said developing roller, said developing stirring member being driven by said driving force transmission member;

(b) a first frame including:

a supporting portion, provided at a longitudinal end of said first frame, configured and positioned to support an end of said developer stirring member;

an end opening, provided at the other longitudinal end of said first frame, in which said driving force transmission member is supported, configured and positioned to permit transmission of a rotational driving force to said developer stirring member through said second helical gear;

a developer supply opening configured and positioned to permit the developer to pass toward said developing roller, the developer supply opening extending in a longitudinal direction; and a developer filling opening configured and positioned to permit the developer accommodating container to be filled with developer; and (c) a second frame connected with said first frame so as to close said first frame, thus constituting with said first frame the developer accommodating container, wherein said developing frame and said developer accommodating container connected with each other are rotatably connected with said drum frame;

(ix) a removable toner seal configured and positioned to seal said developer supply opening, wherein said toner seal is pulled out of said process cartridge before said process cartridge is mounted to the main assembly by which the developer supply opening is opened; and (x) a gripping portion configured and positioned to permit said process cartridge to be gripped provided in said first frame and said second frame, wherein said end opening and said developer filling opening are provided at the same side in the longitudinal direction of said first frame, (xi) a side cover configured and positioned to cover said end opening and side developer filling opening, and wherein said side cover is provided with a developing bias contact for receiving, from the main assembly, a developing bias voltage to be applied to said developing roller when said process cartridge is mounted to the main assembly, wherein said first and second frames are made of plastic resin material.

65. A process cartridge according to claim 64, wherein said first frame further includes a plurality of partition members, extending in a direction crossing with a longitudinal direction of said first frame, for preventing the developer in said developer accommodating container from moving in the longitudinal direction.

66. A process cartridge according to claim 65, wherein as seen from the longitudinal direction of said first frame, a part of each of said partition members partly blocks the view through said developer filling opening.

67. A process cartridge according to claim 64, wherein the part of said first frame constituting said gripping portion is in the form of a recess.

68. A process cartridge according to claim 64, wherein said developing frame and said developer accommodating container are connected to each other by welding.

69. A process cartridge according to claim 68, wherein the welding is ultrasonic welding.

70. A process cartridge according to claim 64 or 67, wherein said second frame is provided on its outer surface with a plurality of ribs extending in the longitudinal direction, as the part of said second frame constituting said gripping portion.

71. A process cartridge according to claim 64, 65, 66, 67, 68, or 69, wherein said side cover is provided with a detection contact, wherein said detection contact permits detection of mounting of said process cartridge to said main assembly and notification to said main assembly that said process cartridge is mounted to said main assembly.

72. A process cartridge according to claim 71, wherein said detection contact is also used for transmitting to said main assembly information indicating that a remaining amount of the toner reaches a predetermined level.

73. A developer accommodating container for accommodating a developer to be used by a developing member to develop a latent image formed on an electrophotographic photosensitive member in a process cartridge, said developer accommodating container comprising:

(a) a developer stirring member configured and positioned to stir the developer which is contained in said developer accommodating container and which is to be fed toward said developing member, said developer stirring member being driven by a driving force transmission member;

(b) a first name including:

a supporting portion,provided at a longitudinal end of said first frame, configured and positioned to support an end of said developer stirring member;

an end opening, provided at the other longitudinal end of first frame, configured and positioned to permit transmission of a rotational driving force from a driving force transmission member to said developer stirring member;

a developer supply opening configured and positioned to permit the developer to pass toward said developing member, the developer supply opening extending in a longitudinal direction; and a developer filling opening configured and positioned to permit the developer accommodating container to be filled with developer; and (c) a second frame connected with said said first frame so as to close said first frame, thus constituting with said first frame said developer accommodating container for the developer; and (d) a gripping portion configured and positioned to permit said process cartridge to be gripped, said gripping portion being constituted by a part of said first frame and a part of said second frame.

74. A developer accommodating container for accommodating a developer to be used by a developing roller supported by a developing frame in a process cartridge to develop a latent image formed on an electrophotographic photosensitive drum having a helical gear at one end thereof for receiving a driving force a main assembly of an electrophotographic image forming apparatus, being charged by a charging member, and being supported by a drum frame that also supports the charging member, said developer accommodating container comprising:

(a) a developer stirring member configured and positioned to stir the developer that is contained in said developer accommodating container and that is to be fed toward the developing roller, said developer stirring member being driven by a driving force transmission member;

(b) a first frame including:

a supporting portion, provided at a longitudinal end of said first frame, configured and positioned to support an end of said developer stirring member;

an end opening, provided at the other longitudinal end of said first frame, configured and positioned to permit transmission of a rotational driving force from the driving force transmission member to said developer stirring member, a developer supply opening configured and positioned to permit the developer to pass toward the developing roller, the developer supply opening extending in a longitudinal direction; and (c) a second frame connected with said first frame so as to close said first frame, thus constituting with said first frame said developer accommodating container developer, wherein the developing frame and said developer accommodating container connected with each other are rotatably connected with the drum frame;

(d) a removable toner seal configured and positioned to seal said developer supply opening, wherein said toner seal is pulled out of said process cartridge before the process cartridge is mounted to the main assembly by which the developer supply opening is opened; and (e) a gripping portion configured and positioned to permit said process cartridge to be gripped provided in said first frame and said second frame, wherein said end opening and said developer filling opening are provided at the same side in the longitudinal direction of said first frame.

75. A developer accommodating container for accommodating a developer to be used by a developing roller supported by a developing frame in a process cartridge to develop a latent image formed on an electrophotographic photosensitive drum having a first helical gear at one end thereof for receiving a driving force from a main assembly of an electrophotographic image forming apparatus and for transmitting a driving force to the developing roller by engaging a second helical gear at one longitudinal end of the developing roller, being charged by a charging roller, and being supported by a drum frame that also supports the charging roller, said developer accommodating container comprising:

(a) a developer stirring member configured and positioned to stir the developer that is contained in said developer accommodating container and that is to be fed toward the developing roller, said developing stirring member being driven by a driving force transmission member;

(b) a first frame including:

a supporting portion, provided at a longitudinal end of said first frame, configured and positioned to support an end of said developer stirring member;

an end opening, provided at the other longitudinal end of said frist frame, in which the driving force transmission member is supported, configured and posotioned to permit transmission of a rotational driving force to said developer stirring member through the second helical gear;

a developer supply opening configured and positioned to permit the developer to pass toward the developing roller, the developer supply opening extending in a longitudinal direction; and a developer filling opening configured and positioned to permit the developer accommodating container to be filled with developer; and (c) a second frame connected with said first frame so as to close said first frame thus constituting with said first frame the developer accommodating container connected with each said developing frame and said developer accommodating container connected with each other are rotatably connected with said drum frame;

(d) a removable toner seal configured and positioned to seal said developer supply opening, wherein said toner seal is pulled out of the process cartridge before the process cartridge is mounted to the main assembly by which the developer supply opening opened; and (e) a gripping portion configured and positioned to permit the process cartridge to be gripped provided in said first frame and said second frame, wherein said end opening and said developer filling opening are provided at the same side in the longitudinal direction of said first frame, (f) a side cover configured and positioned to cover said end opening and said developer filling opening, and wherein said side cover is provided with a developing bias contact for receiving, from the main assembly, a developing bias voltage to be applied to the developing roller when said process cartridge is mounted to the main asembly, wherein said first and second frames are made of plastic resin material.

76. An electrophotographic image forming apparatus, for forming an image on a recording material, having a main assembly to which a process cartridge is detachably mountable, said apparatus comprising:

a mounting member for mounting thereon a process cartridge including: (i) an electrophotographic photosensitive member; (ii) a developing member configured and positioned with respect to said electrophotographic photosensitive member to develop a latent image formed on said electrophotographic photosensitive member; (iii) a developer accommodating container configured to accommodate a developer to be used by said developing member to develope the latent image; and a driving force transmiossion member, said developer accommodating container including: (a) a developer stirring member configured and positioned to stir the developer which is contained in said developer accommodating container and which to be fed toward said developing member, said developer stirring member being driven by said driving force transmission member; (b) a first frame including a supporting portion, provided at a longitudinal end of said first frame, configured and positioned to support an end of said developer stirring member; an end opening, providing at the other longitudinal end of said first frame, configured and positioned to permit transmission of a rotational driving force from said driving force transmission member to said developer stirring member; a developer supply opening configured and positioned to permit the developer to pass toward said developing member, the developer supply opening extending in a longitudinal direction; and a developer filling opening configured and positioned to permit the developer accommodating container to be filled with developer; (c) a second frame connected with said first frame so as to close said first frame, thus constituting with said first frame said developer accommodating container for the developer; and (d) a gripping portion configured configured and positioned to permit said process cartridge to be gripped, said gripping portion being constituted by a part of said first frame and a part of said second frame;

a gear engageable with said electrophotographic photosensitive member when said process cartridge is mounted to said mounting member to transmit a driving force to said electrophotosensitive member; and a feeding member rotatable to feed the recording material through a path to receive the latent image developed by said developing member.

77. An electrophotographic image forming apparatus, for forming an image on a recording material, having a main assembly to which a process cartridge is detachably mountable, said apparatus comprising:

a mounting member for mounting thereon a process cartridge including:(i) an electrophotographic photosensitive drum; (ii) a helical gear, provided at a longitudinal end of said photosensitive drum, configured and positioned to receive a driving force from the main assembly when said process cartridge is mounted to the main assembly; (iii) a charging member configured and positioned to electrically charge said photosensitive drum; (iv) a drum frame configured and positioned to support said photosensitive drum and said charging member; (v) a developing roller configured and positioned to develop a latent image formed on said photosensitive drum; (vi) a developing frame configured and positioned to support said developing roller; and (vii) a developer accommodating container configured and positioned to accommodate a developer to be used by said developing roller to develop the latent image, said developer accommodating container being connected with said developing frame; (viii) a driving force transmission member said developer accommodating container including: (a) a developer stirring member configured and positioned to stir the developer that is contained in said developer accommodating container and that is to be fed toward said developing roller, said developer stirring member being driven by said driving force transmission member; (b) a frist frame including: a supporting portion, provided at a longitudinal end of said first frame configured and positioned to support an end of said developer stirring member; an end opening, provided at the other longitudinal end of said first frame, configured and positioned to permit transmission of a rotational driving force from the driving force transmission member to said developer stirring member; a developer supply opening configured and positioned to permit the developer to pass toward said developing roller, the developer supply opening extending in a longitudinal direction; and a developer filling opening configured and positioned to permit the developer accommodating container to be filled with developer; and (c) a second frame connecting with said first frame so as to close said first frame, thus constituting with said first frame said developer accommodating container for the developer, wherein said developing frame and said developer accommodating container connected with each other are rotatably connected with said drum frame; (ix) a removable toner seal configured and positioned to seal said developer supply opening, wherein said toner seal is pulled out of said process cartridge before said process cartridge is mounted to the main assembly by which the developer supply opening is opened; and (x) a gripping portion configured and positioned to permit said process cartridge to be gripped provided in said frist frame and said second frame, wherein said end opening and said developer filling opening are provided at the same side in the longitudinal direction of said first frame;

a gear engageable with said helical gear when said process cartridge is mounted to said mounting member to transmit a driving force to the helical gear and said electrophotographic photosensitive drum; and a feeding member rotatable to feed the recording material through a path to receive the latent image developed by said developing roller.

78. An electrophotographic image forming apparatus, for forming an image on a recording material, having a main assembly to which a process cartridge is detachably mountable, said apparatus comprising:

a mounting member for mounting thereon a process cartridge including: (i) an electrophotographic photosensitive drum; (ii) a first helical gear, provided at a longitudinal end of said photosensitive drum, configured and positioned to receive a driving force from the main assembly when said process cartridge is mounted to the main assembly; (iii) a charging roller configured and positioned to electrically charge said photosensitive drum, wherein said charging roller is contacted to said photosnsitive drum; (iv) a drum frame configured and positioned to support said photosensitive drum and said charging roller; (v) a developing roller configured and positioned to develop a latent image formed on said photosensitive drum, wherein said developing roller is provided at a longitudinal end thereof with a second helical gear engaged with said first helical gear to receive a driving force for rotating said developing roller; (vi) a developing frame configued and positioned to support said developing roller; and (vii) a developer accommodating container configured and positioned to accommodate a developer to be used by said developing roller to develop the latent image, said developer accommodating container being connected with said developing frame; (viii) a driving force transmission member, said developer accommodating container including: (a) a developer stirring member configured and positioned to stir the developer that is contained in said developer accommodating container and that is to be fed toward said developing roller, said developing stirring member being driven by said driving force transmission member; (b) a first frame including: a supporting portion, provided at a longitudinal end of said first frame, configured and positioned to support an end of said developer stirring member; an end opening, provided at the other logitudinal end of said frist frame, in which said driving force transmission member is supported, configured and positioned to permit transmission of a rotational driving force to said developer stirring member through said second helical gear; a developer supply opening configured and positioned to permit the developer to pass toward said developing roller, the developer supply opening extending in a longitudinal direction; and a developer filling opening configured and positioned to permit the developer accommodating container to be filled with developer; and (c) a second frame connected with said first frame so as to close said first frame, thus constituting with said first frame the developer accommodating container wherein said developing frame and said developer accommodating container connected with each other are rotatably connected with said drum frame; (ix) a removable toner seal configured and positioned to seal said developer supply opening, wherein said toner seal is pulled out of said process cartridge before said process cartridge is mounted to the main assembly by which the developer supply opening is opened; and (x) a gripping portion configured and positioned to permit said process cartridge to be gripped provided in said first frame and said second frame, wherein said end opening and said developer filling opening are provided at the same side in the longitudinal direction of said first frame, (xi) a side cover configured and positioned to cover said end opening and said developer filling opening, and wherein said side cover is provided with a developing bias contact for receiving, from the main assembly, a developing bias voltage to be applied to said developing roller when said process cartridge is mounted to the main assembly, wherein said first and second frames are made of plastic resin material:

a gear engageable with said first helical gear when said process cartridge is mounted to said mounting member to transmit a driving force to said electrophotographic photosensitive drum; and a feeding member rotatable to feed the recording material through a path to receive the latent image developed by said developing roller.

* * * * *

UNITED STATES PATENT AND TRADEMARK OFFICE

CERTIFICATE OF CORRECTION

PATENT NO. : 6,215,969 B1
DATED : April 10, 2001
INVENTOR(S) : Yoshiya Nomura et al.

It is certified that error appears in the above-identified patent and that said Letters Patent is hereby corrected as shown below:

Title page,
Item [56], References Cited, FOREIGN PATENT DOCUMENTS,
"2163761" should read -- 2-163761 --.
OTHER PUBLICATIONS, "Oct. 1997" should read -- Oct. 1987 --.

Column 1,
Line 34, "a-unit" should read -- a unit --.

Figure 9A:
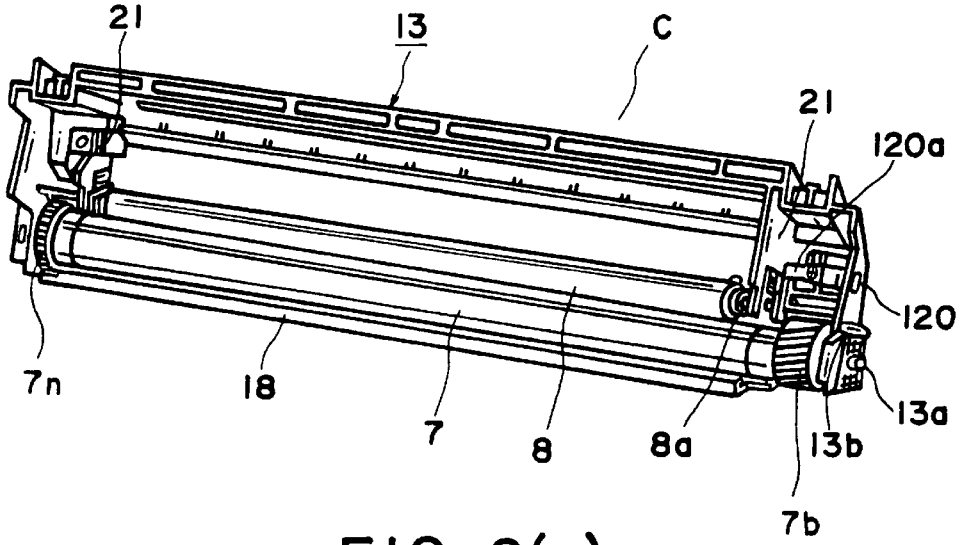
FIG. 9, (*a*) shows an outer appearance of a cleaning unit of the process cartridge of FIG. 3.
Figure 9B:
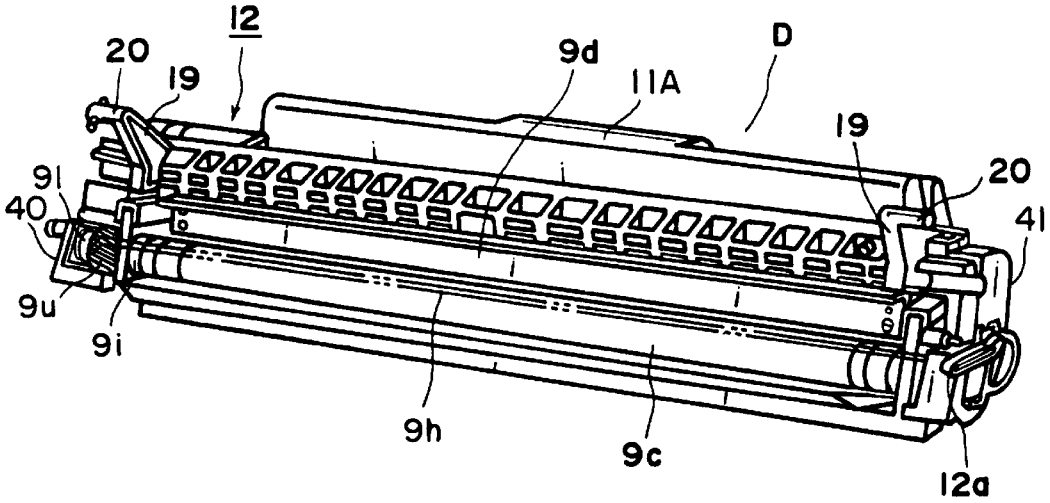

Column 2,
Line 35, "FIG. 9, (a)" should read -- FIG. 9(a) --.
Line 37, "FIG. 9, (b)" should read -- FIG. 9(b) --.

Figure 19A:
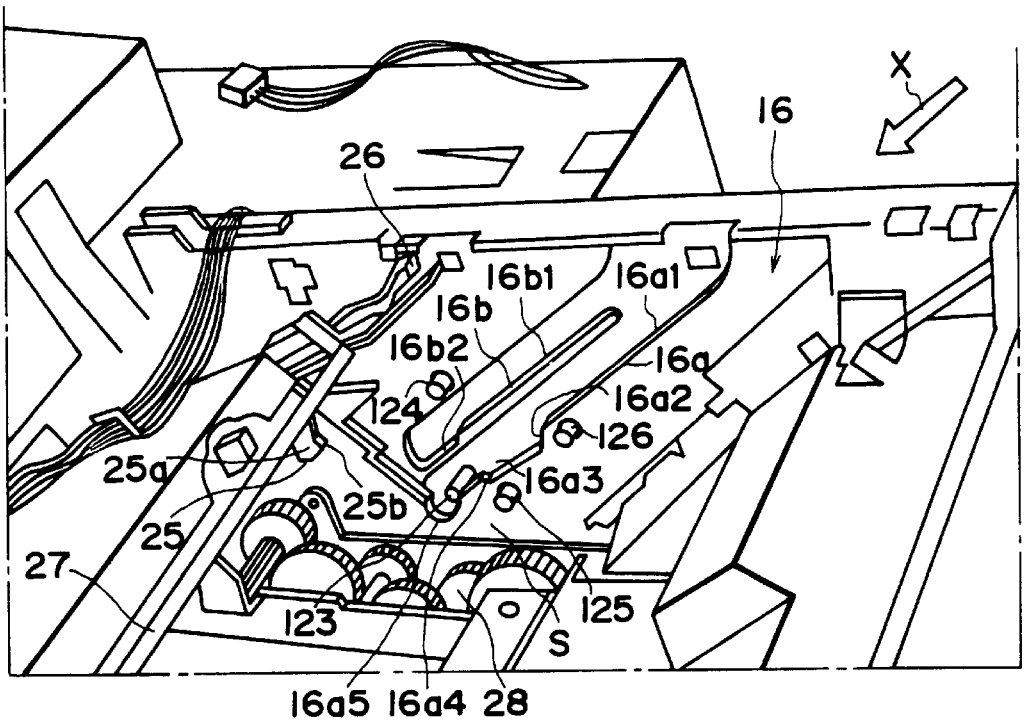
FIG. 19, (*a*) is a perspective view of an inside of the main assembly of the apparatus.
Figure 19B:
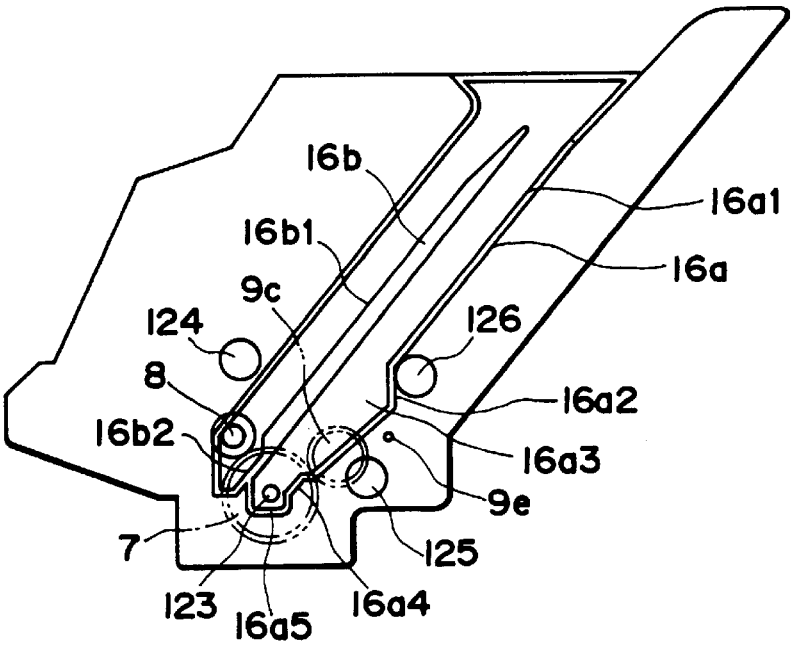

Column 3,
Line 7, "FIG. 19, (a)" should read -- FIG. 19(a) --.
Line 9, "FIG. 19, (b)" should read -- FIG. 19(b) --.
Line 17, "FIG. 23, (a)" should read -- FIG. 23(a) --.
Line 19, "FIG. 23, (b)" should read -- FIG. 23(b) --.

Column 9,
Line 49, "S." should read -- S, --.

Column 12,
Line 60, "portions," should read -- portions --.
Line 62, "a)," should read -- a, --.
Line 62, "an" should read -- the --.

Column 13,
Line 29, "the" should read -- a --.

Column 14,
Line 20, "hla and lib" should read -- 11a and 11b --.

Column 15,
Line 66, "hla" should read -- 11a --.

UNITED STATES PATENT AND TRADEMARK OFFICE

CERTIFICATE OF CORRECTION

PATENT NO. : 6,215,969 B1
DATED : April 10, 2001
INVENTOR(S) : Yoshiya Nomura et al.

It is certified that error appears in the above-identified patent and that said Letters Patent is hereby corrected as shown below:

Column 16,
Line 49, “ald.” should read -- 11d. --.
Line 51, “DA,” should read -- 11A, --.
Lines 52 and 55, “lid” should read -- 11d --.
Lines 53, 55 and 62, “lip” should read -- 11p --.
Line 54, “lid,” should read -- 11d, --.
Line 59, “a 11” should read -- all --.
Line 66, “lip” should read -- 11p --; and “an” should read -- and --.
Line 67, “d” should be deleted.

Column 17,
Line 10, “substantilly” should read -- substantially --.

Column 18,
Line 53, “substantilly” should read -- substantially --.

Column 19,
Line 9, “to-this” should read -- to this --.
Lines 41 and 43, “92” should read -- θ2 --.
Lines 44 and 46, “93” should read -- θ3 --.
Line 59, “FIGS. 26” should read -- FIG. 26 --.
Line 62, “member” should read -- members --.

Column 20,
Line 7, “9d2” should read -- 9d1 --.
Line 32, “(FIG.” should read -- (FIGS. --.
Line 34, “This-arrangement” should read -- This arrangement --.

Column 21,
Line 61, “in” should be deleted.

Column 23,
Line 31, “frame holder” should read -- Frame Holder --.
Line 32, “Frame Holder” should read -- frame holder --.

Column 24,
Line 64, “th e” should read -- the --.

UNITED STATES PATENT AND TRADEMARK OFFICE

CERTIFICATE OF CORRECTION

PATENT NO. : 6,215,969 B1
DATED : April 10, 2001
INVENTOR(S) : Yoshiya Nomura et al.

It is certified that error appears in the above-identified patent and that said Letters Patent is hereby corrected as shown below:

Column 25,
Line 5, “t hat” should read -- that --.
Line 27, “th” should read -- the --.

Column 33,
Line 16, “and” (2nd occurrence) should be deleted.

Column 40,
Line 17, “photosesitive” should read -- photosensitive --.
Line 21, “assembly, wherein” should read -- main assembly, and wherein --.

Column 43,
Line 24, “frist” should read -- first --.

Column 45,
Line 49, “name” should read -- frame --.
Line 54, “first” should read -- said first --.

Column 46,
Line 10, “force” should read -- force from --.
Line 32, “and” should read -- and a developer filling opening configured and positioned to permit the developer accommodating container to be filled with developer; and --.
Line 35, “container” should read -- container for the --.

Column 47,
Line 8, “frist” should read -- first --.
Line 9, “posotioned” should read -- positioned --.
Line 21, “frame” should read -- frame, --.
Line 22, “container con-” should read -- container, wherein --.
Line 23, “nected with each” should be deleted.
Line 30, “opening” should read -- opening is --.
Line 59, “and” should read -- and (iv) --; and “transmiossion” should read -- transmission --.
Line 63, “which” should read -- which is --.

UNITED STATES PATENT AND TRADEMARK OFFICE

CERTIFICATE OF CORRECTION

PATENT NO. : 6,215,969 B1
DATED : April 10, 2001
INVENTOR(S) : Yoshiya Nomura et al.

It is certified that error appears in the above-identified patent and that said Letters Patent is hereby corrected as shown below:

Column 48,
Line 5, “viding” should read -- vided --.
Line 18, “configured” should be deleted.
Line 59, “frist” should read -- first --.
Line 61, “frame” should read -- frame, --.

Column 49,
Line 20, “frist” should read -- first --.

Column 50,
Line 14, “frist” should read -- first --.

Signed and Sealed this

Seventeenth Day of June, 2003

JAMES E. ROGAN
*Director of the United States Patent and Trademark Office*